US011480049B2

(12) United States Patent
Chen et al.

(10) Patent No.: US 11,480,049 B2
(45) Date of Patent: Oct. 25, 2022

(54) DRILLING MODE SEQUENCE CONTROL

(71) Applicant: Schlumberger Technology Corporation, Sugar Land, TX (US)

(72) Inventors: Wei Chen, Katy, TX (US); Rongbing Chen, Beijing (CN); Zhengxin Zhang, Spring, TX (US); Yuelin Shen, Spring, TX (US); Lucian Johnston, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 140 days.

(21) Appl. No.: 16/776,401

(22) Filed: Jan. 29, 2020

(65) Prior Publication Data

US 2021/0230998 A1 Jul. 29, 2021

(51) Int. Cl.
*E21B 47/022* (2012.01)
*E21B 7/04* (2006.01)

(52) U.S. Cl.
CPC ..... *E21B 47/022* (2013.01); *E21B 7/04* (2013.01)

(58) Field of Classification Search
CPC ..... E21B 44/00; E21B 7/04; E21B 47/022
See application file for complete search history.

(56) References Cited

U.S. PATENT DOCUMENTS 6,438,495 B1 8/2002 Chau et al.
6,968,909 B2 11/2005 Aldred et al.
10,221,671 B1 3/2019 Zhang
2012/0024606 A1* 2/2012 Pirovolou ..... E21B 7/04 175/61
2015/0226052 A1 8/2015 Samuel et al.
2017/0328181 A1 11/2017 Kristjansson et al.
2019/0048706 A1 2/2019 Benson et al.
2019/0048707 A1* 2/2019 Benson ..... E21B 7/24
2019/0145240 A1 5/2019 Benson et al.
2019/0330968 A1 10/2019 Boone
2020/0370409 A1 11/2020 Yu et al.

FOREIGN PATENT DOCUMENTS

EP 1335108 A2 8/2003
WO 2010/101473 A1 9/2010
WO 2010101473 A1 9/2010
WO 2012015894 A1 2/2012
WO 2016032640 A1 3/2016

OTHER PUBLICATIONS

International Search Report and Written Opinion for the cross referenced International patent application PCT/US2020//015529 dated Jun. 1, 2020.

(Continued)

*Primary Examiner* — Dany E Akakpo
(74) *Attorney, Agent, or Firm* — Alec J. McGinn

(57) ABSTRACT

A method can include receiving data for a borehole trajectory in a formation, a length of pipe, and a bottom hole assembly that includes a mud motor and a bit; generating a sequence for operation of the mud motor using a model of at least the bit, where the sequence includes a sliding mode and a rotary mode for drilling the borehole in the formation a distance less than or equal to the length of pipe; and drilling the borehole according to the sequence.

20 Claims, 41 Drawing Sheets

(56) References Cited

OTHER PUBLICATIONS

DeepMind, "Safety-first AI for autonomous data centre cooling and industrial control," retrieved at https://deepmind.com/blog/safety-first-ai-autonomous-data-centre-cooling-and-industrial-control/ on Jan. 27, 2020.
Mnih et. Al., "Asynchronous Methods for Deep Reinforcement learning," Proceedings of the 33rd International Conference on Machine Learning, New York, NY, USA, 2016.
Mnih et. al., "Human-level control through deep reinforcement learning," Nature vol. 518, pp. 529, Feb. 26, 2015.
OpenAI, "Learning Dexterity," retrieved at https://blog.openai.com/learning-dexterity/ on Jan. 27, 2020.
Pollock et. al., "Machine Learning for Improved Directional Drilling," Offshore Technology Conference held in Houston, TX USA, Apr. 30-May 3, 2018.

* cited by examiner

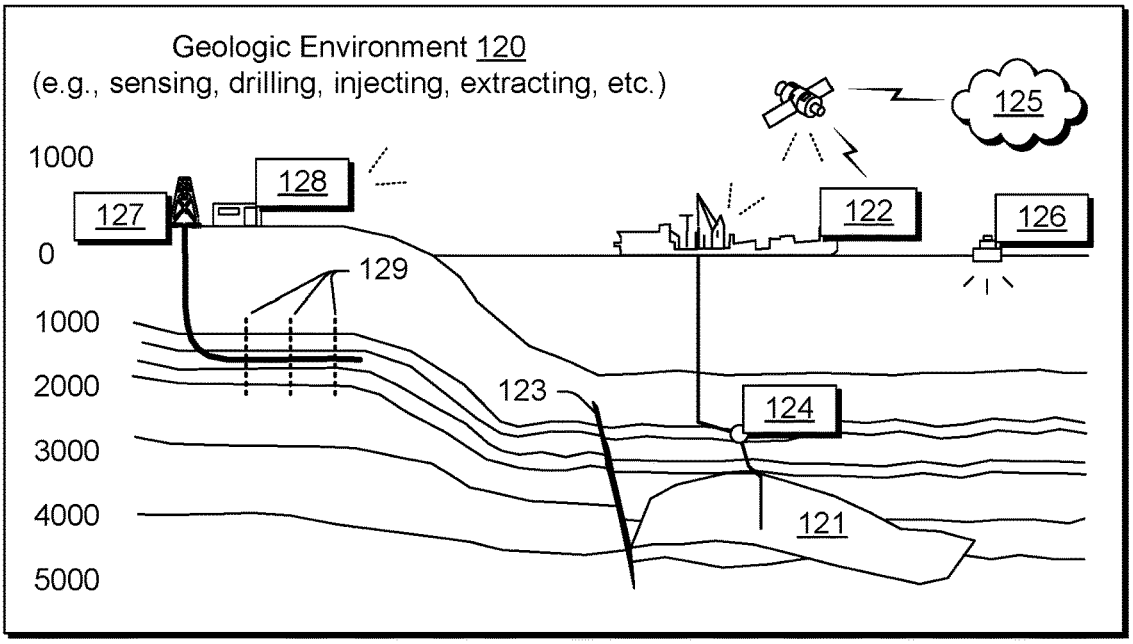
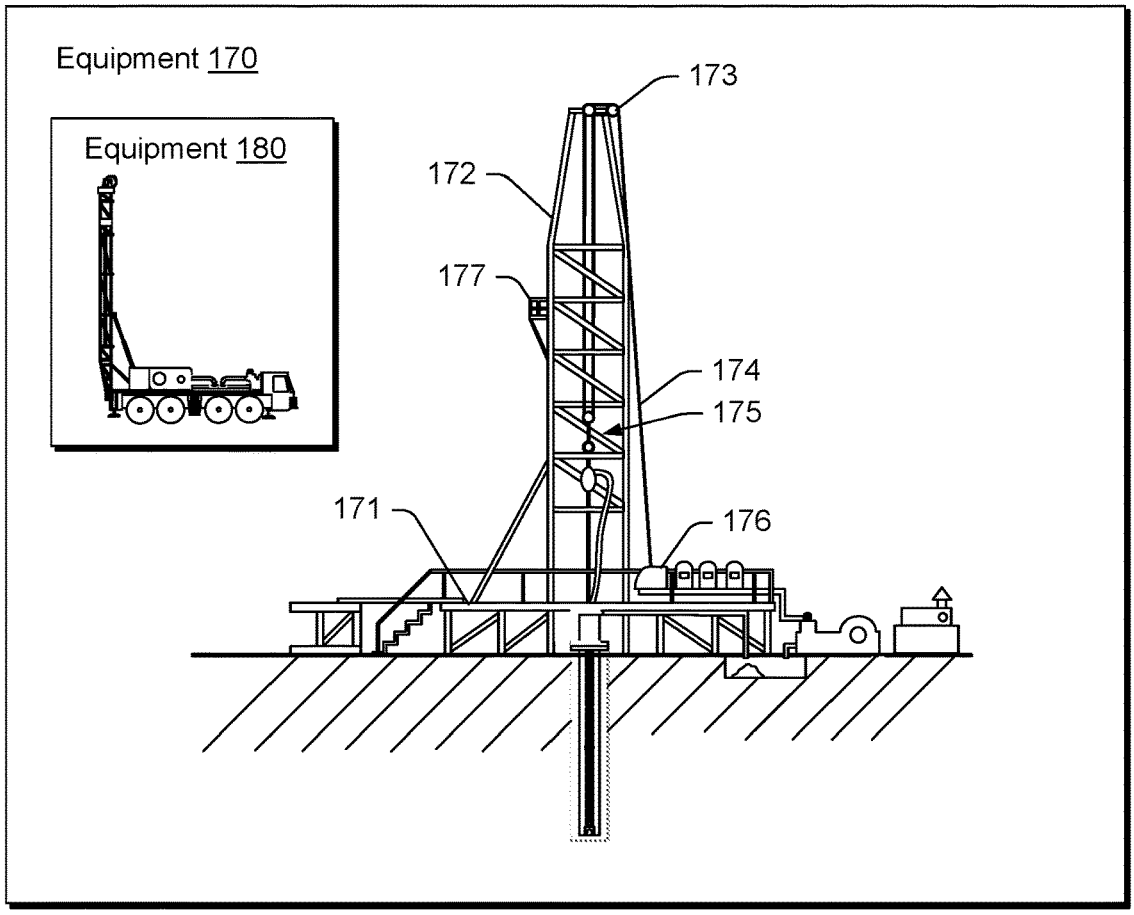
Fig. 1

Point Spreadsheet 670

| x | y | Depth | Pad Config. | Pad Orient. | Well Length | Vertical Spacing | Horiz. Spacing | Toe Height | Step Out | Initial Incl. | Kick Off |
|---|---|---|---|---|---|---|---|---|---|---|---|
| 11 | 93 | 217 | 2 | 90 | 2000 | 50 | 500 | 0 | 1000 | 0 | 0 |
| 11 | 94 | 384 | 1 | 90 | 1000 | 50 | 500 | 0 | 1000 | 0 | 0 |
| 12 | 95 | 282 | 1 | 90 | 1000 | 50 | 500 | 0 | 1000 | 0 | 0 |

GUI 1100

| | ET(h) | TT (days) |
|---|---|---|
| ▽Construct Well | | |
| ▷Construct Section 17.5 in | 59.91 | 2.50 |
| ▷Construct Section 12.5 in | 106.61 | 6.94 |
| ▽Construct Section 8.5 in | | |
| Drilling run (3530-6530ft) | | |
| Safety Meeting | 0.25 | 6.95 |
| Make up BHA | 2.04 | 7.03 |
| Trip in to depth (0-1030ft) | 0.87 | 7.07 |
| Drill shoe track (1030-3530ft) | 1.02 | 7.11 |
| 1110 Drill to depth (3530-6530ft) | 102.08 | 11.37 |
| Circulate to condition hole | 1.02 | 11.41 |
| Conduct flow check | 0.25 | 11.42 |
| Pump slug sweep pill spacer | 0.25 | 11.43 |
| Trip out to depth (6530-0ft) | 5.54 | 11.66 |
| Lay down BHA | 2.04 | 11.75 |
| Wireline run | | |
| Make up wireline toolstring | 2.04 | 11.83 |
| Run in wireline to depth (0-6530ft) | 1.85 | 11.91 |
| Up log wireline to depth (3070-0ft) | 5.09 | 12.12 |
| Lay down wireline toolstring | 2.04 | 12.23 |
| ⋮ | | |

Fig. 11

Method 1200

Method 1400

Method 1710
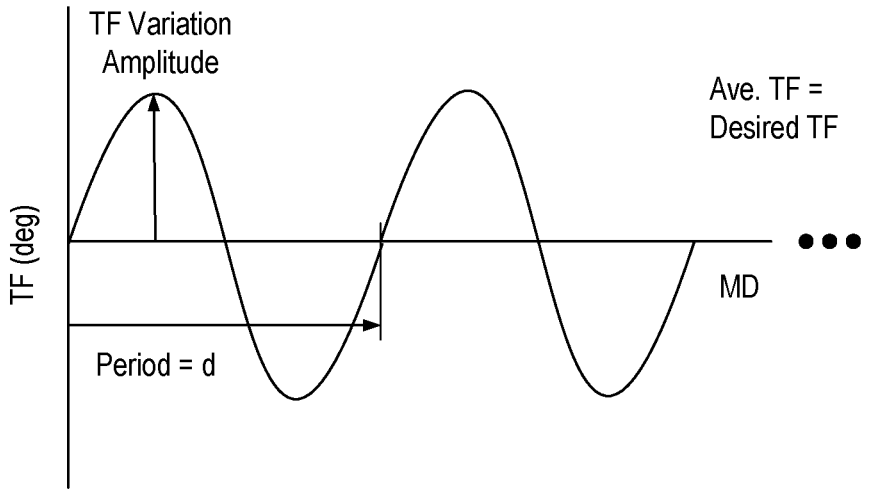
TFA = Avg_TF + TF_Amp sin((180/period)MD)
Method 1730
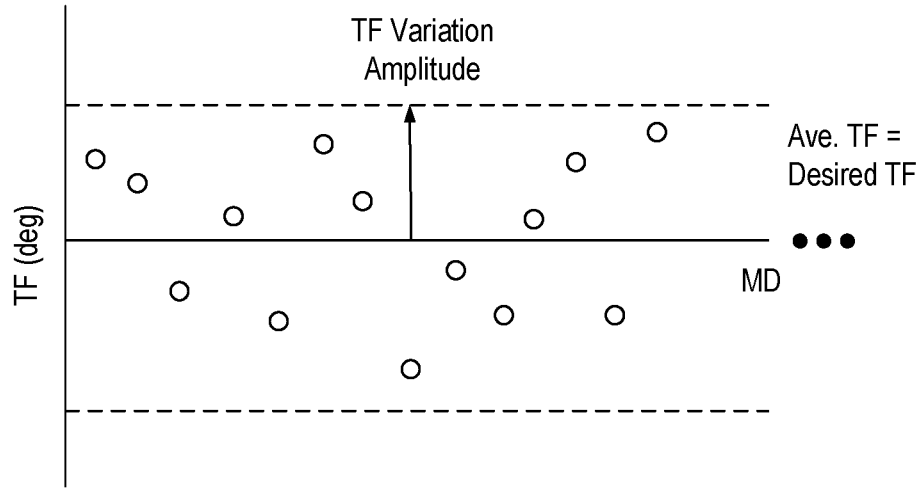
TFA = Avg_TF + Random (-TF_Amp, TF_Amp)
Fig. 17

GUI 1800

| No. | End Depth | WOB | RPM | ROP | TOB | Step | | Bent TFA | Fixed TFA | | On/Off | Flow Rate | Bit Side Cutting Coef. |
|---|---|---|---|---|---|---|---|---|---|---|---|---|---|
| 1 | | | | | | | | | | | | | |
| 2 | | | | | | | | | | | | | |
| 3 | | | | | | | | | | | | | |
| 4 | | | | | | | | | | | | | |
| 5 | | | | | | | | | | | | | |
| 6 | | | | | | | | | | | | | |
| 7 | | | | | | | | | | | | | |
| 8 | | | | | | | | | | | | | |
| 9 | | | | | | | | | | | | | |
| 10 | | | | | | | | | | | | | |

Fig. 18

Method 2000

Input 2010

Input 2020

| MD | Incl | Azi | Diam |
|---|---|---|---|
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |

Input 2030

| Order | Component | OD | ID | Length | Cumulative Length | |
|---|---|---|---|---|---|---|
| 1 | Pipe/Tool Joint/Size | | | | | |
| 2 | HW.DP/Tool Joint/Size | | | | | |
| 3 | Pipe/Tool Joint/Size | | | | | |
| 4 | MWD/LWD | | | | | |
| 5 | FLEX NMDC | | | | | |
| 6 | MWD/LWD | | | | | |
| 7 | Stabilizer | | | | | |
| 8 | Drill Collar | | | | | |
| 9 | Stabilizer | | | | | |
| 10 | Motor/PDM | | | | | |
| 11 | Bit | | | | | |

Input 2100

| Parameters | Value |
|---|---|
| WOB | 25 |
| TOB | 2.5 |
| Flow Rate | 295 |
| Bit Side Cutting Capacity | 0.2 |
| Drilling Step | 0.1 |
| ROP-Rot | 200 |
| ROP-Slide | 80 |
| SRPM-Rot | 50 |
| SRPM-Slide | 0 |
| Stand | 90 |
| Motor | TFA |

If start inclination of stand < 2 deg, TFA = the end azimuth of stand (MTF Simulation Mode)

If start inclination of stand > 2 deg, TFA = calculated well TFA (GTF Simulation Mode)

Fig. 21

GUI 2200

| | | | | | | TF swing (amp=0) | | | TF swing (amp=30) | | | TF swing (amp=60) | | |
|---|---|---|---|---|---|---|---|---|---|---|---|---|---|---|
| Stand # | Start MD | End MD | End Inc | End Azi | DLS | Sliding Ratio (%) | Sliding dist | Rotating dist | Sliding Ratio (%) | Sliding dist | Rotating dist | Sliding Ratio (%) | Sliding dist | Rotating dist |
| 1 | 10000 | 10090 | 8.1 | 80 | 9 | 81 | 72.9 | 17.1 | 85 | 76.5 | 13.5 | 96 | 86.4 | 3.6 |
| 2 | 10090 | 10180 | 16.2 | 80 | 9 | 82 | 73.8 | 16.2 | 85 | 76.5 | 13.5 | 98 | 88.2 | 1.8 |
| 3 | 10180 | 10270 | 24.3 | 80 | 9 | 81 | 72.9 | 17.1 | 85 | 76.5 | 13.5 | 95 | 85.5 | 4.5 |
| 4 | 10270 | 10360 | 32.4 | 80 | 9 | 81 | 72.9 | 17.1 | 85 | 76.5 | 13.5 | 95 | 85.5 | 4.5 |
| 5 | 10360 | 10450 | 40.5 | 80 | 9 | 81 | 72.9 | 17.1 | 85 | 76.5 | 13.5 | 95 | 85.5 | 4.5 |
| 6 | 10450 | 10540 | 48.6 | 80 | 9 | 83 | 74.7 | 15.3 | 86 | 77.4 | 12.6 | 98 | 88.2 | 1.8 |
| 7 | 10540 | 10630 | 56.7 | 80 | 9 | 83 | 74.7 | 15.3 | 86 | 77.4 | 12.6 | 98 | 88.2 | 1.8 |
| 8 | 10630 | 10720 | 64.8 | 80 | 9 | 83 | 74.7 | 15.3 | 86 | 77.4 | 12.6 | 98 | 88.2 | 1.8 |
| 9 | 10720 | 10810 | 72.9 | 80 | 9 | 83 | 74.7 | 15.3 | 86 | 77.4 | 12.6 | 98 | 88.2 | 1.8 |
| 10 | 10810 | 10900 | 81 | 80 | 9 | 83 | 74.7 | 15.3 | 86 | 77.4 | 12.6 | 97 | 87.3 | 2.7 |
| 11 | 10900 | 10990 | 89.1 | 80 | 9 | 83 | 74.7 | 15.3 | 86 | 77.4 | 12.6 | 97 | 87.3 | 2.7 |

Fig. 22

Method 2300

Input 2310

Input 2320

| MD | Incl | Azi | Diam |
|---|---|---|---|
| | | | |
| | | | |
| | | | |

Input 2400

| Parameters | Value |
|---|---|
| WOB | 10 |
| TOB | 1 |
| Flow Rate | 240 |
| Bit Side Cutting Capacity | 0.2 |
| Drilling Step | 0.03 |
| ROP-Rot | 30 |
| ROP-Slide | 10 |
| SRPM-Rot | 30 |
| SRPM-Slide | 0 |
| Stand | 90 |
| Motor | TFA |

If start inclination of stand < 2 deg, TFA = the end azimuth of stand (MTF Simulation Mode)

If start inclination of stand > 2 deg, TFA = calculated well TFA (GTF Simulation Mode)

Fig. 24

GUI 2500

| | | | | | | TF swing (amp=0) | | | TF swing (amp=30) | | | TF swing (amp=60) | | |
|---|---|---|---|---|---|---|---|---|---|---|---|---|---|---|
| Stand # | Start MD | End MD | End Inc | End Azi | DLS | Sliding Ratio (%) | Sliding dist | Rotating dist | Sliding Ratio (%) | Sliding dist | Rotating dist | Sliding Ratio (%) | Sliding dist | Rotating dist |
| 1 | 10067 | 10157 | 7.5 | 80.5 | 8.3 | 66 | 59.4 | 30.6 | 67 | 60.3 | 29.7 | 78 | 70.2 | 19.8 |
| 2 | 10157 | 10247 | 15 | 80.5 | 8.3 | 77 | 69.3 | 20.7 | 79 | 71.1 | 18.9 | 88 | 79.2 | 10.8 |
| 3 | 10247 | 10337 | 22.5 | 80.5 | 8.3 | 76 | 68.4 | 21.6 | 78 | 70.2 | 19.8 | 86 | 77.4 | 12.6 |
| 4 | 10337 | 10427 | 30 | 80.5 | 8.3 | 75 | 67.5 | 22.5 | 78 | 70.2 | 19.8 | 86 | 77.4 | 12.6 |
| 5 | 10427 | 10517 | 37.5 | 80.5 | 8.3 | 75 | 67.5 | 22.5 | 76 | 68.4 | 21.6 | 85 | 76.5 | 13.5 |
| 6 | 10517 | 10607 | 45 | 80.5 | 8.3 | 74 | 66.6 | 23.4 | 76 | 68.4 | 21.6 | 84 | 75.6 | 14.4 |
| 7 | 10607 | 10697 | 52.5 | 80.5 | 8.3 | 74 | 66.6 | 23.4 | 76 | 68.4 | 21.6 | 84 | 75.6 | 14.4 |
| 8 | 10697 | 10787 | 60 | 80.5 | 8.3 | 74 | 66.6 | 23.4 | 76 | 68.4 | 21.6 | 84 | 75.6 | 14.4 |
| 9 | 10787 | 10877 | 67.5 | 80.5 | 8.3 | 74 | 66.6 | 23.4 | 76 | 68.4 | 21.6 | 84 | 75.6 | 14.4 |
| 10 | 10877 | 10967 | 75 | 80.5 | 8.3 | 74 | 66.6 | 23.4 | 76 | 68.4 | 21.6 | 83 | 74.7 | 15.3 |
| 11 | 10967 | 11057 | 82.5 | 80.5 | 8.3 | 74 | 66.6 | 23.4 | 76 | 68.4 | 21.6 | 83 | 74.7 | 15.3 |
| 12 | 11057 | 11147 | 90 | 80.5 | 8.3 | 74 | 66.6 | 23.4 | 76 | 68.4 | 21.6 | 83 | 74.7 | 15.3 |
| 13 | 11147 | 11237 | 90.8 | 80.5 | 0.9 | 34 | 30.6 | 59.4 | 35 | 31.5 | 58.5 | 38 | 34.2 | 55.8 |

Fig. 25

Method 2600

Input 2610

Input 2620

| MD | Incl | Azi | Diam |
|---|---|---|---|
| | | | |

Input 2630

| Order | Component | OD | ID | Length | Cumulative Length |
|---|---|---|---|---|---|
| 1 | Reamer | | | | |
| 2 | DP | | | | |
| 3 | Reamer | | | | |
| 4 | DP | | | | |
| 5 | Reamer | | | | |
| 6 | DP | | | | |
| 7 | Reamer | | | | |
| 8 | DP | | | | |
| 9 | Agitator | | | | |
| 10 | DP | | | | |
| 11 | X/O Sub | | | | |
| 12 | Reamer | | | | |
| 13 | Flex | | | | |
| 14 | Flex | | | | |
| 15 | Flex | | | | |
| 16 | NM UBHO | | | | |
| 17 | Filter Sub | | | | |
| 18 | Reamer | | | | |
| 19 | Motor | | | | |
| 20 | Bit | | | | |

Input 2700

| Parameters | Value |
|---|---|
| WOB | 10 |
| TOB | 1 |
| Flow Rate | 240 |
| Bit Side Cutting Capacity | 0.2 |
| Drilling Step | 0.03 |
| ROP-Rot | 30 |
| ROP-Slide | 10 |
| SRPM-Rot | 30 |
| SRPM-Slide | 0 |
| Stand | 90 |
| Motor | TFA |

If start inclination of stand < 2 deg, TFA = the end azimuth of stand (MTF Simulation Mode)

If start inclination of stand > 2 deg, TFA = calculated well TFA (GTF Simulation Mode)

Fig. 27

GUI 2800

| | | | | | | TF swing (amp=0) | | | TF swing (amp=30) | | | TF swing (amp=60) | | |
|---|---|---|---|---|---|---|---|---|---|---|---|---|---|---|
| Stand # | Start MD | End MD | End Inc | End Azi | DLS | Sliding Ratio (%) | Sliding dist | Rotating dist | Sliding Ratio (%) | Sliding dist | Rotating dist | Sliding Ratio (%) | Sliding dist | Rotating dist |
| 1 | 8079 | 8169 | 4.8 | 99.2 | 3.3 | 50 | 45 | 45 | 52 | 46.8 | 43.2 | 58 | 52.2 | 37.8 |
| 2 | 8169 | 8259 | 8.4 | 96.6 | 4 | 58 | 52.2 | 37.8 | 59 | 53.1 | 36.9 | 67 | 60.3 | 29.7 |
| 3 | 8259 | 8349 | 12.8 | 108.1 | 5.4 | 67 | 60.3 | 29.7 | 69 | 62.1 | 27.9 | 78 | 70.2 | 19.8 |
| 4 | 8349 | 8439 | 18.1 | 107.5 | 5.9 | 74 | 66.6 | 23.4 | 76 | 68.4 | 21.6 | 84 | 75.6 | 14.4 |
| 5 | 8439 | 8529 | 23.5 | 103.4 | 6.2 | 77 | 69.3 | 20.7 | 78 | 70.2 | 19.8 | 87 | 78.3 | 11.7 |
| 6 | 8529 | 8619 | 26.6 | 102.9 | 3.4 | 61 | 54.9 | 35.1 | 62 | 55.8 | 34.2 | 70 | 63 | 27 |
| 7 | 8619 | 8709 | 29 | 101.6 | 2.8 | 53 | 47.7 | 42.3 | 54 | 48.6 | 41.4 | 61 | 54.9 | 35.1 |
| 8 | 8709 | 8799 | 30 | 99.7 | 1.4 | 39 | 35.1 | 54.9 | 40 | 36 | 54 | 45 | 40.5 | 49.5 |
| 9 | 8799 | 8889 | 32.9 | 96.8 | 3.7 | 56 | 50.4 | 39.6 | 58 | 52.2 | 37.8 | 65 | 58.5 | 31.5 |
| 10 | 8889 | 8979 | 39.1 | 97.3 | 6.9 | 78 | 70.2 | 19.8 | 79 | 71.1 | 18.9 | 88 | 79.2 | 10.8 |
| 11 | 8979 | 9069 | 43.4 | 97.1 | 4.8 | 70 | 63 | 27 | 72 | 64.8 | 25.2 | 79 | 71.1 | 18.9 |
| 12 | 9069 | 9159 | 49.6 | 98.8 | 7 | 79 | 71.1 | 18.9 | 81 | 72.9 | 17.1 | 90 | 81 | 9 |
| 13 | 9159 | 9249 | 54.4 | 101.3 | 5.7 | 75 | 67.5 | 22.5 | 76 | 68.4 | 21.6 | 84 | 75.6 | 14.4 |
| 14 | 9249 | 9339 | 61 | 102.8 | 7.6 | 82 | 73.8 | 16.2 | 84 | 75.6 | 14.4 | 92 | 82.8 | 7.2 |
| 15 | 9339 | 9429 | 67.4 | 102.3 | 7 | 81 | 72.9 | 17.1 | 82 | 73.8 | 16.2 | 90 | 81 | 9 |
| 16 | 9429 | 9519 | 72.4 | 101.6 | 5.6 | 74 | 66.6 | 23.4 | 75 | 67.5 | 22.5 | 83 | 74.7 | 15.3 |
| 17 | 9519 | 9609 | 73.8 | 101 | 1.7 | 51 | 45.9 | 44.1 | 52 | 46.8 | 43.2 | 57 | 51.3 | 38.7 |
| 18 | 9609 | 9699 | 76 | 102.2 | 2.8 | 54 | 48.6 | 41.4 | 56 | 50.4 | 39.6 | 62 | 55.8 | 34.2 |

Fig. 28

Method 2900

Input 2910

Input 2920

| MD | Incl | Azi | Diam |
|---|---|---|---|
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |

Input 2930

| Order | Component | OD | ID | Length | Cumulative Length | |
|---|---|---|---|---|---|---|
| 1 | DP | | | | | |
| 2 | HWDP | | | | | |
| 3 | X/O Sub | | | | | |
| 4 | Jars | | | | | |
| 5 | Flex | | | | | |
| 6 | Flex | | | | | |
| 7 | Gap Sub | | | | | |
| 8 | Flex | | | | | |
| 9 | Pony Collar | | | | | |
| 10 | Motor/PDM | | | | | |
| 11 | Bit | | | | | |

Input 3100

| Parameters | Value |
|---|---|
| WOB | 10 |
| TOB | 2 |
| Flow Rate | 500 |
| Bit Side Cutting Capacity | 0.2 |
| Drilling Step | 0.03 |
| ROP-Rot | 100 |
| ROP-Slide | 30 |
| SRPM-Rot | 50 |
| SRPM-Slide | 0 |
| Stand | 90 |
| Motor | TFA |

If start inclination of stand < 2 deg, TFA = the end azimuth of stand (MTF Simulation Mode)

If start inclination of stand > 2 deg, TFA = calculated well TFA (GTF Simulation Mode)

Fig. 31

GUI 3200

| | | | | | | TF swing (amp=0) | | | TF swing (amp=30) | | | TF swing (amp=60) | | |
|---|---|---|---|---|---|---|---|---|---|---|---|---|---|---|
| Stand # | Start MD | End MD | End Inc | End Azi | DLS | Sliding Ratio (%) | Sliding dist | Rotating dist | Sliding Ratio (%) | Sliding dist | Rotating dist | Sliding Ratio (%) | Sliding dist | Rotating dist |
| 1 | 4767 | 4857 | 5.5 | 306.1 | 6.1 | 60 | 54 | 36 | 62 | 55.8 | 34.2 | 68 | 61.2 | 28.8 |
| 2 | 4857 | 4947 | 11 | 306.1 | 6.1 | 75 | 67.5 | 22.5 | 76 | 68.4 | 21.6 | 84 | 75.6 | 14.4 |
| 3 | 4947 | 5037 | 16.5 | 306.1 | 6.1 | 76 | 68.4 | 21.6 | 76 | 68.4 | 21.6 | 84 | 75.6 | 14.4 |
| 4 | 5037 | 5127 | 21.9 | 306.1 | 6.1 | 76 | 68.4 | 21.6 | 78 | 70.2 | 19.8 | 84 | 75.6 | 14.4 |
| 5 | 5127 | 5217 | 27.4 | 306.1 | 6.1 | 77 | 69.3 | 20.7 | 78 | 70.2 | 19.8 | 84 | 75.6 | 14.4 |
| 6 | 5217 | 5307 | 32.9 | 306.1 | 6.1 | 77 | 69.3 | 20.7 | 78 | 70.2 | 19.8 | 84 | 75.6 | 14.4 |
| 7 | 5307 | 5397 | 38.4 | 306.1 | 6.1 | 76 | 68.4 | 21.6 | 78 | 70.2 | 19.8 | 83 | 74.7 | 15.3 |
| 8 | 5397 | 5487 | 43.9 | 306.1 | 6.1 | 76 | 68.4 | 21.6 | 76 | 68.4 | 21.6 | 83 | 74.7 | 15.3 |
| 9 | 5487 | 5577 | 45 | 306.1 | 1.2 | 52 | 46.8 | 43.2 | 53 | 47.7 | 42.3 | 57 | 51.3 | 38.7 |
| 10 | 5577 | 5667 | 45 | 306.1 | 0 | 38 | 34.2 | 55.8 | 38 | 34.2 | 55.8 | 42 | 37.8 | 52.2 |
| 11 | 5667 | 5757 | 49.7 | 310.6 | 6.4 | 70 | 63 | 27 | 72 | 64.8 | 25.2 | 78 | 70.2 | 19.8 |
| 12 | 5757 | 5847 | 54.7 | 315.9 | 7.3 | 81 | 72.9 | 17.1 | 83 | 74.7 | 15.3 | 90 | 81 | 9 |
| 13 | 5847 | 5937 | 59.8 | 321.5 | 7.7 | 84 | 75.6 | 14.4 | 86 | 77.4 | 12.6 | 91 | 81.9 | 8.1 |
| 14 | 5937 | 6027 | 64.8 | 327.5 | 8.1 | 86 | 77.4 | 12.6 | 88 | 79.2 | 10.8 | 92 | 82.8 | 7.2 |
| 15 | 6027 | 6117 | 69.8 | 333.6 | 8.4 | 89 | 80.1 | 9.9 | 90 | 81 | 9 | 93 | 83.7 | 6.3 |
| 16 | 6117 | 6207 | 74.9 | 340 | 8.8 | 90 | 81 | 9 | 91 | 81.9 | 8.1 | 94 | 84.6 | 5.4 |
| 17 | 6207 | 6297 | 79.9 | 346.5 | 9 | 90 | 81 | 9 | 91 | 81.9 | 8.1 | 95 | 85.5 | 4.5 |
| 18 | 6297 | 6387 | 85 | 353.1 | 9.2 | 91 | 81.9 | 8.1 | 92 | 82.8 | 7.2 | 95 | 85.5 | 4.5 |
| 19 | 6387 | 6477 | 90 | 359.8 | 9.3 | 91 | 81.9 | 8.1 | 92 | 82.8 | 7.2 | 95 | 85.5 | 4.5 |

Fig. 32

GUI 3300

| | | | | | | TF swing (amp=0) | | | TF swing (amp=30) | | | TF swing (amp=60) | | |
|---|---|---|---|---|---|---|---|---|---|---|---|---|---|---|
| Stand # | Start MD | End MD | End Inc | End Azi | DLS | Sliding Ratio (%) | Sliding dist | Rotating dist | Sliding Ratio (%) | Sliding dist | Rotating dist | Sliding Ratio (%) | Sliding dist | Rotating dist |
| 1 | 4742 | 4832 | 7.1 | 315.8 | 6.6 | 76 | 68.4 | 21.6 | 78 | 70.2 | 19.8 | 86 | 77.4 | 12.6 |
| 2 | 4832 | 4922 | 11.3 | 314.6 | 4.6 | 67 | 60.3 | 29.7 | 69 | 62.1 | 27.9 | 75 | 67.5 | 22.5 |
| 3 | 4922 | 5012 | 16.2 | 306.7 | 5.8 | 71 | 63.9 | 26.1 | 72 | 64.8 | 25.2 | 79 | 71.1 | 18.9 |
| 4 | 5012 | 5102 | 20 | 303 | 4.5 | 67 | 60.3 | 29.7 | 68 | 61.2 | 28.8 | 75 | 67.5 | 22.5 |
| 5 | 5102 | 5192 | 26.2 | 305.2 | 6.9 | 77 | 69.3 | 20.7 | 78 | 70.2 | 19.8 | 84 | 75.6 | 14.4 |
| 6 | 5192 | 5282 | 31.1 | 307.6 | 5.7 | 76 | 68.4 | 21.6 | 76 | 68.4 | 21.6 | 83 | 74.7 | 15.3 |
| 7 | 5282 | 5372 | 36 | 308 | 5.4 | 72 | 64.8 | 25.2 | 73 | 65.7 | 24.3 | 79 | 71.1 | 18.9 |
| 8 | 5372 | 5462 | 39.8 | 308.8 | 4.3 | 66 | 59.4 | 30.6 | 67 | 60.3 | 29.7 | 73 | 65.7 | 24.3 |
| 9 | 5462 | 5552 | 45.9 | 309.7 | 6.9 | 77 | 69.3 | 20.7 | 78 | 70.2 | 19.8 | 84 | 75.6 | 14.4 |
| 10 | 5552 | 5642 | 47.3 | 307.7 | 2.2 | 52 | 46.8 | 43.2 | 55 | 49.5 | 40.5 | 61 | 54.9 | 35.1 |
| 11 | 5642 | 5732 | 48.4 | 313.7 | 5.1 | 58 | 52.2 | 37.8 | 60 | 54 | 36 | 67 | 60.3 | 29.7 |
| 12 | 5732 | 5822 | 51.8 | 319.8 | 6.4 | 75 | 67.5 | 22.5 | 78 | 70.2 | 19.8 | 84 | 75.6 | 14.4 |
| 13 | 5822 | 5912 | 54.9 | 330.2 | 9.9 | 91 | 81.9 | 8.1 | 93 | 83.7 | 6.3 | 95 | 85.5 | 4.5 |
| 14 | 5912 | 6002 | 61.7 | 332.6 | 7.9 | 84 | 75.6 | 14.4 | 84 | 75.6 | 14.4 | 92 | 82.8 | 7.2 |
| 15 | 6002 | 6092 | 62.4 | 340.8 | 8.1 | 78 | 70.2 | 19.8 | 83 | 74.7 | 15.3 | 92 | 82.8 | 7.2 |
| 16 | 6092 | 6182 | 70.7 | 345.4 | 10 | 90 | 81 | 9 | 91 | 81.9 | 8.1 | 95 | 85.5 | 4.5 |
| 17 | 6182 | 6272 | 78.8 | 350.2 | 10 | 93 | 83.7 | 6.3 | 93 | 83.7 | 6.3 | 98 | 88.2 | 1.8 |
| 18 | 6272 | 6362 | 85 | 354.1 | 8.2 | 88 | 79.2 | 10.8 | 90 | 81 | 9 | 93 | 83.7 | 6.3 |

Fig. 33

GUI 3400

| | | | | | | Sliding ratio (%) | | | | | | |
|---|---|---|---|---|---|---|---|---|---|---|---|---|
| Stand # | Start MD | End MD | End Inc | End Azi | DLS | No TF swing | Sinusoid | | Sinusoid | | Random variation | |
| | | | | | | | Swing Amp=30 | Swing Amp=60 | Swing Amp=30 | Swing Amp=60 | Swing Amp=30 | Swing Amp=60 |
| 1 | 4767 | 4857 | 5.5 | 306.1 | 6.1 | 60 | 62 | 68 | 61 | 68 | 61 | 66 |
| 2 | 4857 | 4947 | 11 | 306.1 | 6.1 | 75 | 76 | 84 | 76 | 87 | 76 | 80 |
| 3 | 4947 | 5037 | 16.5 | 306.1 | 6.1 | 76 | 76 | 84 | 76 | 85 | 76 | 81 |
| 4 | 5037 | 5127 | 21.9 | 306.1 | 6.1 | 76 | 78 | 84 | 78 | 85 | 76 | 81 |
| 5 | 5127 | 5217 | 27.4 | 306.1 | 6.1 | 77 | 78 | 84 | 78 | 84 | 78 | 81 |
| 6 | 5217 | 5307 | 32.9 | 306.1 | 6.1 | 77 | 78 | 84 | 78 | 84 | 76 | 84 |
| 7 | 5307 | 5397 | 38.4 | 306.1 | 6.1 | 76 | 78 | 83 | 76 | 83 | 76 | 80 |
| 8 | 5397 | 5487 | 43.9 | 306.1 | 6.1 | 76 | 76 | 83 | 76 | 82 | 76 | 80 |
| 9 | 5487 | 5577 | 45 | 306.1 | 1.2 | 52 | 53 | 57 | 52 | 57 | 52 | 55 |
| 10 | 5577 | 5667 | 45 | 306.1 | 0 | 38 | 38 | 42 | 38 | 41 | 38 | 40 |
| 11 | 5667 | 5757 | 49.7 | 310.6 | 6.4 | 70 | 72 | 78 | 72 | 78 | 71 | 76 |
| 12 | 5757 | 5847 | 54.7 | 315.9 | 7.3 | 81 | 83 | 90 | 82 | 90 | 83 | 87 |
| 13 | 5847 | 5937 | 59.8 | 321.5 | 7.7 | 84 | 86 | 91 | 85 | 91 | 85 | 90 |
| 14 | 5937 | 6027 | 64.8 | 327.5 | 8.1 | 86 | 88 | 92 | 89 | 92 | 88 | 91 |
| 15 | 6027 | 6117 | 69.8 | 333.6 | 8.4 | 89 | 90 | 93 | 90 | 93 | 90 | 92 |
| 16 | 6117 | 6207 | 74.9 | 340 | 8.8 | 90 | 91 | 94 | 91 | 93 | 91 | 93 |
| 17 | 6207 | 6297 | 79.9 | 346.5 | 9 | 90 | 91 | 95 | 91 | 94 | 91 | 93 |
| 18 | 6297 | 6387 | 85 | 353.1 | 9.2 | 91 | 92 | 95 | 92 | 94 | 91 | 94 |
| 19 | 6387 | 6477 | 90 | 359.8 | 9.3 | 91 | 92 | 95 | 92 | 95 | 92 | 94 |

Fig. 34

Method 3500

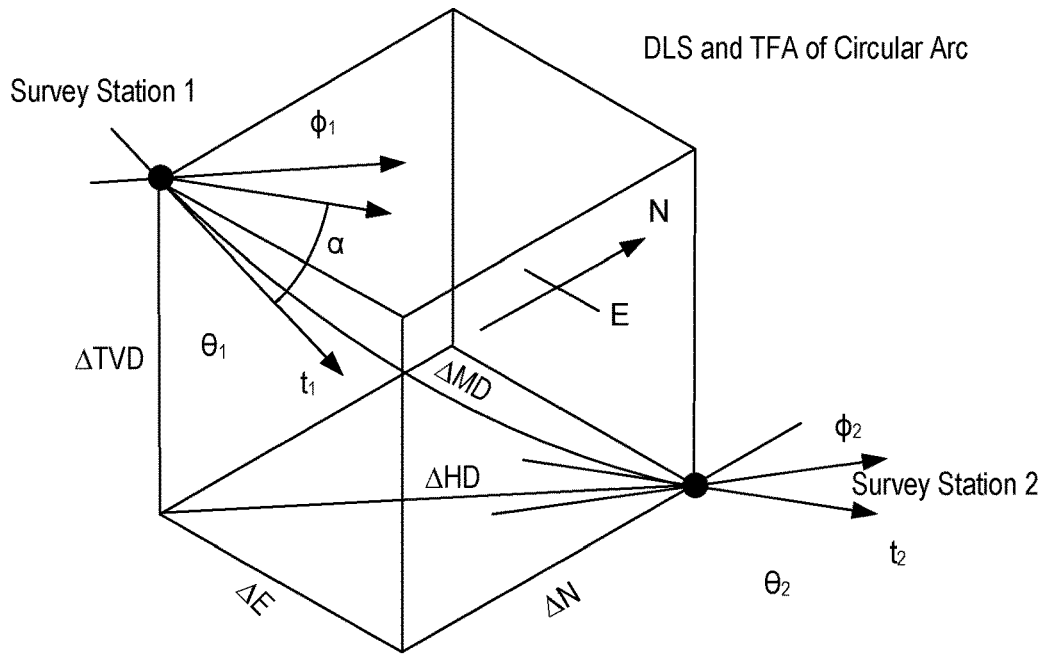

Tool Face Angle (TFA) (starting TFA)

$$TFA = \cos^{-1}\left[\frac{\cos(\theta_1)\cos(\alpha) - \cos(\phi_2)}{\sin(\theta_1)\sin(\alpha)}\right]$$

Angle Change over the Course of the Trajectory $$\alpha = 2\sin^{-1}\left\{\left[\sin^2\left(\frac{\theta_2 - \theta_1}{2}\right) + \sin(\theta_1)\sin(\theta_2)\sin^2\left(\frac{\phi_2 - \phi_1}{2}\right)\right]^{1/2}\right\}$$

DLS $$DLS = \frac{\alpha}{\Delta MD}$$

$$BR = \cos(TFA) \cdot DLS$$

$$TR = \frac{\sin(TFA)}{\sin(\theta_1)} DLS$$

Fig. 35

Method 3600

Survey Interpolation Based on Radius of Curvature $I_1, I_2, A_1, A_2$ Inclination and azimuth angles at two adjacent survey stations $MD_1, MD_2$ Measured depths of survey stations $MD_i, I_i, A_i$ Intermediate depth and interpolated angles at a depth $$I_i = I_1 + \frac{I_2 - I_1}{MD_2 - MD_1}(MD_i - MD_1)$$

$$A_i = A_1 + \frac{\cos(I_i) - \cos(I_1)}{\cos(I_2) - \cos(I_1)}(A_2 - A_1)$$

Fig. 36

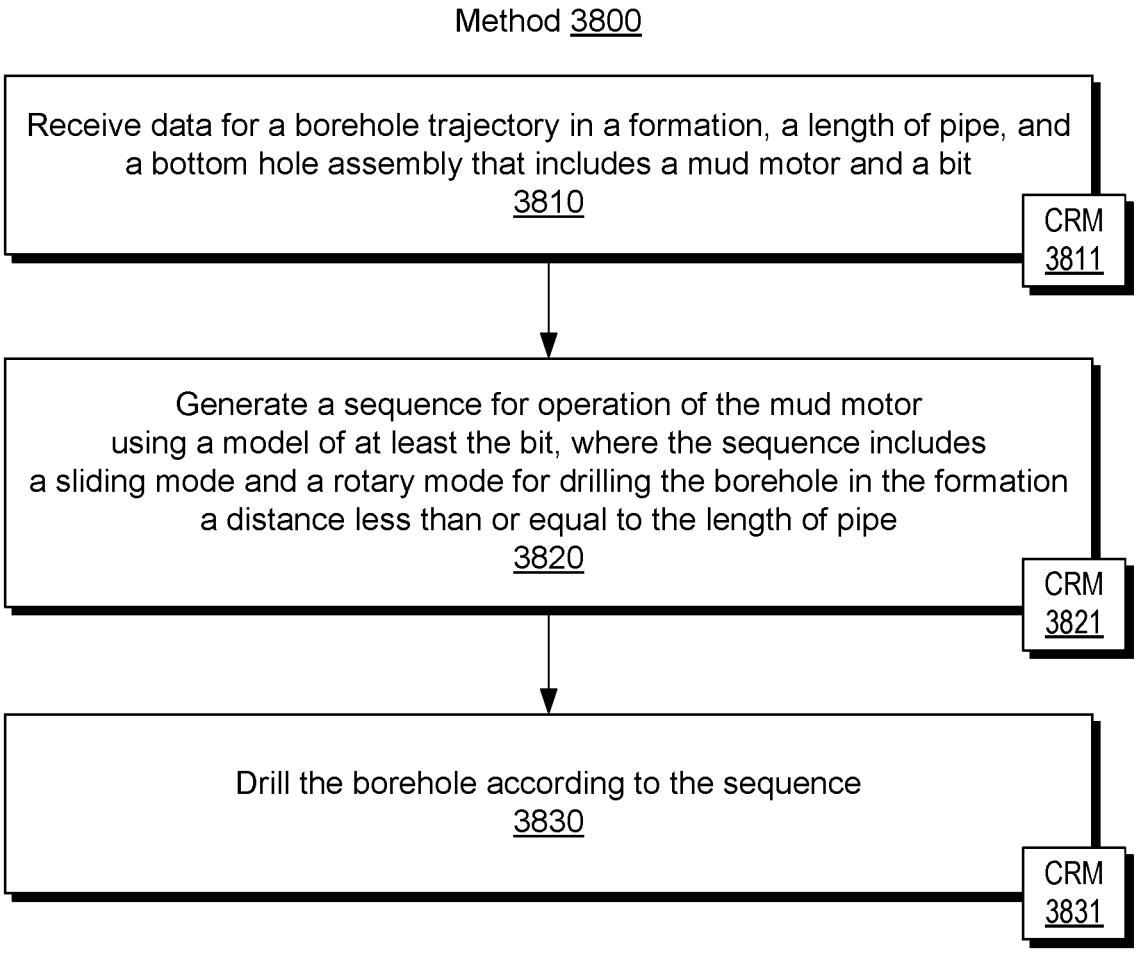
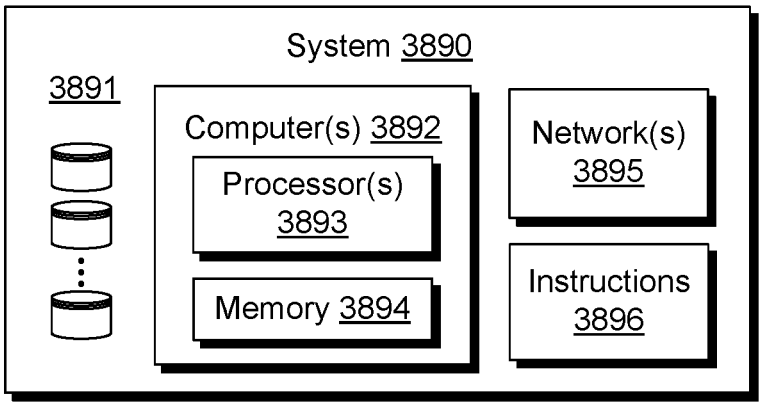
Fig. 38

DRILLING MODE SEQUENCE CONTROL

BACKGROUND

A resource field can be an accumulation, pool or group of pools of one or more resources (e.g., oil, gas, oil and gas) in a subsurface environment. A resource field can include at least one reservoir. A reservoir may be shaped in a manner that can trap hydrocarbons and may be covered by an impermeable or sealing rock. A bore (e.g., a borehole) can be drilled into an environment where the bore may be utilized to form a well that can be utilized in producing hydrocarbons from a reservoir.

A rig can be a system of components that can be operated to form a bore in an environment, to transport equipment into and out of a bore in an environment, etc. As an example, a rig can include a system that can be used to drill a bore and to acquire information about an environment, about drilling, etc. A resource field may be an onshore field, an offshore field or an on- and offshore field. A rig can include components for performing operations onshore and/or offshore. A rig may be, for example, vessel-based, offshore platform-based, onshore, etc.

Field planning and/or development can occur over one or more phases, which can include an exploration phase that aims to identify and assess an environment (e.g., a prospect, a play, etc.), which may include drilling of one or more bores (e.g., one or more exploratory wells, etc.).

SUMMARY

A method can include receiving data for a borehole trajectory in a formation, a length of pipe, and a bottom hole assembly that includes a mud motor and a bit; generating a sequence for operation of the mud motor using a model of at least the bit, where the sequence includes a sliding mode and a rotary mode for drilling the borehole in the formation a distance less than or equal to the length of pipe; and drilling the borehole according to the sequence. A system can include a processor; memory accessible by the processor; processor-executable instructions stored in the memory and executable to instruct the system to: receive data for a borehole trajectory in a formation, a length of pipe, and a bottom hole assembly that includes a mud motor and a bit; generate a sequence for operation of the mud motor using a model of at least the bit, where the sequence includes a sliding mode and a rotary mode for drilling the borehole in the formation a distance less than or equal to the length of pipe; and drill the borehole according to the sequence. One or more computer-readable storage media can include processor-executable instructions to instruct a computing system to: receive data for a borehole trajectory in a formation, a length of pipe, and a bottom hole assembly that includes a mud motor and a bit; generate a sequence for operation of the mud motor using a model of at least the bit, where the sequence includes a sliding mode and a rotary mode for drilling the borehole in the formation a distance less than or equal to the length of pipe; and drill the borehole according to the sequence. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 1 illustrates examples of equipment in a geologic environment;

FIG. 11 illustrates an example of a graphical user interface;

FIG. 17 illustrates examples of methods;

FIG. 18 illustrates an example of a graphical user interface;

FIG. 21 illustrates examples of inputs;

FIG. 22 illustrates an example of a graphical user interface;

FIG. 24 illustrates examples of inputs;

FIG. 25 illustrates an example of a graphical user interface;

FIG. 27 illustrates examples of inputs;

FIG. 28 illustrates an example of a graphical user interface;

FIG. 31 illustrates examples of inputs;

FIG. 32 illustrates an example of a graphical user interface;

FIG. 33 illustrates an example of a graphical user interface;

FIG. 34 illustrates an example of a graphical user interface;

FIG. 35 illustrates an example of a method;

FIG. 36 illustrates an example of a method;

FIG. 38 illustrates an example of a method and an example of a system;

DETAILED DESCRIPTION

Figure 2:
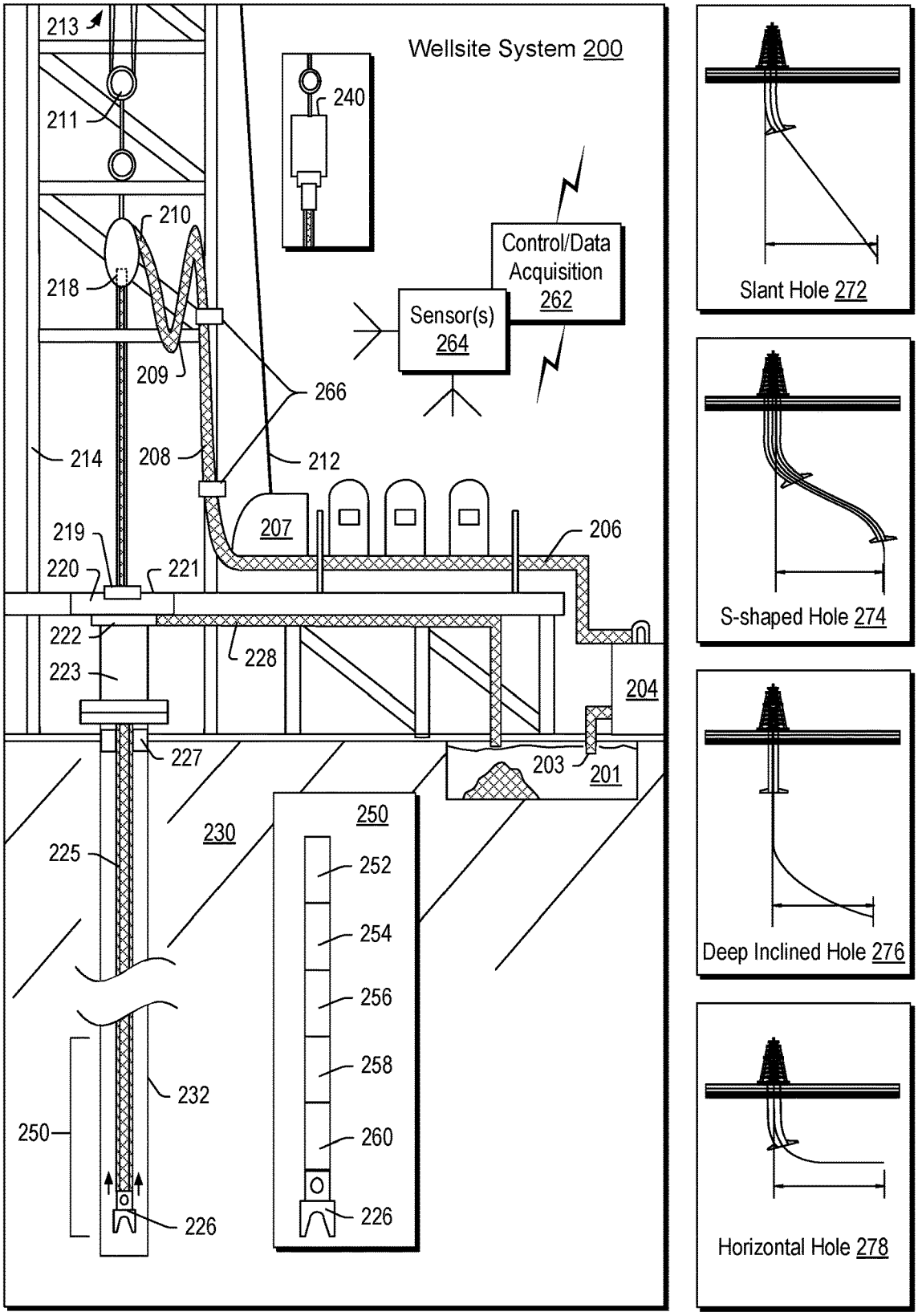
FIG. 2 illustrates examples of equipment and examples of hole types.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion (e.g., a lateral portion) that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system (e.g., an offshore rig, etc.).

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick can include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe located at or near the center of a derrick or a mast and to throw a line around the pipe and pull it back into its storage location (e.g., fingerboards), for example, until it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that can be pulled out of a hole and/or placed or replaced in a hole. As an example, a pipe trip may be performed where a drill bit has dulled or has otherwise ceased to drill efficiently and is to be replaced. As an example, a trip that pulls equipment out of a borehole may be referred to as pulling out of hole (POOH) and a trip that runs equipment into a borehole may be referred to as running in hole (RIH).

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the traveling block 211 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring can include a plurality of tools.

As to a RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling can commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor can present some challenges depending on factors such as rate of penetration (ROP), transferring weight to a bit (e.g., weight on bit, WOB) due to friction, etc. A mud motor can be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM or surface_RPM) may be determined by use of the surface equipment and a downhole RPM of the mud motor may be determined using various factors related to flow of drilling fluid, mud motor type, etc. As an example, in the combined rotating mode, bit RPM can be determined or estimated as a sum of the SRPM and the mud motor RPM, assuming the SRPM and the mud motor RPM are in the same direction.

As an example, a PDM mud motor can operate in a so-called sliding mode, when the drillstring is not rotated from the surface. In such an example, a bit RPM can be determined or estimated based on the RPM of the mud motor.

A RSS can drill directionally where there is continuous rotation from surface equipment, which can alleviate the sliding of a steerable motor (e.g., a PDM). A RSS may be deployed when drilling directionally (e.g., deviated, horizontal, or extended-reach wells). A RSS can aim to minimize interaction with a borehole wall, which can help to preserve borehole quality. A RSS can aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform method such as geosteering. As mentioned, a steerable system can be or include an RSS. As an example, a steerable system can include a PDM or of a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

Figure 3:
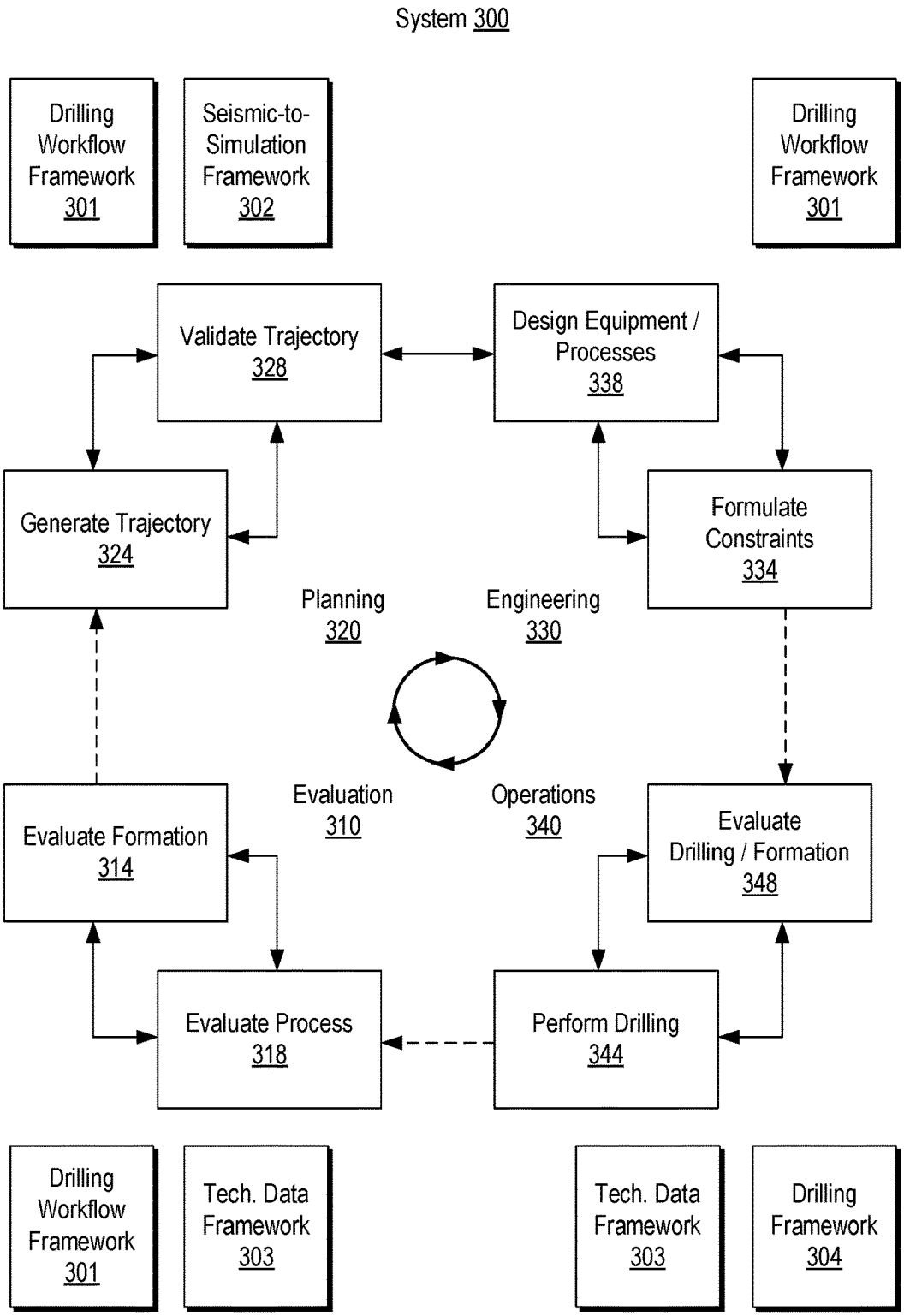
FIG. 3 illustrates an example of a system.

FIG. 3 shows an example of a system 300 that includes various equipment for evaluation 310, planning 320, engineering 330 and operations 340. For example, a drilling workflow framework 301, a seismic-to-simulation framework 302, a technical data framework 303 and a drilling framework 304 may be implemented to perform one or more processes such as a evaluating a formation 314, evaluating a process 318, generating a trajectory 324, validating a trajectory 328, formulating constraints 334, designing equipment and/or processes based at least in part on constraints 338, performing drilling 344 and evaluating drilling and/or formation 348.

In the example of FIG. 3, the seismic-to-simulation framework 302 can be, for example, the PETREL framework (Schlumberger, Houston, Tex.) and the technical data framework 303 can be, for example, the TECHLOG framework (Schlumberger, Houston, Tex.).

As an example, a framework can include entities that may include earth entities, geological objects or other objects such as wells, surfaces, reservoirs, etc. Entities can include virtual representations of actual physical entities that are reconstructed for purposes of one or more of evaluation, planning, engineering, operations, etc.

Entities may include entities based on data acquired via sensing, observation, etc. (e.g., seismic data and/or other information). An entity may be characterized by one or more properties (e.g., a geometrical pillar grid entity of an earth model may be characterized by a porosity property). Such properties may represent one or more measurements (e.g., acquired data), calculations, etc.

A framework may be an object-based framework. In such a framework, entities may include entities based on predefined classes, for example, to facilitate modeling, analysis, simulation, etc. An example of an object-based framework is the MICROSOFT .NET framework (Redmond, Wash.), which provides a set of extensible object classes. In the .NET framework, an object class encapsulates a module of reusable code and associated data structures. Object classes can be used to instantiate object instances for use in by a program, script, etc. For example, borehole classes may define objects for representing boreholes based on well data.

As an example, a framework may be implemented within or in a manner operatively coupled to the DELFI cognitive exploration and production (E&P) environment (Schlumberger, Houston, Tex.), which is a secure, cognitive, cloud-based collaborative environment that integrates data and workflows with digital technologies, such as artificial intelligence and machine learning. As an example, such an environment can provide for operations that involve one or more frameworks.

As an example, a framework can include an analysis component that may allow for interaction with a model or model-based results (e.g., simulation results, etc.). As to simulation, a framework may operatively link to or include a simulator such as the ECLIPSE reservoir simulator (Schlumberger, Houston Tex.), the INTERSECT reservoir simulator (Schlumberger, Houston Tex.), etc.

The aforementioned PETREL framework provides components that allow for optimization of exploration and development operations. The PETREL framework includes seismic to simulation software components that can output information for use in increasing reservoir performance, for example, by improving asset team productivity. Through use of such a framework, various professionals (e.g., geophysicists, geologists, well engineers, reservoir engineers, etc.) can develop collaborative workflows and integrate operations to streamline processes. Such a framework may be considered an application and may be considered a data-driven application (e.g., where data is input for purposes of modeling, simulating, etc.).

As mentioned with respect to the DELFI environment, one or more frameworks may be interoperative and/or run upon one or another. As an example, a framework environment marketed as the OCEAN framework environment (Schlumberger, Houston, Tex.) may be utilized, which allows for integration of add-ons (or plug-ins) into a PETREL framework workflow. In an example embodiment, various components may be implemented as add-ons (or plug-ins) that conform to and operate according to specifications of a framework environment (e.g., according to application programming interface (API) specifications, etc.).

As an example, a framework can include a model simulation layer along with a framework services layer, a framework core layer and a modules layer. In a framework environment (e.g., OCEAN, DELFI, etc.), a model simulation layer can include or operatively link to a model-centric framework. In an example embodiment, a framework may be considered to be a data-driven application. For example, the PETREL framework can include features for model building and visualization. As an example, a model may include one or more grids where a grid can be a spatial grid that conforms to spatial locations per acquired data (e.g., satellite data, logging data, seismic data, etc.).

As an example, a model simulation layer may provide domain objects, act as a data source, provide for rendering and provide for various user interfaces. Rendering capabilities may provide a graphical environment in which applications can display their data while user interfaces may provide a common look and feel for application user interface components.

As an example, domain objects can include entity objects, property objects and optionally other objects. Entity objects may be used to geometrically represent wells, surfaces, reservoirs, etc., while property objects may be used to provide property values as well as data versions and display parameters. For example, an entity object may represent a well where a property object provides log information as well as version information and display information (e.g., to display the well as part of a model).

As an example, data may be stored in one or more data sources (or data stores, generally physical data storage devices), which may be at the same or different physical sites and accessible via one or more networks. As an example, a model simulation layer may be configured to model projects. As such, a particular project may be stored where stored project information may include inputs, models, results and cases. Thus, upon completion of a modeling session, a user may store a project. At a later time, the project can be accessed and restored using the model simulation layer, which can recreate instances of the relevant domain objects.

As an example, the system 300 may be used to perform one or more workflows. A workflow may be a process that includes a number of worksteps. A workstep may operate on data, for example, to create new data, to update existing data, etc. As an example, a workflow may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable at least in part in the PETREL framework, for example, that operates on seismic data, seismic attribute(s), etc.

As an example, seismic data can be data acquired via a seismic survey where sources and receivers are positioned in a geologic environment to emit and receive seismic energy where at least a portion of such energy can reflect off subsurface structures. As an example, a seismic data analysis framework or frameworks (e.g., consider the OMEGA framework, marketed by Schlumberger, Houston, Tex.) may be utilized to determine depth, extent, properties, etc. of subsurface structures. As an example, seismic data analysis can include forward modeling and/or inversion, for example, to iteratively build a model of a subsurface region of a geologic environment. As an example, a seismic data analysis framework may be part of or operatively coupled to a seismic-to-simulation framework (e.g., the PETREL framework, etc.).

As an example, a workflow may be a process implementable at least in part in a framework environment and by one or more frameworks. As an example, a workflow may include one or more worksteps that access a set of instructions such as a plug-in (e.g., external executable code, etc.). As an example, a framework environment may be cloud-based where cloud resources are utilized that may be operatively coupled to one or more pieces of field equipment such that data can be acquired, transmitted, stored, processed, analyzed, etc., using features of a framework environment. As an example, a framework environment may employ various types of services, which may be backend, frontend or backend and frontend services. For example, consider a client-server type of architecture where communications may occur via one or more application programming interfaces (APIs), one or more microservices, etc.

As an example, a framework may provide for modeling petroleum systems. For example, the modeling framework marketed as the PETROMOD framework (Schlumberger, Houston, Tex.), which includes features for input of various types of information (e.g., seismic, well, geological, etc.) to model evolution of a sedimentary basin. The PETROMOD framework provides for petroleum systems modeling via input of various data such as seismic data, well data and other geological data, for example, to model evolution of a sedimentary basin. The PETROMOD framework may predict if, and how, a reservoir has been charged with hydrocarbons, including, for example, the source and timing of hydrocarbon generation, migration routes, quantities, pore pressure and hydrocarbon type in the subsurface or at surface conditions. In combination with a framework such as the PETREL framework, workflows may be constructed to provide basin-to-prospect scale exploration solutions. Data exchange between frameworks can facilitate construction of models, analysis of data (e.g., PETROMOD framework data analyzed using PETREL framework capabilities), and coupling of workflows.

As mentioned, a drillstring can include various tools that may make measurements. As an example, a wireline tool or another type of tool may be utilized to make measurements. As an example, a tool may be configured to acquire electrical borehole images. As an example, the fullbore Formation Microlmager (FMI) tool (Schlumberger, Houston, Tex.) can acquire borehole image data. A data acquisition sequence for such a tool can include running the tool into a borehole with acquisition pads closed, opening and pressing the pads against a wall of the borehole, delivering electrical current into the material defining the borehole while translating the tool in the borehole, and sensing current remotely, which is altered by interactions with the material.

Analysis of formation information may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). As an example, information acquired by a tool or tools may be analyzed using a framework such as the TECHLOG framework. As an example, the TECHLOG framework can be interoperable with one or more other frameworks such as, for example, the PETREL framework.

As an example, various aspects of a workflow may be completed automatically, may be partially automated, or may be completed manually, as by a human user interfacing with a software application that executes using hardware (e.g., local and/or remote). As an example, a workflow may be cyclic, and may include, as an example, four stages such as, for example, an evaluation stage (see, e.g., the evaluation equipment 310), a planning stage (see, e.g., the planning equipment 320), an engineering stage (see, e.g., the engineering equipment 330) and an execution stage (see, e.g., the operations equipment 340). As an example, a workflow may commence at one or more stages, which may progress to one or more other stages (e.g., in a serial manner, in a parallel manner, in a cyclical manner, etc.).

As an example, a workflow can commence with an evaluation stage, which may include a geological service provider evaluating a formation (see, e.g., the evaluation block 314). As an example, a geological service provider may undertake the formation evaluation using a computing system executing a software package tailored to such activity; or, for example, one or more other suitable geology platforms may be employed (e.g., alternatively or additionally). As an example, the geological service provider may evaluate the formation, for example, using earth models, geophysical models, basin models, petrotechnical models, combinations thereof, and/or the like. Such models may take into consideration a variety of different inputs, including offset well data, seismic data, pilot well data, other geologic data, etc. The models and/or the input may be stored in the database maintained by the server and accessed by the geological service provider.

As an example, a workflow may progress to a geology and geophysics ("G&G") service provider, which may generate a well trajectory (see, e.g., the generation block 324), which may involve execution of one or more G&G software packages. Examples of such software packages include the PETREL framework. As an example, a G&G service provider may determine a well trajectory or a section thereof, based on, for example, one or more model(s) provided by a formation evaluation (e.g., per the evaluation block 314), and/or other data, e.g., as accessed from one or more databases (e.g., maintained by one or more servers, etc.). As an example, a well trajectory may take into consideration various "basis of design" (BOD) constraints, such as general surface location, target (e.g., reservoir) location, and the like. As an example, a trajectory may incorporate information about tools, bottom-hole assemblies, casing sizes, etc., that may be used in drilling the well. A well trajectory determination may take into consideration a variety of other parameters, including risk tolerances, fluid weights and/or plans, bottom-hole pressures, drilling time, etc.

As an example, a workflow may progress to a first engineering service provider (e.g., one or more processing machines associated therewith), which may validate a well trajectory and, for example, relief well design (see, e.g., the validation block 328). Such a validation process may include evaluating physical properties, calculations, risk tolerances, integration with other aspects of a workflow, etc. As an example, one or more parameters for such determinations may be maintained by a server and/or by the first engineering service provider; noting that one or more model (s), well trajectory(ies), etc. may be maintained by a server and accessed by the first engineering service provider. For example, the first engineering service provider may include one or more computing systems executing one or more software packages. As an example, where the first engineering service provider rejects or otherwise suggests an adjustment to a well trajectory, the well trajectory may be adjusted or a message or other notification sent to the G&G service provider requesting such modification.

As an example, one or more engineering service providers (e.g., first, second, etc.) may provide a casing design, bottom-hole assembly (BHA) design, fluid design, and/or the like, to implement a well trajectory (see, e.g., the design block 338). In some embodiments, a second engineering service provider may perform such design using one of more software applications. Such designs may be stored in one or more databases maintained by one or more servers, which may, for example, employ STUDIO framework tools (Schlumberger, Houston, Tex.), and may be accessed by one or more of the other service providers in a workflow.

As an example, a second engineering service provider may seek approval from a third engineering service provider for one or more designs established along with a well trajectory. In such an example, the third engineering service provider may consider various factors as to whether the well engineering plan is acceptable, such as economic variables (e.g., oil production forecasts, costs per barrel, risk, drill time, etc.), and may request authorization for expenditure, such as from the operating company's representative, well-owner's representative, or the like (see, e.g., the formulation block 334). As an example, at least some of the data upon which such determinations are based may be stored in one or more database maintained by one or more servers. As an example, a first, a second, and/or a third engineering service provider may be provided by a single team of engineers or even a single engineer, and thus may or may not be separate entities.

As an example, where economics may be unacceptable or subject to authorization being withheld, an engineering service provider may suggest changes to casing, a bottom-hole assembly, and/or fluid design, or otherwise notify and/or return control to a different engineering service provider, so that adjustments may be made to casing, a bottom-hole assembly, and/or fluid design. Where modifying one or more of such designs is impracticable within well constraints, trajectory, etc., the engineering service provider may suggest an adjustment to the well trajectory and/or a workflow may return to or otherwise notify an initial engineering service provider and/or a G&G service provider such that either or both may modify the well trajectory.

As an example, a workflow can include considering a well trajectory, including an accepted well engineering plan, and a formation evaluation. Such a workflow may then pass control to a drilling service provider, which may implement the well engineering plan, establishing safe and efficient drilling, maintaining well integrity, and reporting progress as well as operating parameters (see, e.g., the blocks 344 and 348). As an example, operating parameters, formation encountered, data collected while drilling (e.g., using logging-while-drilling or measuring-while-drilling technology), may be returned to a geological service provider for evaluation. As an example, the geological service provider may then re-evaluate the well trajectory, or one or more other aspects of the well engineering plan, and may, in some cases, and potentially within predetermined constraints, adjust the well engineering plan according to the real-life drilling parameters (e.g., based on acquired data in the field, etc.).

Whether the well is entirely drilled, or a section thereof is completed, depending on the specific embodiment, a workflow may proceed to a post review (see, e.g., the evaluation block 318). As an example, a post review may include reviewing drilling performance. As an example, a post review may further include reporting the drilling performance (e.g., to one or more relevant engineering, geological, or G&G service providers).

Various activities of a workflow may be performed consecutively and/or may be performed out of order (e.g., based partially on information from templates, nearby wells, etc. to fill in any gaps in information that is to be provided by another service provider). As an example, undertaking one activity may affect the results or basis for another activity, and thus may, either manually or automatically, call for a variation in one or more workflow activities, work products, etc. As an example, a server may allow for storing information on a central database accessible to various service providers where variations may be sought by communication with an appropriate service provider, may be made automatically, or may otherwise appear as suggestions to the relevant service provider. Such an approach may be considered to be a holistic approach to a well workflow, in comparison to a sequential, piecemeal approach.

As an example, various actions of a workflow may be repeated multiple times during drilling of a wellbore. For example, in one or more automated systems, feedback from a drilling service provider may be provided at or near real-time, and the data acquired during drilling may be fed to one or more other service providers, which may adjust its piece of the workflow accordingly. As there may be dependencies in other areas of the workflow, such adjustments may permeate through the workflow, e.g., in an automated fashion. In some embodiments, a cyclic process may additionally or instead proceed after a certain drilling goal is reached, such as the completion of a section of the wellbore, and/or after the drilling of the entire wellbore, or on a per-day, week, month, etc. basis.

Well planning can include determining a path of a well (e.g., a trajectory) that can extend to a reservoir, for example, to economically produce fluids such as hydrocarbons therefrom. Well planning can include selecting a drilling and/or completion assembly which may be used to implement a well plan. As an example, various constraints can be imposed as part of well planning that can impact design of a well. As an example, such constraints may be imposed based at least in part on information as to known geology of a subterranean domain, presence of one or more other wells (e.g., actual and/or planned, etc.) in an area (e.g., consider collision avoidance), etc. As an example, one or more constraints may be imposed based at least in part on characteristics of one or more tools, components, etc. As an example, one or more constraints may be based at least in part on factors associated with drilling time and/or risk tolerance.

As an example, a system can allow for a reduction in waste, for example, as may be defined according to LEAN. In the context of LEAN, consider one or more of the following types of waste: transport (e.g., moving items unnecessarily, whether physical or data); inventory (e.g., components, whether physical or informational, as work in process, and finished product not being processed); motion (e.g., people or equipment moving or walking unnecessarily to perform desired processing); waiting (e.g., waiting for information, interruptions of production during shift change, etc.); overproduction (e.g., production of material, information, equipment, etc. ahead of demand); over processing (e.g., resulting from poor tool or product design creating activity); and defects (e.g., effort involved in inspecting for and fixing defects whether in a plan, data, equipment, etc.). As an example, a system that allows for actions (e.g., methods, workflows, etc.) to be performed in a collaborative manner can help to reduce one or more types of waste.

As an example, a system can be utilized to implement a method for facilitating distributed well engineering, planning, and/or drilling system design across multiple computation devices where collaboration can occur among various different users (e.g., some being local, some being remote, some being mobile, etc.). In such a system, the various users via appropriate devices may be operatively coupled via one or more networks (e.g., local and/or wide area networks, public and/or private networks, land-based, marine-based and/or areal networks, etc.).

As an example, a system may allow well engineering, planning, and/or drilling system design to take place via a subsystems approach where a wellsite system (e.g., a rigsite system) is composed of various subsystem, which can include equipment subsystems and/or operational subsystems (e.g., control subsystems, etc.). As an example, computations may be performed using various computational platforms/devices that are operatively coupled via communication links (e.g., network links, etc.). As an example, one or more links may be operatively coupled to a common database (e.g., a server site, etc.). As an example, a particular server or servers may manage receipt of notifications from one or more devices and/or issuance of notifications to one or more devices. As an example, a system may be implemented for a project where the system can output a well plan, for example, as a digital well plan, a paper well plan, a digital and paper well plan, etc. Such a well plan can be a complete well engineering plan or design for the particular project.

Figure 4:
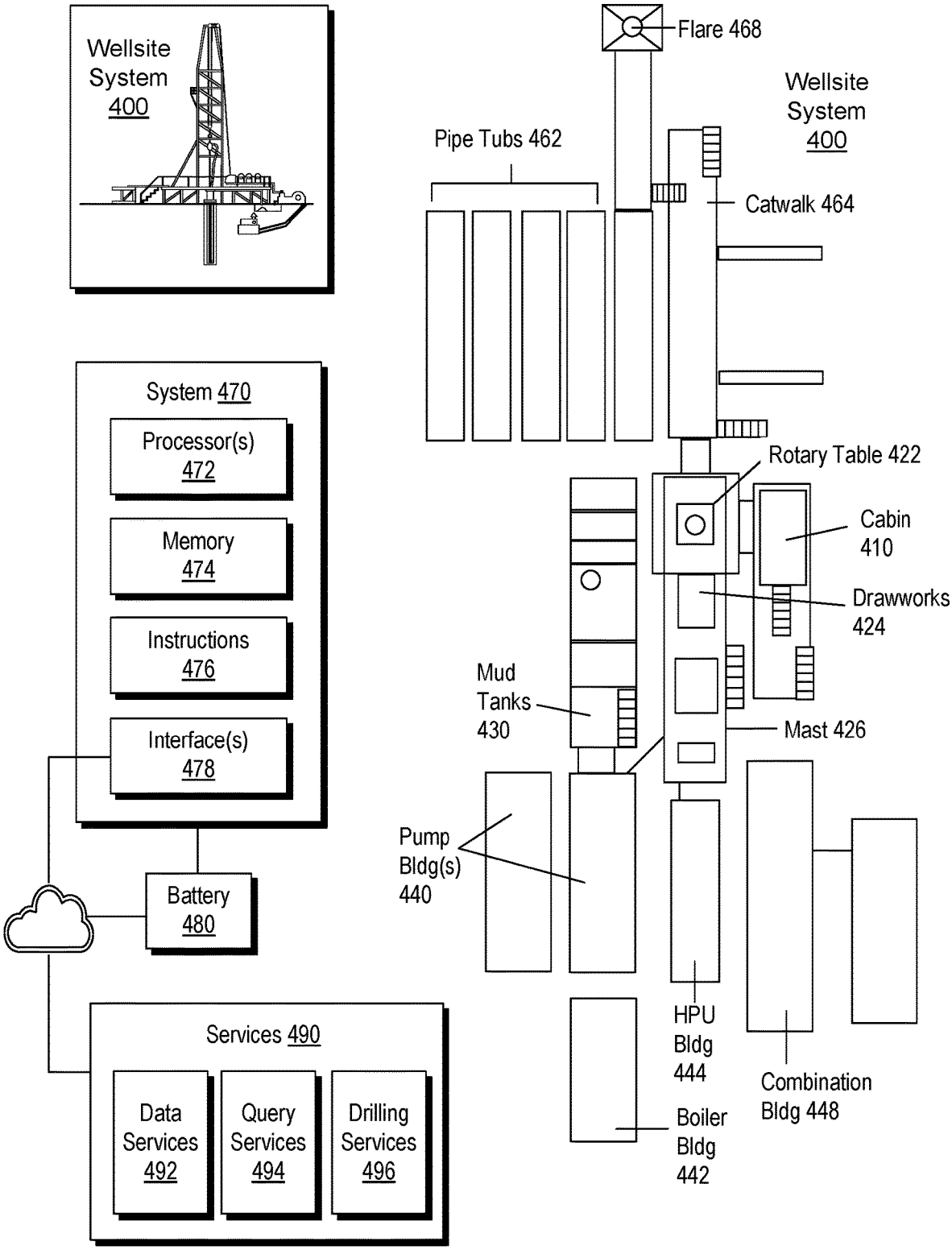
FIG. 4 illustrates an example of a wellsite system and an example of a computing system.

FIG. 4 shows an example of a wellsite system 400, specifically, FIG. 4 shows the wellsite system 400 in an approximate side view and an approximate plan view along with a block diagram of a system 470.

In the example of FIG. 4, the wellsite system 400 can include a cabin 410, a rotary table 422, drawworks 424, a mast 426 (e.g., optionally carrying a top drive, etc.), mud tanks 430 (e.g., with one or more pumps, one or more shakers, etc.), one or more pump buildings 440, a boiler building 442, an HPU building 444 (e.g., with a rig fuel tank, etc.), a combination building 448 (e.g., with one or more generators, etc.), pipe tubs 462, a catwalk 464, a flare 468, etc. Such equipment can include one or more associated functions and/or one or more associated operational risks, which may be risks as to time, resources, and/or humans.

As shown in the example of FIG. 4, the wellsite system 400 can include a system 470 that includes one or more processors 472, memory 474 operatively coupled to at least one of the one or more processors 472, instructions 476 that can be, for example, stored in the memory 474, and one or more interfaces 478. As an example, the system 470 can include one or more processor-readable media that include processor-executable instructions executable by at least one of the one or more processors 472 to cause the system 470 to control one or more aspects of the wellsite system 400. In such an example, the memory 474 can be or include the one or more processor-readable media where the processor-executable instructions can be or include instructions. As an example, a processor-readable medium can be a computer-readable storage medium that is not a signal and that is not a carrier wave.

FIG. 4 also shows a battery 480 that may be operatively coupled to the system 470, for example, to power the system 470. As an example, the battery 480 may be a back-up battery that operates when another power supply is unavailable for powering the system 470. As an example, the battery 480 may be operatively coupled to a network, which may be a cloud network. As an example, the battery 480 can include smart battery circuitry and may be operatively coupled to one or more pieces of equipment via a SMBus or other type of bus.

In the example of FIG. 4, services 490 are shown as being available, for example, via a cloud platform. Such services can include data services 492, query services 494 and drilling services 496. As an example, the services 490 may be part of a system such as the system 300 of FIG. 3.

As an example, the system 470 may be utilized to generate one or more sequences and/or to receive one or more sequences, which may, for example, be utilized to control one or more drilling operations. For example, consider a sequence that includes a sliding mode and a drilling mode and a transition therebetween.

Figure 5:
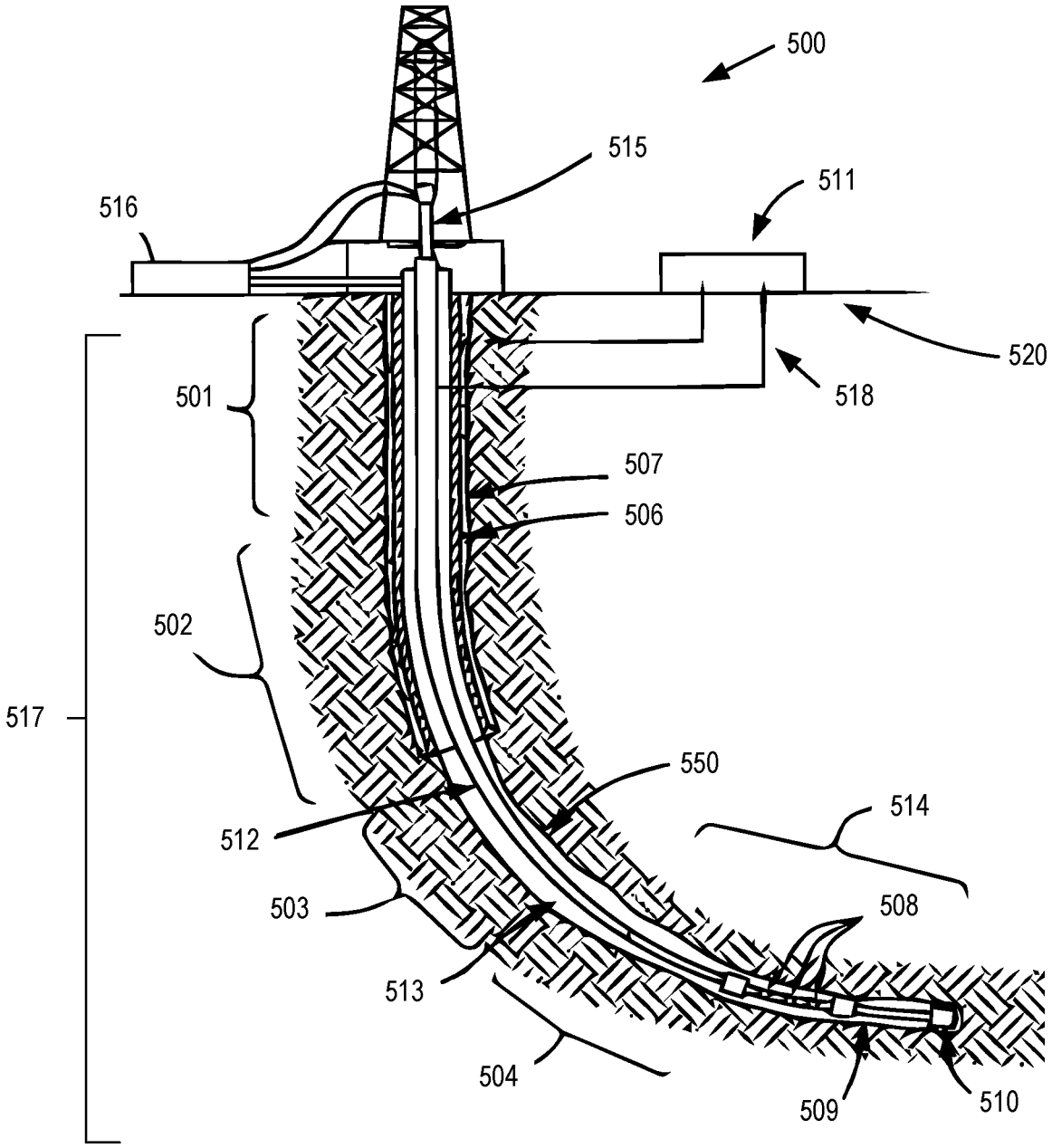
FIG. 5 illustrates an example of equipment in a geologic environment.

FIG. 5 shows a schematic diagram depicting an example of a drilling operation of a directional well in multiple sections. The drilling operation depicted in FIG. 5 includes a wellsite drilling system 500 and a field management tool 520 for managing various operations associated with drilling a bore hole 550 of a directional well 517. The wellsite drilling system 500 includes various components (e.g., drillstring 512, annulus 513, bottom hole assembly (BHA) 514, kelly 515, mud pit 516, etc.). As shown in the example of FIG. 5, a target reservoir may be located away from (as opposed to directly under) the surface location of the well 517. In such an example, special tools or techniques may be used to ensure that the path along the bore hole 550 reaches the particular location of the target reservoir.

As an example, the BHA 514 may include sensors 508, a rotary steerable system (RSS) 509, and a bit 510 to direct the drilling toward the target guided by a pre-determined survey program for measuring location details in the well. Furthermore, the subterranean formation through which the directional well 517 is drilled may include multiple layers (not shown) with varying compositions, geophysical characteristics, and geological conditions. Both the drilling planning during the well design stage and the actual drilling according to the drilling plan in the drilling stage may be performed in multiple sections (see, e.g., sections 501, 502, 503 and 504), which may correspond to one or more of the multiple layers in the subterranean formation. For example, certain sections (e.g., sections 501 and 502) may use cement 507 reinforced casing 506 due to the particular formation compositions, geophysical characteristics, and geological conditions.

In the example of FIG. 5, a surface unit 511 may be operatively linked to the wellsite drilling system 500 and the field management tool 520 via communication links 518. The surface unit 511 may be configured with functionalities to control and monitor the drilling activities by sections in real time via the communication links 518. The field management tool 520 may be configured with functionalities to store oilfield data (e.g., historical data, actual data, surface data, subsurface data, equipment data, geological data, geophysical data, target data, anti-target data, etc.) and determine relevant factors for configuring a drilling model and generating a drilling plan. The oilfield data, the drilling model, and the drilling plan may be transmitted via the communication link 518 according to a drilling operation workflow. The communication links 518 may include a communication subassembly.

During various operations at a wellsite, data can be acquired for analysis and/or monitoring of one or more operations. Such data may include, for example, subterranean formation, equipment, historical and/or other data. Static data can relate to, for example, formation structure and geological stratigraphy that define the geological structures of the subterranean formation. Static data may also include data about a bore, such as inside diameters, outside diameters, and depths. Dynamic data can relate to, for example, fluids flowing through the geologic structures of the subterranean formation over time. The dynamic data may include, for example, pressures, fluid compositions (e.g. gas oil ratio, water cut, and/or other fluid compositional information), and states of various equipment, and other information.

The static and dynamic data collected via a bore, a formation, equipment, etc. may be used to create and/or update a three dimensional model of one or more subsurface formations. As an example, static and dynamic data from one or more other bores, fields, etc. may be used to create and/or update a three dimensional model. As an example, hardware sensors, core sampling, and well logging techniques may be used to collect data. As an example, static measurements may be gathered using downhole measurements, such as core sampling and well logging techniques. Well logging involves deployment of a downhole tool into the wellbore to collect various downhole measurements, such as density, resistivity, etc., at various depths. Such well logging may be performed using, for example, a drilling tool and/or a wireline tool, or sensors located on downhole production equipment. Once a well is formed and completed, depending on the purpose of the well (e.g., injection and/or production), fluid may flow to the surface (e.g., and/or from the surface) using tubing and other completion equipment. As fluid passes, various dynamic measurements, such as fluid flow rates, pressure, and composition may be monitored. These parameters may be used to determine various characteristics of a subterranean formation, downhole equipment, downhole operations, etc.

As an example, a system can include a framework that can acquire data such as, for example, real time data associated with one or more operations such as, for example, a drilling operation or drilling operations. As an example, consider the PERFORM toolkit framework (Schlumberger Limited, Houston, Tex.).

As an example, a service can be or include one or more of OPTIDRILL, OPTILOG and/or other services marketed by Schlumberger Limited, Houston, Tex.

The OPTIDRILL technology can help to manage downhole conditions and BHA dynamics as a real time drilling intelligence service. The service can incorporate a rigsite display (e.g., a wellsite display) of integrated downhole and surface data that provides actionable information to mitigate risk and increase efficiency. As an example, such data may be stored, for example, to a database system (e.g., consider a database system associated with the STUDIO framework).

The OPTILOG technology can help to evaluate drilling system performance with single- or multiple-location measurements of drilling dynamics and internal temperature from a recorder. As an example, post-run data can be analyzed to provide input for future well planning.

As an example, information from a drill bit database may be accessed and utilized. For example, consider information from Smith Bits (Schlumberger Limited, Houston, Tex.), which may include information from various operations (e.g., drilling operations) as associated with various drill bits, drilling conditions, formation types, etc.

As an example, one or more QTRAC services (Schlumberger Limited, Houston Tex.) may be provided for one or more wellsite operations. In such an example, data may be acquired and stored where such data can include time series data that may be received and analyzed, etc.

As an example, one or more M-I SWACO services (M-I L.L.C., Houston, Tex.) may be provided for one or more wellsite operations. For example, consider services for value-added completion and reservoir drill-in fluids, additives, cleanup tools, and engineering. In such an example, data may be acquired and stored where such data can include time series data that may be received and analyzed, etc.

As an example, one or more ONE-TRAX services (e.g., via the ONE-TRAX software platform, M-I L.L.C., Houston, Tex.) may be provided for one or more wellsite operations. In such an example, data may be acquired and stored where such data can include time series data that may be received and analyzed, etc.

As an example, various operations can be defined with respect to WITS or WITSML, which are acronyms for well-site information transfer specification or standard (WITS) and markup language (WITSML). WITS/WITSML specify how a drilling rig or offshore platform drilling rig can communicate data. For example, as to slips, which are an assembly that can be used to grip a drillstring in a relatively non-damaging manner and suspend the drillstring in a rotary table, WITS/WITSML define operations such as "bottom to slips" time as a time interval between coming off bottom and setting slips, for a current connection; "in slips" as a time interval between setting the slips and then releasing them, for a current connection; and "slips to bottom" as a time interval between releasing the slips and returning to bottom (e.g., setting weight on the bit), for a current connection.

Well construction can occur according to various procedures, which can be in various forms. As an example, a procedure can be specified digitally and may be, for example, a digital plan such as a digital well plan. A digital well plan can be an engineering plan for constructing a wellbore. As an example, procedures can include information such as well geometries, casing programs, mud considerations, well control concerns, initial bit selections, offset well information, pore pressure estimations, economics and special procedures that may be utilized during the course of well construction, production, etc. While a drilling procedure can be carefully developed and specified, various conditions can occur that call for adjustment to a drilling procedure.

As an example, an adjustment can be made at a rigsite when acquisition equipment acquire information about conditions, which may be for conditions of drilling equipment, conditions of a formation, conditions of fluid(s), conditions as to environment (e.g., weather, sea, etc.), etc. Such an adjustment may be made on the basis of personal knowledge of one or more individuals at a rigsite. As an example, an operator may understand that conditions call for an increase in mudflow rate, a decrease in weight on bit, etc. Such an operator may assess data as acquired via one or more sensors (e.g., torque, temperature, vibration, etc.). Such an operator may call for performance of a procedure, which may be a test procedure to acquire additional data to understand better actual physical conditions and physical phenomena that may occur or that are occurring. An operator may be under one or more time constraints, which may be driven by physical phenomena, such as fluid flow, fluid pressure, compaction of rock, borehole stability, etc. In such an example, decision making by the operator can depend on time as conditions evolve. For example, a decision made at one fluid pressure may be sub-optimal at another fluid pressure in an environment where fluid pressure is changing. In such an example, timing as to implementing a decision as an adjustment to a procedure can have a broad ranging impact. An adjustment to a procedure that is made too late or too early can adversely impact other procedures compared to an adjustment to a procedure that is made at an optimal time (e.g., and implemented at the optimal time).

As an example, a system can include one or more automation assisted features. For example, consider a feature that can generate and/or receive one or more sequences that can be utilized to control a drilling operation. In such an example, a driller may utilize a generated sequence to control one or more pieces of equipment to drill a borehole.

As an example, where automation can issue signals to one or more pieces of equipment, a controller can utilize a generated sequence or a portion thereof for automatic control. As explained, where a driller is involved in decision making and/or control, a generated sequence may facilitate drilling as the driller may rely on the generated sequence for making one or more adjustments to a drilling operation. Where one or more generated sequences are received in advance and/or in real-time, drilling operations can be performed more efficiently, for example, with respect to time to drill a section, a portion of a section, an entire borehole, etc. Such an approach may take equipment integrity (e.g., health, etc.) into consideration, for example, such an approach may account for risk of contact between a bit body and a formation and/or mud motor performance where a mud motor can be utilized to drive a bit.

Figure 6:
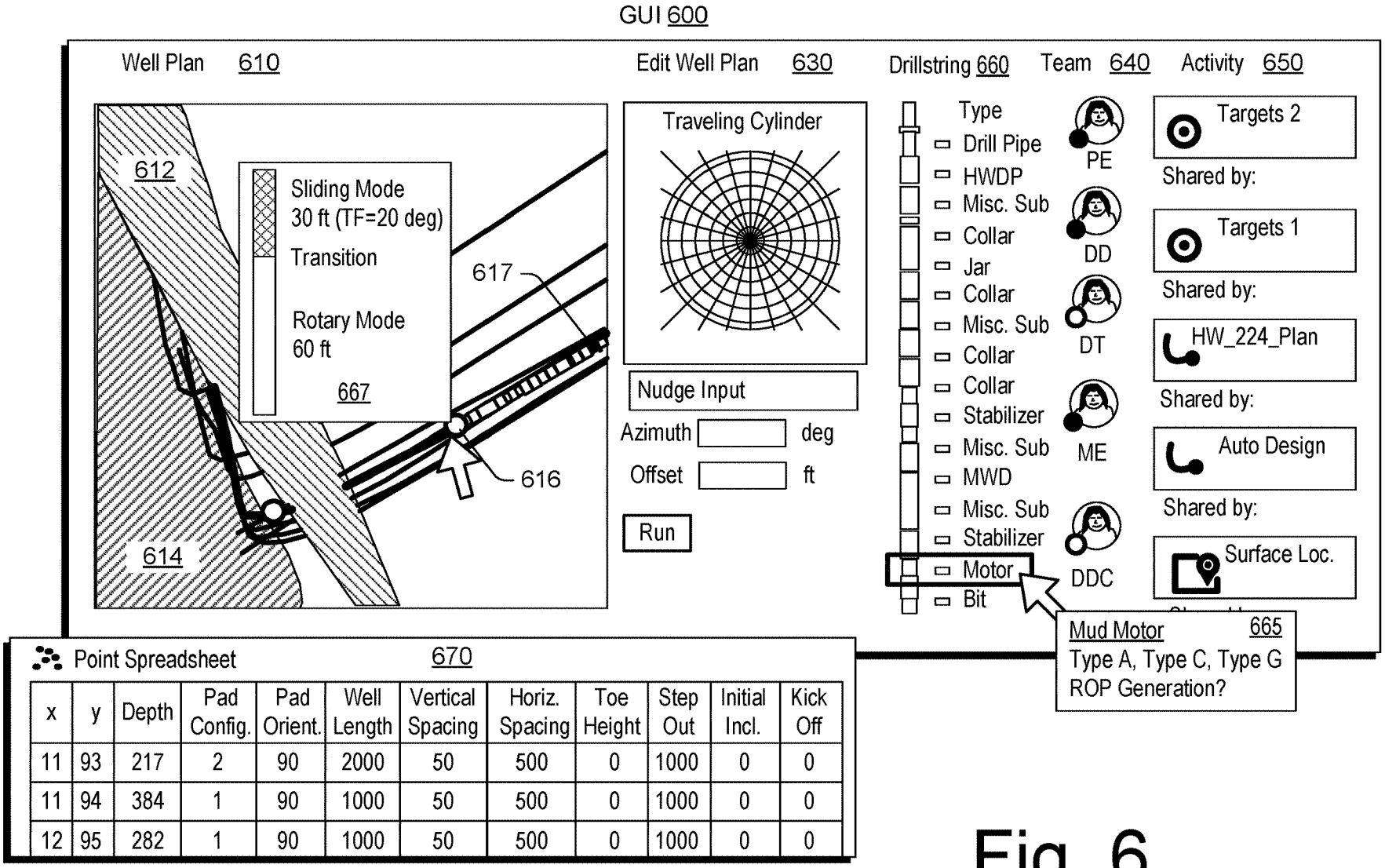
FIG. 6 illustrates an example of a graphical user interface.

FIG. 6 shows an example of a graphical user interface (GUI) 600 that includes information associated with a well plan. Specifically, the GUI 600 includes a panel 610 where surfaces representations 612 and 614 are rendered along with well trajectories where a location 616 can represent a position of a drillstring 617 along a well trajectory. The GUI 600 may include one or more editing features such as an edit well plan set of features 630. The GUI 600 may include information as to individuals of a team 640 that are involved, have been involved and/or are to be involved with one or more operations. The GUI 600 may include information as to one or more activities 650.

As shown in the example of FIG. 6, the GUI 600 can include a graphical control of a drillstring 660 where, for example, various portions of the drillstring 660 may be selected to expose one or more associated parameters (e.g., type of equipment, equipment specifications, operational history, etc.). In the example of FIG. 6, the drillstring graphical control 660 includes components such as drill pipe, heavy weight drill pipe (HWDP), subs, collars, jars, stabilizers, motor(s) and a bit. A drillstring can be a combination of drill pipe, a bottom hole assembly (BHA) and one or more other tools, which can include one or more tools that can help a drill bit turn and drill into material (e.g., a formation).

As an example, a workflow can include utilizing the graphical control of the drillstring 660 to select and/or expose information associated with a component or components such as, for example, a bit and/or a mud motor. As an example, in response to selection of a bit and/or a mud motor (e.g., consider a bit and mud motor combination), a computational framework (e.g., via a sequence engine, etc.) can generate one or more sequences, which may be utilized, for example, to operating drilling equipment in a particular mode (e.g., sliding mode, rotating mode, etc.). In the example of FIG. 6, a graphical control 665 is shown that can be rendered responsive to interaction with the graphical control of the drillstring 660, for example, to select a type of component and/or to generate one or more sequences, etc. In the example of FIG. 6, another graphical control 667 is shown that can be rendered to a display with information as to drilling of a stand, which may be approximately 90 ft in length (e.g., approximately 30 m). As shown, the graphical control 667 shows use of a sliding mode for 30 ft of the stand with a toolface angle of 20 degrees and a transition from the sliding mode to a rotary mode where the rotary mode is utilized for the remaining 60 ft of the stand. Such a graphical control may be utilized during one or more phases such as, for example, during planning and/or during execution. During execution, such a graphical control (e.g., or GUI) can be rendered as each stand is prepared for further drilling to inform a driller or an automated controller how to drill the stand.

FIG. 6 also shows an example of a table 670 as a point spreadsheet that specifies information for a plurality of wells. As shown in the example table 670, coordinates such as "x" and "y" and "depth" can be specified for various features of the wells, which can include pad parameters, spacings, toe heights, step outs, initial inclinations, kick offs, etc.

Figure 7:
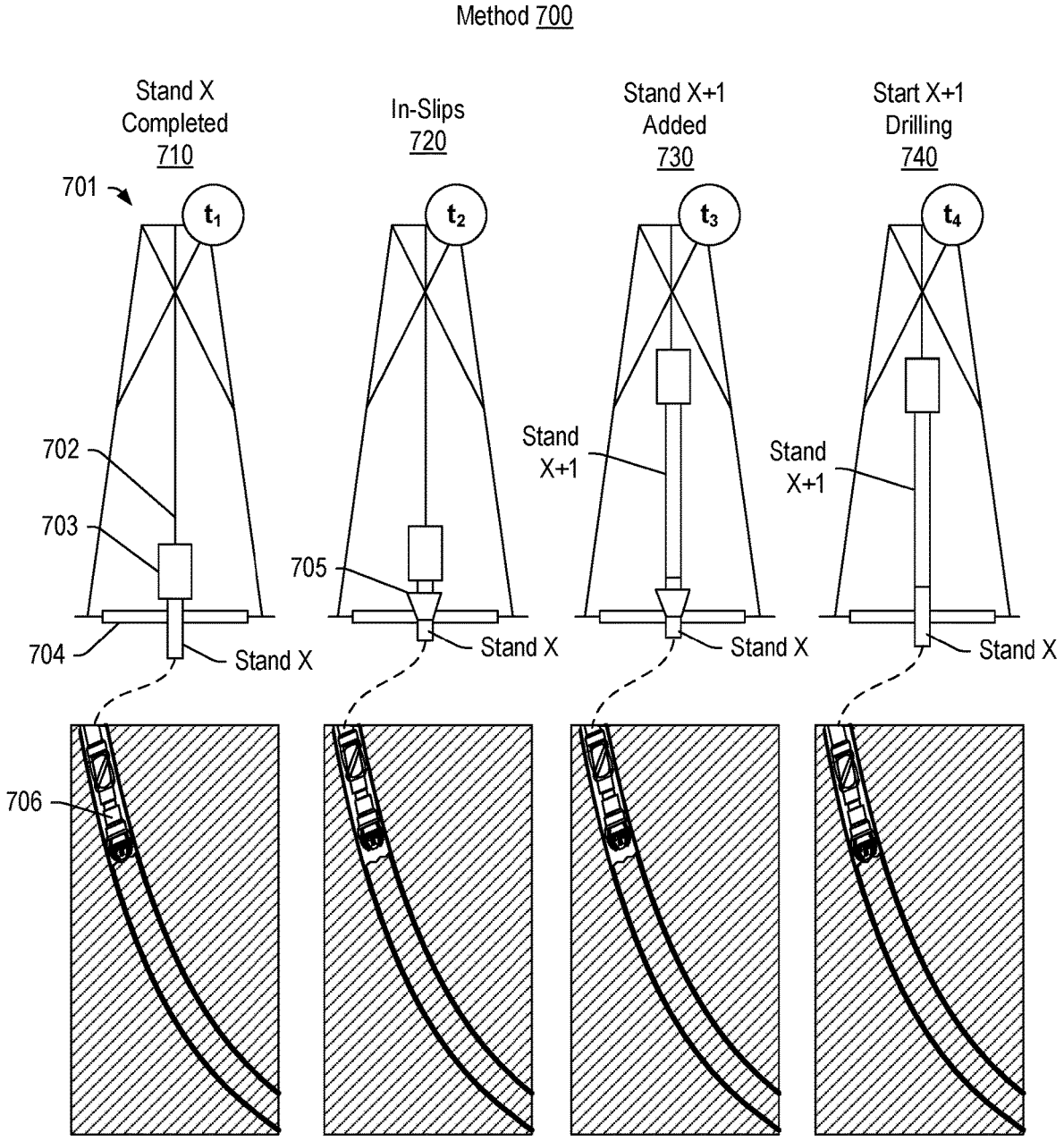
FIG. 7 illustrates an example of a method.

FIG. 7 shows an example of a method 700 that utilizes drilling equipment to perform drilling operations. As shown, the drilling equipment includes a rig 701, a lift system 702, a block 703, a platform 704, slips 705 and a bottom hole assembly 706. As shown, the rig 701 supports the lift system 702, which provides for movement of the block 703 above the platform 704 where the slips 705 may be utilized to support a drillstring that includes the bottom hole assembly 706, which is shown as including a bit to drill into a formation to form a borehole.

As to the drilling operations, they include a first operation 710 that completes a stand (Stand X) of the drillstring; a second operation 720 that pulls the drillstring off the bottom of the borehole by moving the block 703 upwardly and that supports the drillstring in the platform 704 using the slips 705; a third operation 730 that adds a stand (Stand X+1) to the drillstring; and a fourth operation 740 that removes the slips 705 and that lowers the drillstring to the bottom of the borehole by moving the block 703 downwardly. Various details of examples of equipment and examples of operations are also explained with respect to FIGS. 1, 2, 3, 4, 5 and 6.

As an example, drilling operations may utilize one or more types of equipment to drill, which can provide for various modes of drilling. As a borehole is deepened by drilling, as explained, stands can be added to a drillstring. A stand can be one or more sections of pipe; noting that a pipe-by-pipe or hybrid stand and pipe approach may be utilized.

In the example of FIG. 7, the operations 710, 720, 730 and 740 may take a period of time that may be of the order of minutes. For example, consider the amount of time it takes to position and connect a stand to another stand of a drillstring. A stand may be approximately 30 meters in length where precautions are taken to avoid detrimental contacting of the stand (metal or metal alloy) with other equipment or humans. During the period of time, one or more types of calculations, computations, communications, etc., may occur. For example, a driller may perform a depth of hole calculation based on a measured length of a stand, etc. As an example, a driller may analyze survey data as acquired by one or more downhole tools of a drillstring. Such survey data may help a driller to determine whether or not a planned or otherwise desired trajectory is being followed, which may help to inform the driller as to how drilling is to occur for an increase in borehole depth corresponding approximately to the length of the added stand.

As an example, where a top drive is utilized (e.g., consider the block 703 as including a top drive), as the top drive approaches the platform 704, rotation and circulation can be stopped and the drillstring lifted a distance off the bottom of the borehole. As the top drive is to be coupled to another stand, it is to be disconnected, which means that the drillstring is to be supported, which can be accomplished through use of the slips 705. The slips 705 can be set on a portion of the last stand (e.g., a pipe) to support the weight of the drillstring such that the top drive can be disconnected from the drillstring by operator(s), for example, using a top drive pipehandler. Once disconnected, the driller can then raise the top drive (e.g., the block 703) to an appropriate level such as a fingerboard level, where another stand of pipe (e.g., approximately 30 m) can be delivered to a set of drill pipe elevators hanging from the top drive. The stand (e.g., Stand X+1) can be raised and stabbed into the drillstring. The top drive can then be lowered until its drive stem engages an upper connection of the stand (e.g., Stand X+1). The top drive motor can be engaged to rotate the drive stem such that upper and lower connections of the stand are made up relatively simultaneously. In such an example, a backup tong may be used at the platform 704 (e.g., drill floor) to prevent rotation of the drillstring as the connections are being made. After the connections are properly made up, the slips 705 can be released (e.g., out-of-slips). Circulation of drilling fluid (e.g., mud) can commence (e.g., resume) and, once the bit of the bottom hole assembly 706 contacts the bottom of the borehole, the top drive can be utilized for drilling to deepen the borehole. The entire process, from the time the slips are set on the drillstring (e.g., in-slips), a new stand is added, the connections are made up, and the slips are released (e.g., out-of-slips), allowing drilling to resume, can take on the order of tens of seconds to minutes, generally less than 10 minutes where operations are normal and as expected.

As to the aforementioned top drive approach, the process of adding a new stand of pipe to the drillstring, and drilling down to the platform (e.g., the floor), can involve fewer actions and demand less involvement from a drill crew when compared to kelly drilling (e.g., rotary table drilling). Drillers and rig crews can become relatively proficient in drilling with top drives. Built-in features such as thread compensation, remote-controlled valves to stop the flow of drilling fluids, and mechanisms to tilt the elevators and links to the derrickman or floor crew can add to speed, convenience and safety associated with top drive drilling.

As an example, a top drive can be utilized when drilling with single joints (e.g., 10 m lengths) of pipe, although greater benefit may be achieved by drilling with triples (e.g., stands of pipe where a stand can be approximately 30 m long). As explained, with the drill pipe being supported and rotated from the top, an entire stand of drill pipe can be drilled down at one time. Such an approach can extend the time the bit is on bottom and can help to produce a cleaner borehole. Compared to kelly drilling, where a connection is made after drilling down a single joint of pipe, top drive drilling can result in faster drilling by reducing demand for two out of three connections.

As mentioned, a well can be a direction well, which is constructed using directional drilling. Directional wells have been a boon to oil and gas production, particularly in unconventional plays, where horizontal and extended-reach wells can help to maximize wellbore exposure through productive zones.

One or more of various technologies can be utilized for directional drilling. For example, consider a steerable mud motor that can be utilized to achieve a desired borehole trajectory to and/or through one or more target zones. As an example, a directional drilling operation can use a downhole mud motor when they kick off the well, build angle, drill tangent sections and maintain trajectory.

A mud motor can include a bend in a motor bearing housing that provides for steering a bit toward a desired target. A bend can be surface adjustable (e.g., a surface adjustable bend (SAB)) and, for example, set at an angle in a range of operational angles (e.g., consider 0 degrees to approximate 5 degrees, 0 degrees to approximately 4 degrees, 0 degrees to approximately 3 degrees, etc.). The bend can aim to be sufficient for pointing the bit in a given direction while being small enough to permit rotation of the entire mud motor assembly during rotary drilling. The deflection cause by a bend can be a factor that determines a rate at which a mud motor can build angle to construct a desired borehole. By orienting the bend in a specific direction, referred to as a toolface angle, a drilling operation can change the inclination and/or the azimuth of a borehole trajectory. To maintain the orientation of the bend, the drillstring is operated in a sliding mode where the entire drillstring itself does not rotate in the borehole (e.g., via a top drive, a rotary table, etc.) and where bit rotation for drilling is driven by a mud motor of the drillstring.

A mud motor is a type of positive displacement motor (PDM) powered by drilling fluid. As an example, a mud motor can include an eccentric helical rotor and stator assembly drive. As drilling fluid (e.g., mud) is pumped downhole, the drilling fluid flows through the stator and turns the rotor. The mud motor converts hydraulic power to mechanical power to turn a drive shaft that causes a bit operatively coupled to the mud motor to rotate.

Through use of a mud motor, a directional drilling operation can alternate between rotating and sliding modes of drilling. In the rotating mode, a rotary table or top drive is operated to rotate an entire drillstring to transmit power to a bit. As mentioned, the rotating mode can include combined rotation via surface equipment and via a downhole mud motor. In the rotating mode, rotation enables a bend in the motor bearing housing to be directed equally across directions and thus maintain a straight drilling path. As an example, one or more measurement-while-drilling (MWD) tools integrated into a drillstring can provide real-time inclination and azimuth measurements. Such measurements may be utilized to alert a driller, a controller, etc., to one or more deviations from a desired trajectory (e.g., a planned trajectory, etc.). To adjust for a deviation or to alter a trajectory, a drilling operation can switch from the rotating mode to the sliding mode. As mentioned, in the sliding mode, the drillstring is not rotated; rather, a downhole motor turns the bit and the borehole is drilled in the direction the bit is point, which is controlled by toolface orientation. Upon adjustment of course and reestablishing a desired trajectory that aims to hit a target (or targets), a drilling operation may transition from the sliding mode to the rotating mode, which, as mentioned, can be a combined surface and downhole rotating mode.

Of the two modes, slide drilling of the sliding mode tends to be less efficient; hence, lateral reach can come at the expense of penetration rate. The rate of penetration (ROP) achieved using a sliding technique tends to be approximately 10 percent to 25 percent of that attainable using a rotating technique. For example, when a mud motor is operated in the sliding mode, axial drag force in a curve portion and/or in a lateral portion acts to reduce the impact of surface weight such that surface weight is not effectively transferred downhole to a bit, which can lead to a lower penetration rate and lower drilling efficiency.

Various types of automated systems (e.g., auto drillers) may aim to help a drilling operation to achieve gains in horizontal reach with noticeably faster rates of penetration.

When transitioning from the rotating mode to the sliding mode, a drilling operation can halt rotation of a drillstring and initiate a slide by orienting a bit to drill, for example, in alignment with a trajectory proposed in a well plan. As to halting rotation of a drillstring, consider, as an example, a drilling operation that pulls a bit off-bottom and reciprocates drillpipe to release torque that has built up within the drillstring. The drilling operation can then orient a downhole mud motor using real-time MWD toolface measurements to ensure the specified borehole deviation is obtained. Following this relatively time-consuming orientation process, the drilling operation can set a top drive brake to prevent further rotation from the surface. In such an example, a slide can begin as the drilling operation eases off a drawworks brake to control hook load, which, in turn, affects the magnitude of weight imposed at the bit (e.g., WOB). As an example, minor right and left torque adjustments (e.g., clockwise and counter-clockwise) may be applied manually to steer the bit as appropriate to keep the trajectory on course.

As the depth or lateral reach increases, a drillstring tends to be subjected to greater friction and drag. These forces, in turn, affect ability to transfer weight to the bit (e.g., WOB) and control toolface orientation while sliding, which may make it more difficult to attain sufficient ROP and maintain a desired trajectory to a target (or targets). Such issues can result in increased drilling time, which may adversely impact project economics and ultimately limit length of a lateral section of a borehole and hence a lateral section of a completed well (e.g., a producing well).

The capability to transfer weight to a bit affects several aspects of directional drilling. As an example, a drilling operation can transfers weight to a bit by easing, or slacking off, a brake, which can transfer some of the hook load, or drillstring weight, to the bit. The difference between the weight imposed at the bit and the amount of weight made available by easing the brake at the surface is primarily caused by drag. As a horizontal departure of a borehole increases, longitudinal drag of the drillpipe along the borehole tends to increase.

Controlling weight at the bit throughout the sliding mode can be made more difficult by drillstring elasticity, which permits the pipe to move nonproportionally. Such elasticity can cause one segment of drillstring to move while other segments remain stationary or move at different velocities. Conditions such as, for example, poor hole cleaning may also affect weight transfer. In the sliding mode, hole cleaning tends to be less efficient because of a lack of pipe rotation; noting that pipe rotation facilitates turbulent flow in the annulus between the pipe (drillstring pipe or stands) and the borehole and/or cased section(s). Poor hole cleaning is associated with ability to carry solids (e.g., crushed rock) in drilling fluid (e.g., mud). As solids accumulate on the low side of a borehole due to gravity, the cross-sectional area of the borehole can decrease and cause an increase in friction on a drillstring (e.g., pipe or stands), which can make it more difficult to maintain a desired weight on bit (WOB), which may be a desired constant WOB. As an example, poor hole cleaning may give rise to an increased risk of sticking (e.g., stuck pipe).

Differences in frictional forces between a drillstring inside of casing versus that in open hole can cause weight to be released suddenly, as can hang-ups caused by key seats and ledges. A sudden transfer of weight to the bit that exceeds a downhole motor's capacity may cause bit rotation to abruptly halt and the motor to stall. Frequent stalling can damage the stator component of a mud motor, depending on the amount of the weight transferred. A drilling operation can aim to operate a mud motor within a relatively narrow load range in an effort to maintain an acceptable ROP without stalling.

As an example, a system can include a console, which can include one or more displays that can render one or more graphical user interfaces (GUIs) that include data from one or more sensors. As an example, an impending stall might be indicated by an increase in WOB as rendered to a GUI, for example, with no corresponding upsurge in downhole pressure to signal that an increase in downhole WOB has actually occurred. In such an example, at some point, the WOB indicator may show an abrupt decrease, indicating a sudden transfer of force from the drillstring to the bit. Increases in drag impede an ability to remove torque downhole, making it more difficult to set and maintain toolface orientation.

Toolface orientation can be affected by torque and WOB. When weight is applied to the bit, torque at the bit tends to increase. As mentioned, torque can be transmitted downhole through a drillstring, which is operated generally for drilling by turning to the right, in a clockwise direction. As weight is applied to the bit, reactive torque, acting in the opposite direction, can develop. Such left-hand torque (e.g., bit reaction torque in a counter-clockwise direction) tends to twist the drillstring due to the elastic flexibility of drillstring in torsional direction. In such conditions, the motor toolface angle can rotate with the twist of drillstring. A drilling operation can consider the twist angle due to reactive torque when the drilling operation tries to orient the toolface of a mud motor from the surface. Reactive torque tends to build as weight is increased, for example, reaching its maximum value when a mud motor stalls. As an example, reactive torque can be taken into account as a drilling operation tries to orient a mud motor from the surface. In practice, a drilling operation may act to make minor shifts in toolface orientation by changing downhole WOB, which alters the reactive torque. To produce larger changes, the drilling operation may act to lift a bit off-bottom and reorient the toolface. However, even after the specified toolface orientation is achieved, maintaining that orientation can be at times challenging. As mentioned, longitudinal drag tends to increases with lateral reach, and weight transfer to the bit can become more erratic along the length of a horizontal section, thus allowing reactive torque to build and consequently change the toolface angle. The effort and time spent on orienting the toolface can adversely impact productive time on the rig.

As explained, directional drilling can involve operating in the rotating mode and operating in the sliding mode where multiple transitions can be made between these two modes. As mentioned, drilling fluid can be utilized to drive a downhole mud motor and hence rotate a bit in a sliding mode while surface equipment can be utilized to rotate an entire drillstring in a rotating mode (e.g., a rotary table, a top drive, etc.), optionally in combination with drilling fluid being utilized to drive a downhole mud motor (e.g., a combined rotating mode). Directional drilling operations can depend on various factors, including operational parameters that can be at least to some extent controllable. For example, one or more factors such as mode transitions, lifting, WOB, RPM, torque, and drilling fluid flow rate can be controllable during a drilling operation.

Figure 8:
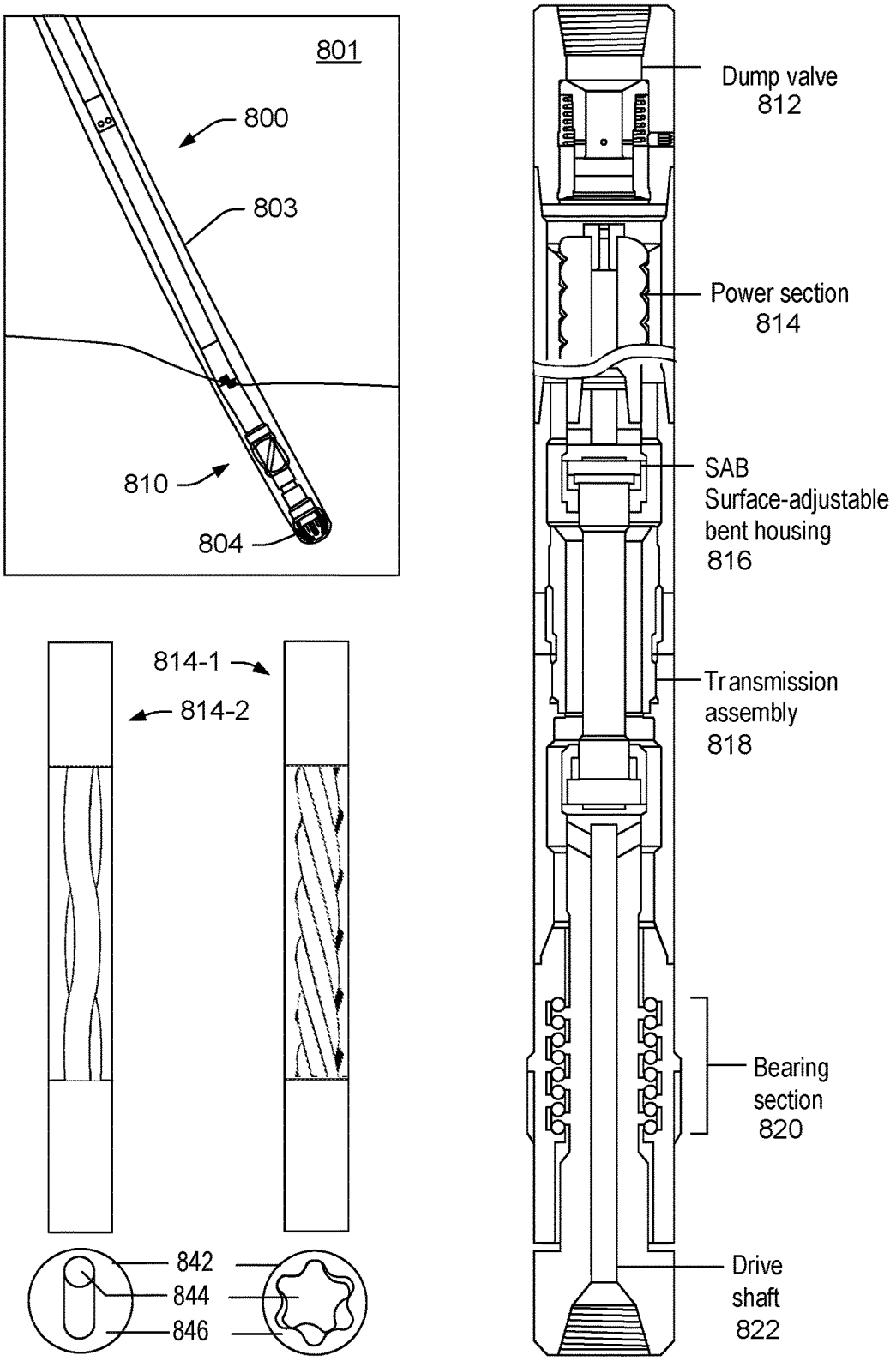
FIG. 8 illustrates examples of directional drilling equipment.

FIG. 8 shows an example of a drilling assembly 800 in a geologic environment 801 that includes a borehole 803 where the drilling assembly 800 (e.g., a drillstring) includes a bit 804 and a motor section 810 where the motor section 810 includes a mud motor that can drive the bit 804 (e.g., cause the bit 804 to rotate and deepen the borehole 803).

As shown, the motor section 810 includes a dump valve 812, a power section 814, a surface-adjustable bent housing 816, a transmission assembly 818, a bearing section 820 and a drive shaft 822, which can be operatively coupled to a bit such as the bit 804. Flow of drilling fluid through the power section 814 can generate power that can rotate the drive shaft 822, which can rotate the bit 804.

As to the power section 814, two examples are illustrated as a power section 814-1 and a power section 814-2 each of which includes a housing 842, a rotor 844 and a stator 846. The rotor 844 and the stator 846 can be characterized by a ratio. For example, the power section 814-1 can be a 5:6 ratio and the power section 814-2 can be a 1:2 ratio, which, as seen in cross-sectional views, can involve lobes (e.g., a rotor/stator lobe configuration). The motor section 810 of FIG. 8 may be a POWERPAK family motor section (Schlumberger Limited, Houston, Tex.) or another type of motor section. The POWERPAK family of motor sections can include ratios of 1:2, 2:3, 3:4, 4:5, 5:6 and 7:8 with corresponding lobe configurations.

A power section can convert hydraulic energy from drilling fluid into mechanical power to turn a bit. For example, consider the reverse application of the Moineau pump principle. During operation, drilling fluid can be pumped into a power section at a pressure that causes the rotor to rotate within the stator where the rotational force is transmitted through a transmission shaft and drive shaft to a bit.

A motor section may be manufactured in part of corrosion-resistant stainless steel where a thin layer of chrome plating may be present to reduce friction and abrasion. As an example, tungsten carbide may be utilized to coat a rotor, for example, to reduce abrasion wear and corrosion damage. As to a stator, it can be formed of a steel tube, which may be a housing (see, e.g., the housing 842) with an elastomeric material that lines the bore of the steel tube to define a stator. An elastomeric material may be referred to as a liner or, when assembled with the tube or housing, may be referred to as a stator. As an example, an elastomeric material may be molded into the bore of a tube. An elastomeric material can be formulated to resist abrasion and hydrocarbon induced deterioration. Various types of elastomeric materials may be utilized in a power section and some may be proprietary. Properties of an elastomeric material can be tailored for particular types of operations, which may consider factors such as temperature, speed, rotor type, type of drilling fluid, etc. Rotors and stators can be characterized by helical profiles, for example, by spirals and/or lobes. A rotor can have one less fewer spiral or lobe than a stator (see, e.g., the cross-sectional views in FIG. 8).

During operation, the rotor and stator can form a continuous seal at their contact points along a straight line, which produces a number of independent cavities. As fluid is forced through these progressive cavities, it causes the rotor to rotate inside the stator. The movement of the rotor inside the stator is referred to as nutation. For each nutation cycle, the rotor rotates by a distance of one lobe width. The rotor nutates each lobe in the stator to complete one revolution of the bit box. For example, a motor section with a 7:8 rotor/stator lobe configuration and a speed of 100 RPM at the bit box will have a nutation speed of 700 cycles per minute. Generally, torque output increases with the number of lobes, which corresponds to a slower speed. Torque also depends on the number of stages where a stage is a complete spiral of a stator helix. Power is defined as speed times torque; however, a greater number of lobes in a motor does not necessarily mean that the motor produces more power. Motors with more lobes tend to be less efficient because the seal area between the rotor and the stator increases with the number of lobes.

The difference between the size of a rotor mean diameter (e.g., valley to lobe peak measurement) and the stator minor diameter (lobe peak to lobe peak) is defined as the rotor/stator interference fit. Various motors are assembled with a rotor sized to be larger than a stator internal bore under planned downhole conditions, which can produce a strong positive interference seal that is referred to as a positive fit. Where higher downhole temperatures are expected, a positive fit can be reduced during motor assembly to allow for swelling of an elastomeric material that forms the stator (e.g., stator liner). Mud weight and vertical depth can be considered as they can influence the hydrostatic pressure on the stator liner. A computational framework such as, for example, the POWERFIT framework (Schlumberger Limited, Houston, Tex.), may be utilized to calculate a desired interference fit.

As to some examples of elastomeric materials, consider nitrile rubber, which tends to be rated to approximately 138 C (280 F), and highly saturated nitrile, which may be formulated to resist chemical attack and be rated to approximately 177 C (350 F).

The spiral stage length of a stator is defined as the axial length for one lobe in the stator to rotate 360 degrees along its helical path around the body of the stator. The stage length of a rotor differs from that of a stator as a rotor has a shorter stage length than its corresponding stator. More stages can increase the number of fluid cavities in a power section, which can result in a greater total pressure drop. Under the same differential pressure conditions, the power section with more stages tends to maintain speed better as there tends to be less pressure drop per stage and hence less leakage.

Drilling fluid temperature, which may be referred to as mud temperature or mud fluid temperature, can be a factor in determining an amount of interference in assembling a stator and a rotor of a power section. As to interference, greater interference can result in a stator experiencing higher shearing stresses, which can cause fatigue damage. Fatigue can lead to premature chunking failure of a stator liner. As an example, chlorides or other such halides may cause damage to a power section. For example, such halides may damage a rotor through corrosion where a rough edged rotor can cut into a stator liner (e.g., cutting the top off an elastomeric liner). Such cuts can reduce effectiveness of a rotor/stator seal and may cause a motor to stall (e.g., chunking the stator) at a low differential pressure. For oil-based mud (OBM) with supersaturated water phases and for salt muds, a coated rotor can be beneficial.

As to differential pressure, as mentioned, it is defined as the difference between the on-bottom and off-bottom drilling pressure, which is generated by the rotor/stator section (power section) of a motor. As mentioned, for a larger pressure difference, there tends to be higher torque output and lower shaft speed. A motor that is run with differential pressures greater than recommended can be more prone to premature chunking. Such chunking may follow a spiral path or be uniform through the stator liner. A life of a power section can depend on factors that can lead to chunking (e.g., damage to a stator), which may depend on characteristics of a rotor (e.g., surface characteristics, etc.).

As to trajectory of a wellbore to be drilled, it can be defined in part by one or more dogleg seventies (DLSs). Rotating a motor in high DLS interval of a well can increase risk of damage to a stator. For example, the geometry of a wellbore can cause a motor section to bend and flex. A power section stator can be relatively more flexible that other parts of a motor. Where the stator housing bends, the elastomeric liner can be biased or pushed upon by the housing, which can result in force being applied by the elastomeric liner to the rotor. Such force can lead to excessive compression on the stator lobes and cause chunking.

A motor can have a power curve. A test can be performed using a dynamo meter in a laboratory, for example, using water at room temperature to determine a relationship between input, which is flow rate and differential pressure, to power output, in the form of RPM and torque. Such information can be available in a motor handbook. However, what is actually happening downhole can differ due to various factors. For example, due to effect of downhole pressure and temperature, output can be reduced (e.g., the motor power output). Such a reduction may lead one to conclude that a motor is not performing. In response, a driller may keep pushing such that the pressure becomes too high, which can damage elastomeric material due to stalling (e.g., damage a stator).

Figure 9:
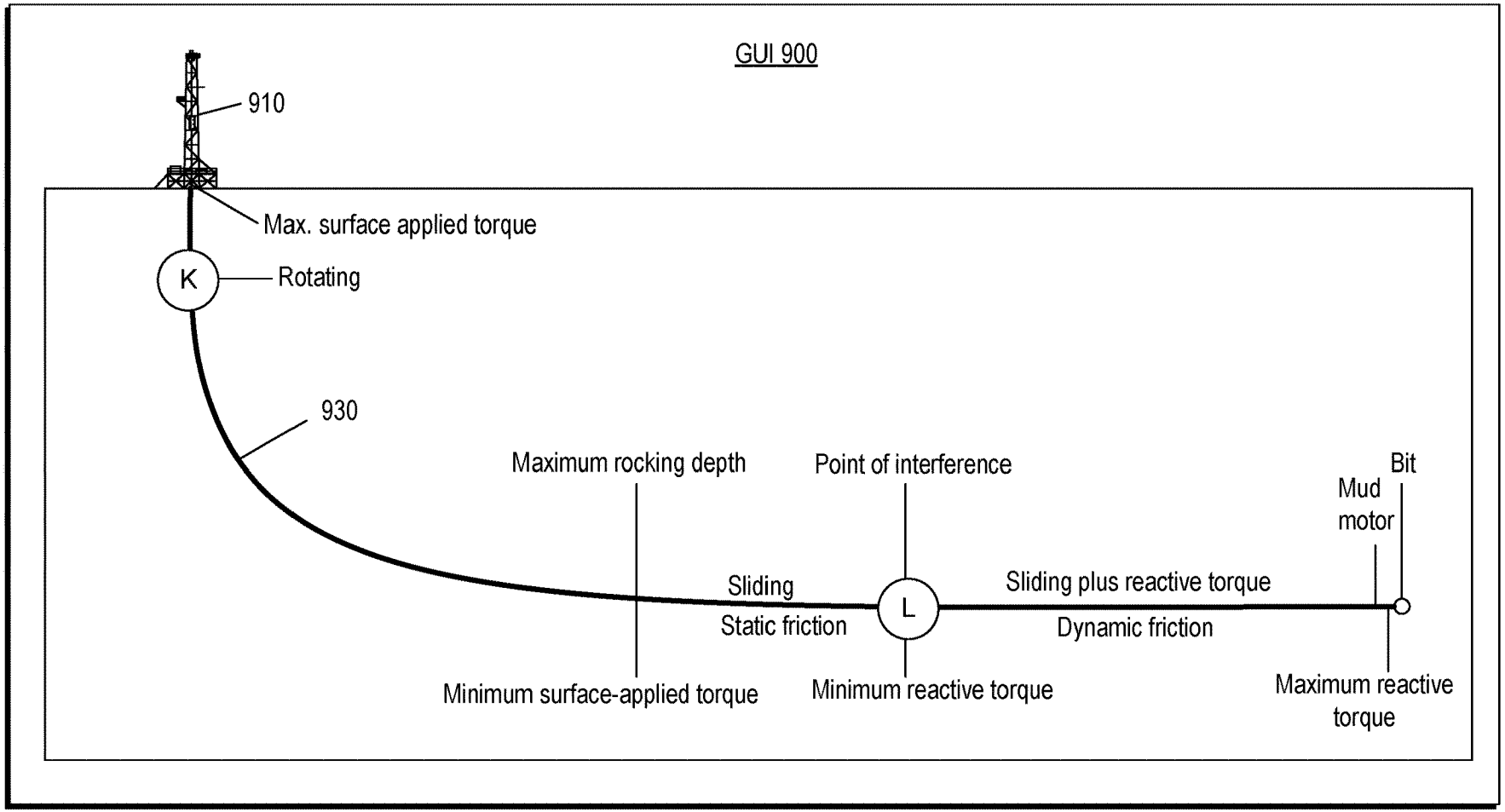
FIG. 9 illustrates an example of a graphical user interface.

FIG. 9 shows an example of a graphical user interface 900 that includes a graphic of a system 910 and a graphic of a trajectory 930 where the system 910 can perform directional drilling to drill a borehole according to the trajectory 930. As shown, the trajectory 930 includes a substantially vertical section, a dogleg and a substantially lateral section (e.g., a substantially horizontal section). As an example, the dogleg can be defined between a kickoff point (K) and a landing point (L), which are shown approximately as points along the trajectory 930. The system 910 can be operated in various operational modes, which can include, for example, a rotary drilling mode and a sliding drilling mode.

In the example of FIG. 9, longitudinal drag along the drillstring can be reduced from the surface down to a maximum rocking depth, at which friction and imposed torque are in balance. As an example, a drilling operation can include manipulating surface torque oscillations such that the maximum rock depth may be moved deep enough to produce a substantial reduction in drag. As an example, reactive torque from a bit can create vibrations that propagate back uphole, breaking friction and longitudinal drag across a bottom section of a drillstring up to a point of interference, where the torque is balanced by static friction. As shown in the example of FIG. 9, an intermediate zone may remain relatively unaffected by surface rocking torque or by reactive torque. In the example of FIG. 9, a drilling operation can include monitoring torque, WOB and ROP while sliding. As an example, such a drilling operation may aim to minimize length of the intermediate zone and thus reduce longitudinal drag.

A drilling operation in the sliding mode that involves manual adjustments to change and/or maintain a toolface orientation can be challenging. As an example, a drilling operation in the sliding mode can depend on an ability to transfer weight to a bit without stalling a mud motor and an ability to reduce longitudinal drag sufficiently to achieve and maintain a desired toolface angle. As an example, a drilling operation in the sliding mode can aim to achieve an acceptable ROP while taking into account one or more of various other factors (e.g., equipment capabilities, equipment condition, tripping, etc.).

In a drilling operation, as an example, amount of surface torque (e.g., STOR) supplied by a top drive can largely dictate how far downhole rocking motion can be transmitted. As an example, a relationship between torque and rocking depth can be modeled using a torque and drag framework (e.g., T&D framework). As an example, a system may include one or more T&D features.

As an example, a system may utilize inputs from surface hook load and standpipe pressure as well as downhole MWD toolface angle. In such an example, the system may automatically determine the amount of surface torque that is appropriate to transfer weight downhole to a bit, which may allow an operation to not come off-bottom to make a toolface adjustment, which can results in a more efficient drilling operation and reduced wear on downhole equipment. Such a system may be referred to as an automation assisted system.

Figure 10:
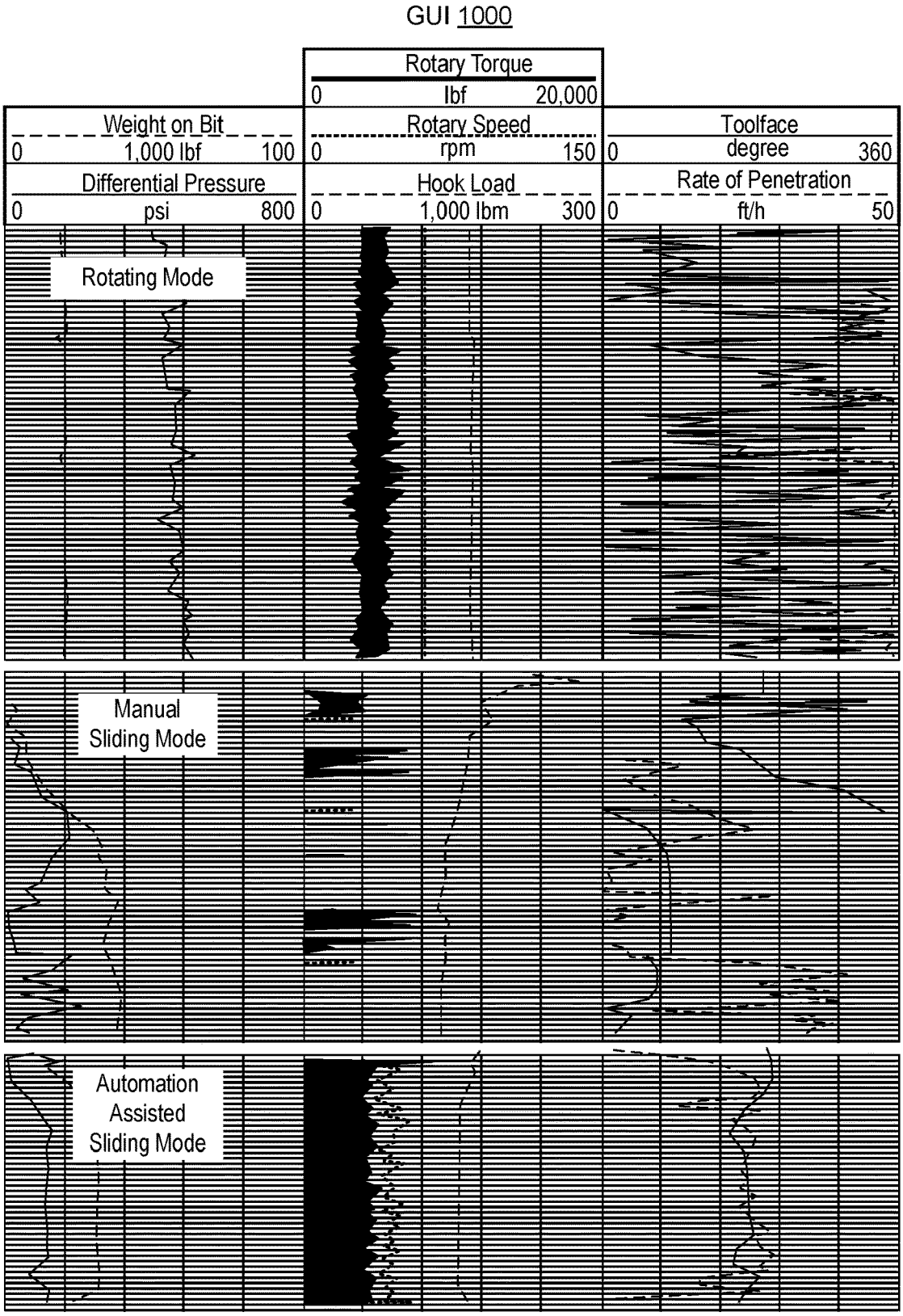
FIG. 10 illustrates an example of a graphical user interface.

FIG. 10 shows an example of a graphical user interface 1000 that includes various tracks for different types of operations, which include rotating, manual sliding, and automation assisted sliding according to a provided amount of surface torque. As shown in the GUI 1000, comparisons can be made for rotating and sliding drilling parameters for the rotating mode and the sliding mode. As shown, rate of penetration (ROP) and toolface orientation control can depend large on an ability of a system to transfer weight to the bit and counter the effects of torque and drag between rotating and sliding modes. As shown, the best ROP is achieved while rotating; however, toolface varies drastically, as there is no attempt to control it (Track 3). Hook load (Track 2) and weight on bit (WOB) remain fairly constant while differential pressure (Track 1) shows a slight increase as depth increases. To begin manual sliding, a drilling operation can act to pull off-bottom to release trapped torque; during this time, WOB (Track 1) decreases while hook load (Track 2) increases. As drilling proceeds, inconsistencies in differential pressure (e.g., difference between pressures when the bit is on-bottom versus off-bottom) indicate poor transfer of weight to the bit (Track 1). Spikes of rotary torque indicate efforts to orient and maintain toolface orientation (Track 2). As shown, toolface control may be poor because of trouble transferring weight to bit, which is also reflected by poor ROP (Track 3). Using an automation assisted sliding mode system, a directional driller can more quickly gain toolface orientation. When the WOB increased, differential pressure was consistent, demonstrating good weight transfer (Track 1). In the example of FIG. 10, weight on bit during a sliding operation is lower than during a manual sliding operation. Left-right oscillation of the drillpipe is relatively constant through the slide (Track 2). Average ROP is substantially higher than that attained during the manual slide, and toolface orientation is more consistent (Track 3).

FIG. 11 shows an example of a graphical user interface 1100 that includes various types of information for construction of a well where times are rendered for corresponding actions. In the example of FIG. 11, the times are shown as an estimated time (ET) in hours and a total or cumulative time (TT), which is in days. Another time may be a clean time, which can be for performing an action or actions without occurrence of non-productive time (NPT) while the estimated time (ET) can include NPT, which may be determined using one or more databases, probabilistic analysis, etc. In the example of FIG. 11, the total time (TT or cumulative time) may be a sum of the estimated time column. As an example, during execution and/or replanning the GUI 1100 may be rendered and revised accordingly to reflect changes. As shown in the example of FIG. 11, the GUI 1100 can include selectable elements and/or highlightable elements. As an example, an element may be highlighted responsive to a signal that indicates that an activity is currently being performed, is staged, is to be revised, etc. For example, a color coding scheme may be utilized to convey information to a user via the GUI 1100.

As an example, the GUI 1100 can be operatively coupled to one or more systems that can assist and/or control one or more drilling operations. For example, consider the aforementioned automation assisted sliding mode system, which provides amounts of surface torque. As another example, consider a system that generates rate of penetration values, which may be, for example, rate of penetration set points. Such a system may be an automation assisted system and/or a control system. For example, a system may render a GUI that displays one or more generated rate of penetration values and/or a system may issue one or more commands to one or more pieces of equipment to cause operation thereof at a generated rate of penetration. In the example GUI 1100, an entry 1110 corresponds to a drilling run, drill to depth operation, which specifies a distance (e.g., a total interval to be drilled) along with a time estimate. In such an example, the drill to depth operation can be implemented using a guidance system that, for example, provides for a sequence of drilling parameters (e.g., mode, toolface angle, etc.), which may be for pipe-by-pipe, stand-by-stand, etc. (see, e.g., the graphical control 667 of FIG. 6). As an example, a time estimate may be given for the drill to depth operation using manual, automated and/or semi-automated drilling. For example, where a driller enters a sequence of modes, the time estimate may be based on that sequence; whereas, for an automated approach, a sequence can be generated (e.g., an estimated automated sequence, a recommended estimated sequence, etc.) with a corresponding time estimate. In such an approach, a driller may compare the sequences and select one or the other or, for example, generate a hybrid sequence (e.g., part manual and part automated, etc.).

As explained, a mud motor can be a directional drilling tool that can help to deliver a desired directional capability and land a borehole in a production zone. As explained, a directional motor can include various features such as, for example, a power unit, a bent sub, etc. To drill a curved hole, the bend can be pointed to a desired orientation while rotation from the surface rig (e.g., table or top drive) may be stopped such that circulation of mud (e.g., drilling fluid) acts to drive the mud motor to rotate the bit downhole. As mentioned, in some instances, there can be a combination of surface rotation and downhole rotation. In general, where surface rotation is not provided, the drillstring is in a sliding mode as it slides downward as drilling ahead occurs via rotation of the bit via operation of the mud motor. Such an operation can be referred to as a sliding operation (e.g., sliding mode). Another mode can be for holding the borehole direction tangent where surface equipment rotates the drillstring such that the motor bend also rotates with drillstring. In such a mode, the BHA does not have a particular drill-ahead direction. Such an operation can be referred to as a rotating operation (e.g., a rotating mode or rotary mode).

During a directional drilling planning phase, a well trajectory tends to be designed to ensure better reservoir exposure and less collision risk. A given trajectory in a curved section can include one or more arcs with constant curvatures (DLS) and straight holding sections. For a motor-based directional drilling plan, drilling can be improved if it is known a priori (e.g., or during drilling) when to use a particular mode (e.g., and when to switch modes). Additionally, it is desirable to know if a particular BHA is able to deliver a desired DLS. As explained, a method can include utilizing various types of data to determine what sliding and rotating sequence can be utilized to improve drilling efficiency for a particular BHA (or BHAs) to adhere to designed trajectory. As to BHA capabilities, a method can include performing one or more sliding simulations with given motor BHA specifications to check if a corresponding motor sliding DLS capability is higher than that of a desired DLS. Such a method may be performed prior to performing a method that can determine one or more sequences (e.g., mode sequences) for a BHA where such one or more sequences can help to improve an ability to create a desired or desirable borehole trajectory.

For a given motor BHA design, DLS capability adjustability is limited in the sliding operation. To match motor DLS output with a designed trajectory, an operation sequence mixing sliding and rotating can be utilized. However, switching between rotating and sliding tends to be undesirable as it can be time-consuming (e.g., non-productive time (NPT)). For example, switching operational modes can involve stopping equipment of a rig and reorienting a motor bent toolface angle (TFA). Further, switching can compromise borehole quality, for example, by introducing ledges. Therefore, it can be quite helpful to plan a motor operation sequence in a manner whereby a desired or desirable DLS can be achieved, for example, with high drilling efficiency (e.g., limited or reduced NPT).

As an example, a computer-aided workflow can be utilized for planning sliding and rotating distances of a motor in a curve drilling application. Such a workflow can utilize a finite element method (FEM)-based BHA tendency model to predict BHA drill-ahead direction for a given BHA design and drilling parameters. Such an approach can have a relatively fast computation speed that enables reasonably quick turn-around time. For example, a designed curve trajectory can be partitioned into stands (e.g., approximately 90 ft or 30 m in length). In such an example, sequence planning can be conducted within one stand. As an example, a switching limit may be specified on a per stand or number of stands basis (e.g., a per pipe or number of pipes basis). For example, consider a one switching operation per stand limit (e.g., one switching operation per three pipes, etc.). Given such conditions, a workflow can include performing multiple simulations with various sliding/rotating sequences such that an optimal ratio of sliding and rotating distance can be determined.

As an example, a workflow can be utilized prior to and/or during an execution phase (e.g., actual drilling). For example, in an execution phase, a recommended sliding ratio can guide directional drilling by instructing sliding and rotating distance for each stand to achieve a desired or desirable DLS. As an example, offset drilling data can be utilized to calibrate a BHA tendency model for better prediction accuracy. Often, motor toolface variation can be inevitable in sliding operation. As such, sliding ratios can be calculated beforehand based on different levels of toolface variations. As an example, a directional driller (e.g., manual, semi-automated, or automated) may choose an appropriate sliding ratio per real-time measurement of toolface variation. In real-time, the well trajectory may deviate away from a planned well path. In such an example, a trajectory replanning process can be initiated to adjust a deviated borehole. After trajectory replanning, a workflow of motor sliding/rotating sequence can be conducted again to provide an updated sliding ratio recommendation or recommendations. In various examples, real-time drilling data can be used for model calibration to improve the accuracy.

As an example, a method can be implemented that can generate output that may be static and/or dynamic. For example, in a real-time implementation, real-time data may result in updates to output. As an example, output may be represented as control instructions, a graphical user interface, etc. As to a graphical user interface, it may include numeric and/or graphic information as to how a curved portion of a borehole is to be drilled. As an example, a graphical user interface may be presented with a table of values where a driller can select one or more of the values to instruct drilling equipment, which can include, for example, instructing to switch operational mode (e.g., from sliding to rotating or from rotating to sliding). As an example, an override feature may be available, for example, to override one or more values or operations (e.g., switching, etc.). In a real-time approach, output can be updated based on data that can account for one or more overrides and, for example, one or more actual operations.

In various examples, a method can generate a graphic (e.g., a table, etc.) that provides estimated sliding ratio along with sliding and rotating distance for each drilling stand (e.g., or pipe) based on a designed trajectory, optionally updated through surveys, replanning, etc. One or more recommendations can help a driller to decide sliding distance and/or rotating distance for each stand (e.g., or pipe) to achieve a desired or desirable DLS. As mentioned, such recommendations may be in the form of control instructions that can, for example, be implemented manually, semi-automatically and/or automatically.

As an example, a default bit side cutting capability and toolface variation may be obtained from offset drilling data, which may help to provide more accurate predictions As mentioned, in real-time, sliding distance and/or rotating distance may be adjusted based on a system directional response. In such an approach, a driller or controller may deviate from one or more recommendations. In such an example, the deviations may be slight and within some reasonable bound or bounds from a recommendation.

Figure 12:
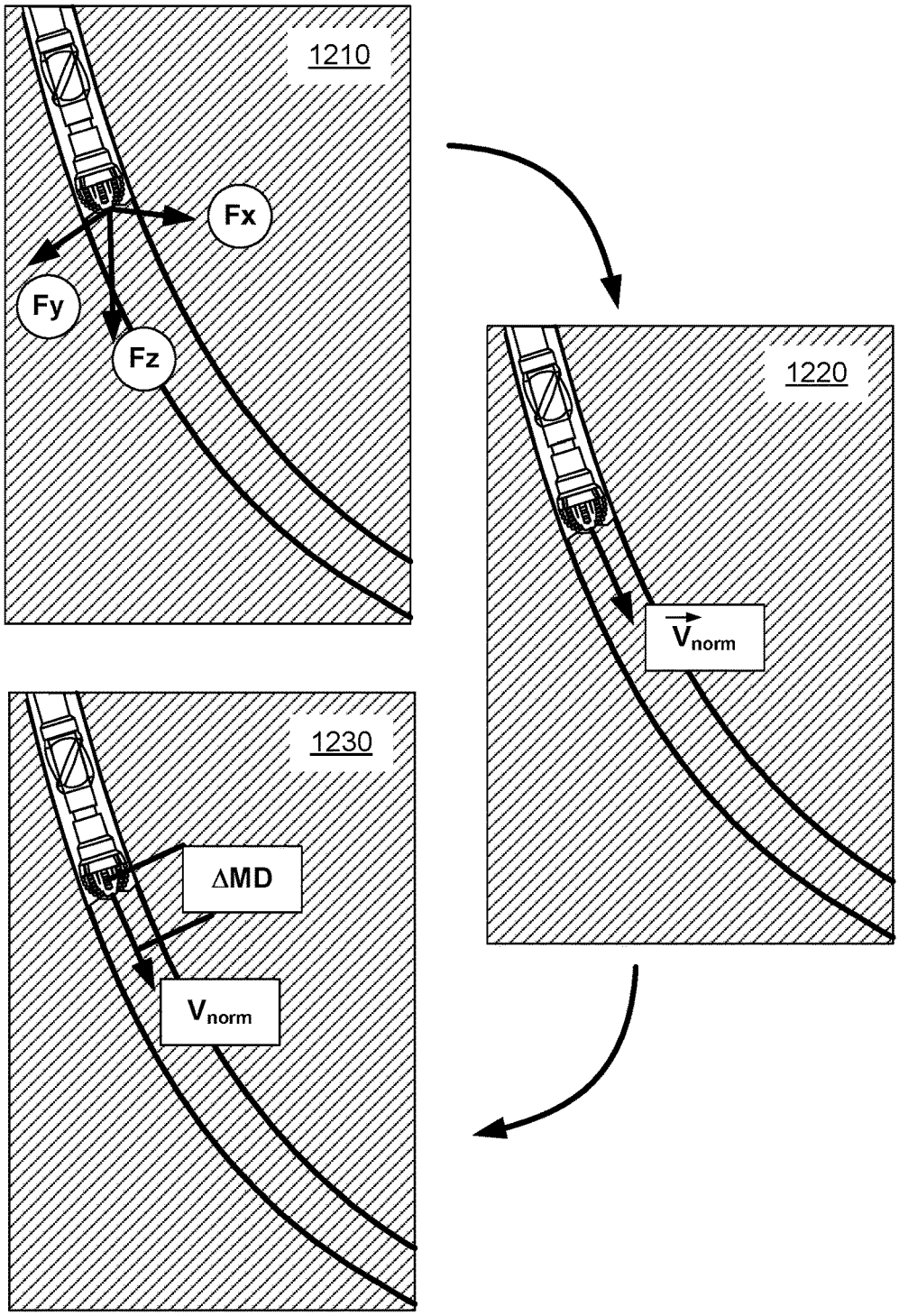
FIG. 12 illustrates an example of a method.

FIG. 12 shows an example of a method 1200 that can output a predicted propagation direction of a drill bit based on forces and bit characteristics. The method 1200 can utilize a computational framework that includes one or more features of a framework such as, for example, the IDEAS framework (Schlumberger Limited, Houston, Tex.). The IDEAS framework utilizes the finite element method (FEM) to model various physical phenomena, which can include reaction force at a bit (e.g., using a static, physics-based model). The FEM utilizes a grid or grids that discretize one or more physical domains. Equations such as, for example, continuity equations, are utilized to represent physical phenomena. The IDEAS framework, as with other types of FEM-based approaches, provides for numerical experimentation that approximates real-physical experimentation. In various instances, a framework can be a simulator that performs simulations to generation simulation results that approximate results that have occurred, are occurring or may occur in the real-world. In the context of drilling, such a framework can provide for execution of scenarios that can be part of a workflow or workflows as to planning, control, etc. As to control, a scenario may be based on data acquired by one or more sensors during one or more well construction operations such as, for example, directional drilling. In such an approach, determinations can be made using scenario result(s) that can directly and/or indirectly control one or more aspects of directional drilling. For example, consider control of a sliding/rotating drilling mode sequence and determination of a ratio of sliding distance in directional drilling.

As an example, for a bent motor, a "rotating mode" (or rotary mode) can be defined as surface_RPM>0 and motor RPM>0 (e.g., flow of drilling fluid driving a mud motor) and a "sliding mode" can be defined as surface_RPM=0 and motor RPM>0 (e.g., flow of drilling fluid driving a mud motor).

As an example, a workflow can include determining a sliding and/or rotating sequence for a pipe, which may be a single pipe or multiple pipes where multiple pipes can be connected to form a stand. In such an example, the workflow can utilize modeling as to tendency such as, for example, bottom hole assembly (BHA) tendency. Using tendency modeling results, a determination can be made as to one or more drilling modes for lengthening a borehole by a distance that corresponds approximately to that a pipe or a stand that is added at surface (e.g., at a rig).

As an example, a workflow can output one or more optimal sequences for directional drilling. For example, such a workflow can provide a sliding and rotating sequence plan for motor drilling based on BHA tendency modeling.

As explained, directional drilling can be utilized to make a curved section of a borehole trajectory. Such an approach can include specifying a curve that can be between a kickoff point and a landing point. Where the curved section is to be drilled, a sequence can be provided for each pipe or each stand where the sequence is based at least in part on a physics-based model that can account for BHA tendency. Such an approach can include performing one or more simulations. Using such simulations, output may be generated as to one or more drilling conditions, which can be for one or more drilling modes. For example, consider output as to conditions such as starting, rotating, sliding, rotating/sliding ratio, distance, etc. As an example, distance may be part of a directional trajectory that can be compared with a planned or current trajectory. In such an example, drilling may be performed using a selected set of parameters that correspond to conditions that provide for a trajectory that most closely matches a desired trajectory, which may be a planned trajectory or other desired trajectory.

Referring again to FIG. 12, the method 1200 commences in a force determination block 1210 for determining forces on a bit, which are utilized in a vector determination block 1220 for determining a vector as to how a drill bit of a BHA may be expected to move in a formation during drilling (e.g., according to one or more drilling modes). In the block 1230, a sufficiently small drilling distance (e.g., hole propagation length, which may be AMD) is added to the bore along the direction of the vector determined by the drilling directional determination block 1220. The process can be repeated until the specified total drilling distance (e.g., pipe length, stand length, etc.) is completed. Such a method can allow for a comparison between the determined position and a desired or desirable position, which may correspond to, for example, a position of a planned trajectory.

Figure 13:
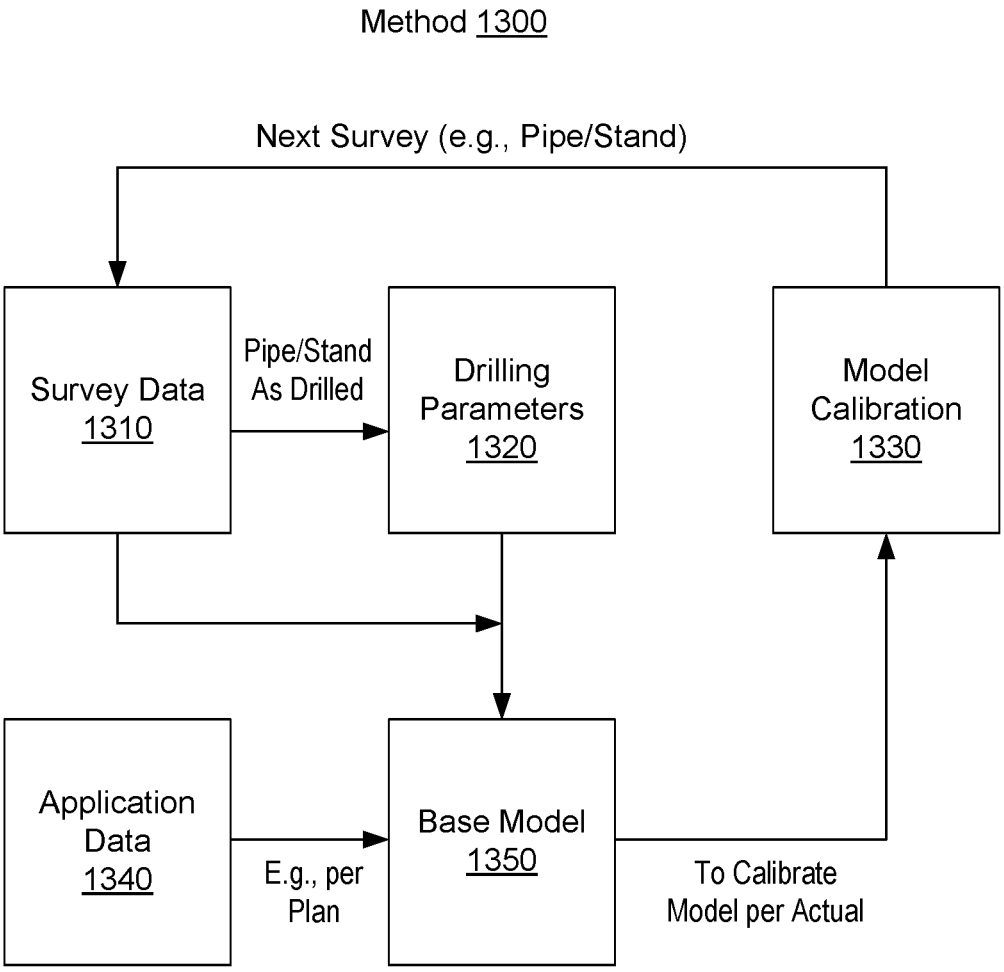
FIG. 13 illustrates an example of a method.

FIG. 13 shows an example of a method 1300 that can provide for model validation with offset well data, which can be data from one or more offset wells that have been constructed and/or that are under construction.

In the example of FIG. 13, the model parameters (e.g., bit side cutting capability, hole enlargement, and toolface (TF) variation) can be validated with offset directional drilling data.

In a survey data block 1310, survey data can be acquired, which can be through operation of one or more types of tools that can be utilized to perform downhole surveys (e.g., or downhole and/or uphole surveys using downhole and/or uphole equipment). The survey data per the survey data block 1310 can be utilized to determine actual drilling parameters as indicated by the drilling parameters block 1320. As shown, the survey data and the drilling parameters, along with application data per an application data block 1340, can be utilized by a base model block 1350 to generate information that is output to a model calibration block 1330 for calibrating a model, which may be referred to as a calibrated model or an updated model (e.g., or an updated, calibrated model, etc.). An arrow is illustrated in the method 1300 that connects the model calibration block 1330 and the survey data block 1310, which represents utilization of a calibrated model for drilling (e.g., simulated and/or actual) to reach a next survey point, which results in acquisition of additional survey data. Thus, the method 1300 includes a loop, which can be iterative on a pipe by pipe, stand by stand, and/or a hybrid basis.

As to the application data block 1340, consider data as to equipment such as BHA equipment and/or data as to well design such as diameters, casings, cement, open hole, etc. (e.g., completions, etc.). In such examples, data may be specified with respect to length. For example, consider lengths of equipment that make up a BHA, lengths of sections of a well (e.g., diameter by length, casing by length, etc.). Such data may be utilized by the base model block 1350 to generate a base model, which can be updated using at least a portion of survey data and at least one actual drilling parameter. As an example, the method 1300 can include generating a base model per the base model block 1350 using application data per the application data block 1340 prior to receipt of survey data and/or one or more actual drilling parameters. As an example, where a drillstring is or is to be tripped out of a borehole, for example, to modify the drillstring (e.g., change one or more aspects of a BHA, etc.), the base model block 1350 may be utilized to generate a new base model.

In the example of FIG. 13, actual drilling can occur utilizing a drillstring that corresponds to data of the application data block 1340. As an example, such drilling may occur according to a plan that is to construct a well according to data of the application data block 1340. In a scenario where a change is to be made to a drillstring and/or a plan, the application data block 1340 can be updated and data thereof utilized by the base model block 1350 to generate a new base model, as appropriate.

Figure 14:
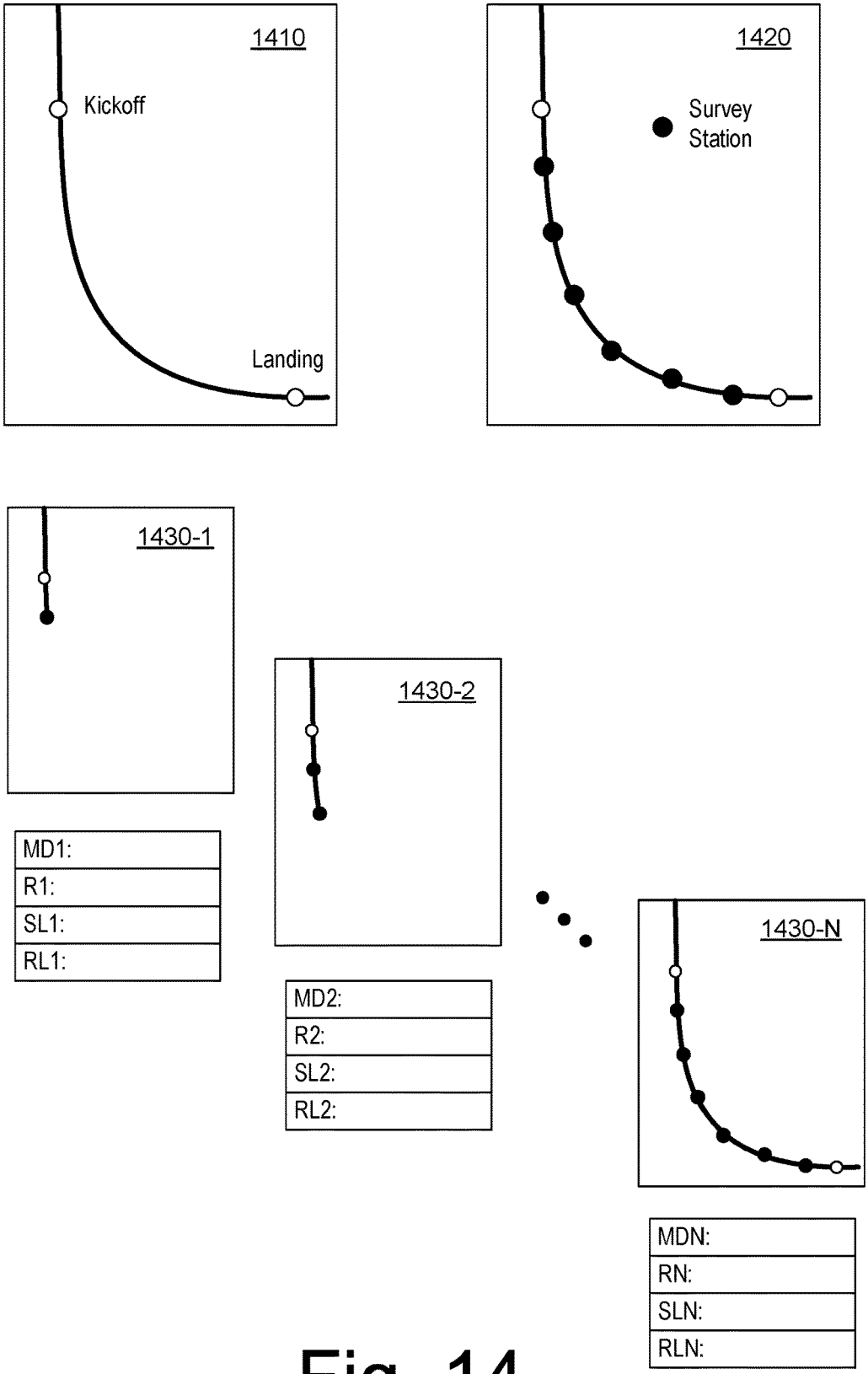
FIG. 14 illustrates an example of a method.

FIG. 14 shows an example of a method 1400 that includes a plan block 1410 for planning at least a portion of a trajectory between a kickoff point and a landing point, a survey block 1420 for identifying survey stations along the planned trajectory, where the survey stations can correspond to pipe intervals, stand intervals, etc. As an example, a survey interpolation technique can be utilized to interpolate positions at appropriate intervals (see, e.g., FIG. 36).

As shown, the method 1400 includes a series of blocks 1430-1, 1430-2, to 1430-N that correspond to a series of 1 to N pipes and/or stands where outputs can include measured depth (MD), ratio of rotating to sliding (e.g., or sliding to rotating) (R), a sliding length (SL) and a rotating length (RL). The blocks 1430-1, 1430-2, to 1430-N include using a model (e.g., or models), a calibrated model (e.g., or calibrated models), etc., where simulations can be performed for individual intervals to generate one or more outputs (e.g., one or more of MD, R, SL, RL, etc.).

Figure 15:
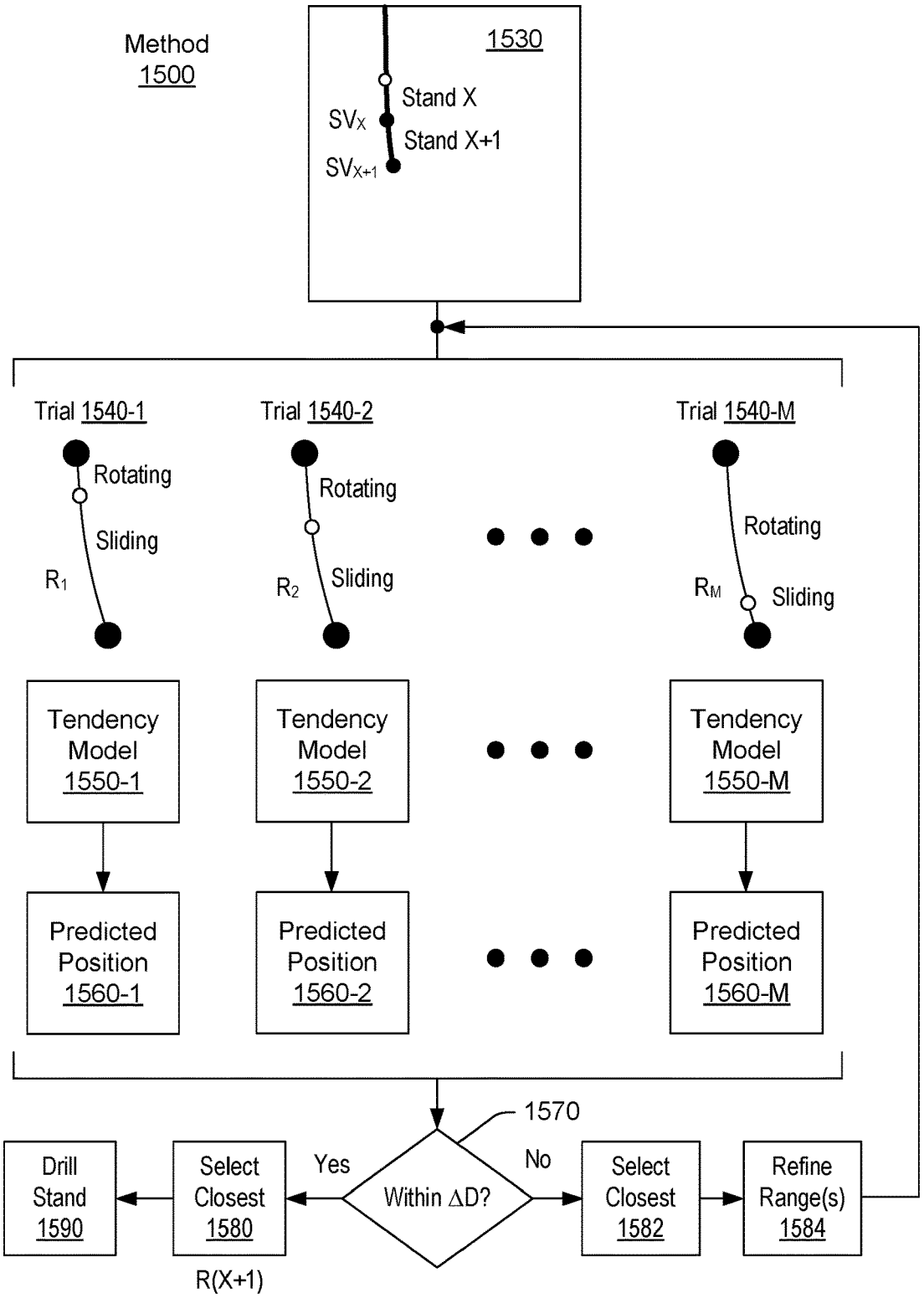
FIG. 15 illustrates an example of a method.

FIG. 15 shows an example of a method 1500 that includes determining one or more mode sequences where mode sequences can be sequences that include one or more modes such as, for example, one or more of sliding mode and rotating mode.

As shown, the method 1500 includes an increment block 1530 that corresponds to an interval from stand X to stand X+1, noting that such an interval may be for a pipe. As shown, survey data (SV) exist for positions associated with stands X and X+1.

The method 1500 includes various trials, which can be simulation scenarios, 1540-1, 1540-2, to 1540-M, where a result (e.g., or results) of each of the trials is utilized by a corresponding tendency model block 1550-1, 1550-2, to 1550-M. The output of each of the tendency model blocks 1550-1, 1550-2, to 1550-M, is utilized by a corresponding prediction block 1560-1, 1560-2, to 1550-M, to predict a corresponding position (e.g., P1, P2, to PM).

As shown, the method 1500 can include a decision block 1570 that can decide if one or more of the positions is within a distance (e.g., Δd) of a planned, desired or desirable trajectory. As shown, where the decision block 1570 decides affirmatively, the method 1500 can proceed to a selection block 1580 to select a closest position of the predicted positions, which can be utilized, for example, by a drilling block 1590 to drill a borehole a depth to that position using a stand (e.g., a pipe, pipes, etc.). As shown, the selection block 1580 can act to select a position of one of the trials 1540-1, 1540-2, to 1540-M, which can have a corresponding ratio (e.g., R) and/or specified sliding length and/or rotating length. Such information can be control information that can be utilized to control a directional drilling operation.

As shown in the example of FIG. 15, where the decision block 1570 decides negatively, the method 1500 can proceed to a selection block 1582 that selects a closest position of the predicted positions that can be utilized, for example, by a refinement block 1584 for refining a range of additional trials, which may be performed such that a loop exists that aims to find an acceptable result for use in subsequent drilling.

Figure 16:
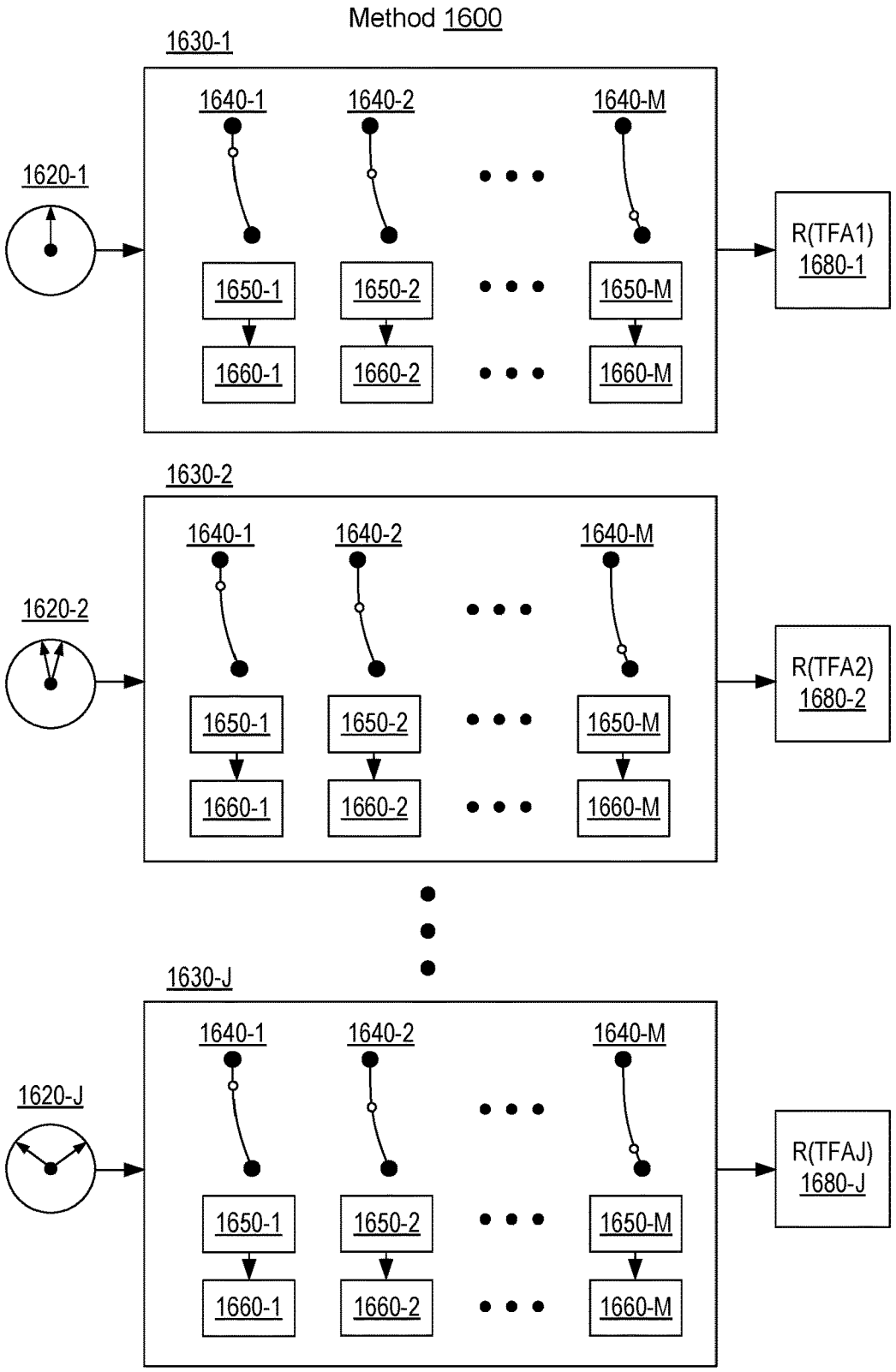
FIG. 16 illustrates an example of a method.

FIG. 16 shows an example of a method 1600 that can account for toolface angle (TFA), which can be an acceptable or expected amount of toolface variation. As shown, the TFA trials include 1620-1, 1620-2, to 1620-J where the number of trials are from 1 to J. As shown, various mode trials 1630-1, 1630-2, to 1630-J, each for trials 1640-1, 1640-2, to 1640-M, tendency models 1650-1, 1650-2, to 1650-M, for predicted borehole angles 1660-1, 1660-2, to 1660-M, can be output where, for example, each of the tendency models 1650-1, 1650-2, to 1650-M may be customized according to the corresponding TFA 1620-1, 1620-2, to 1620-J. As shown, the method 1600 can provide for outputs 1680-1, 1680-2, to 1680-J, which may be selected in a manner akin to that explained with respect to the method 1500 of FIG. 15. In turn, one of the outputs 1680-1, 1680-2, to 1680-J can be selected, for example, for use in drilling. In such an example, the selection may be based on assessing predicted position with a desired or desirable position (e.g., planned or otherwise) and/or assessing a predicted borehole angle with a desired or desirable borehole angle (e.g., planned or otherwise). As shown, the trial 1620-1 is a toolface variation of zero degrees, which may result in drilling in a manner that is based on no toolface variation.

FIG. 17 shows two example methods 1710 and 1730 that may be utilized for toolface computations. For example, the method 1710 can utilize a sinusoidal approach of toolface variation in amplitude according to a period. As shown, a toolface angle in degrees (e.g., toolface amplitude in degrees), can be denoted as TFA and appropriately computed using a sine function. As to the method 1730, it shows use of a random function. In the examples of FIG. 17, the amplitude shown for the methods 1710 and 1730 can be plus-and-minus or other, where, for example, a bias exists (e.g., due to direction of rotation, type of formation, etc.).

FIG. 18 shows an example of a graphical user interface 1800 that includes various fields for various types of data. As shown, the data can be specified with respect to depth and include data for weight-on-bit (WOB), table RPM (e.g., or top drive RPM, etc.), ROP, TOB, step, bent TFA, fixed TFA, PDM "on", PDM "off", flow rate, bit side cutting coefficient.

As an example, a sliding stage step size can be of the order of approximately a few centimeters (e.g., approximately 0.1 foot) in the presence of TFA variation.

As explained with respect to FIG. 13, the model parameters (e.g., bit side cutting capability, hole enlargement, and toolface (TF) variation) can be validated with offset directional drilling data.

Figure 19:
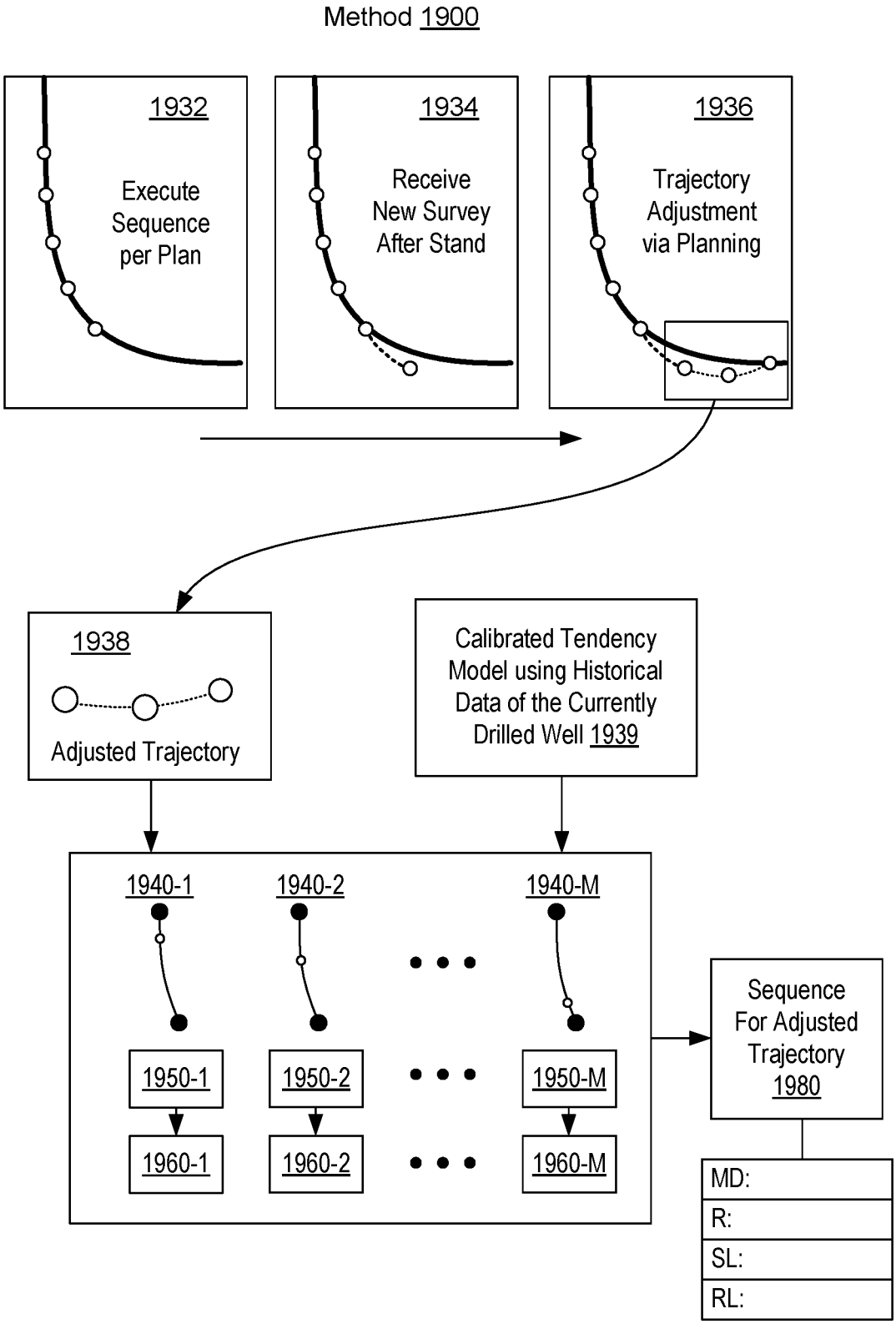
FIG. 19 illustrates an example of a method.

FIG. 19 shows an example of a method 1900 that includes an execution block 1932 for executing a sequence per a plan, a reception block 1934 for receiving a new survey after drilling a stand (e.g., or pipe) where the survey provides survey data sufficient to estimate a position, and an adjustment block 1936 for adjusting a trajectory via a planning process. For example, the method 1900 can include providing an adjusted trajectory 1938 and a calibrated tendency model as may be calibrated using historical data of the borehole currently being drilled 1939 where such data and model are utilized to run trials 1940-1, 1940-2, to 1940-M, using tendency models 1950-1, 1950-2, to 1950-M, to generate predicted positions 1960-1, 1960-2, to 1960-M. As shown, the method 1900 can include an output block 1980 for outputting a sequence for the adjusted trajectory 1938, which may be a closest matching trajectory as predicted per the trials (e.g., a selected closest predicted position, etc.). As an example, the output of the output block 1980 can be utilized to control drilling according to one or more modes.

Figure 20:
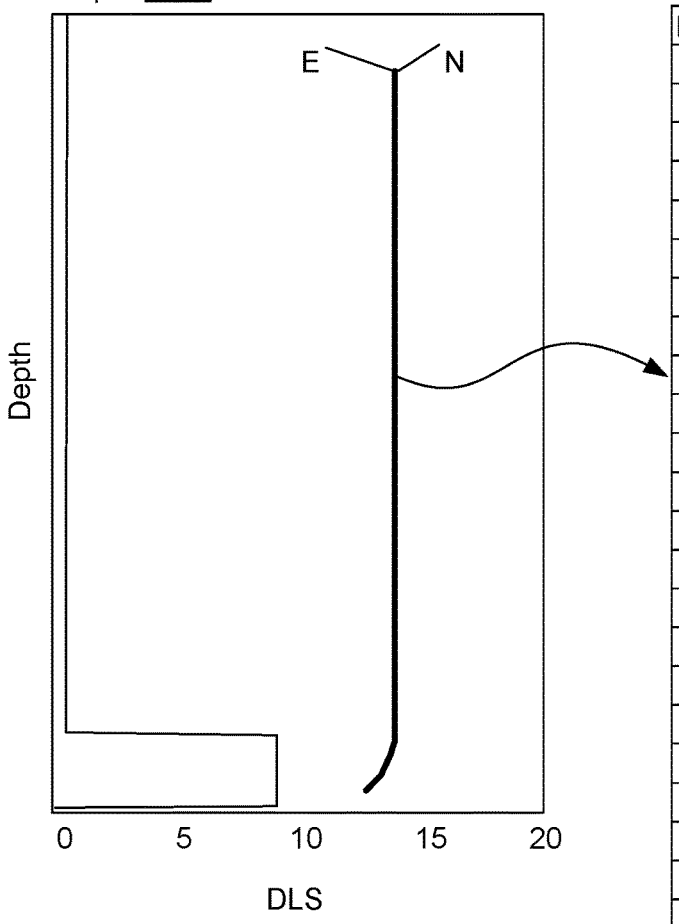
FIG. 20 illustrates an example of a method.
Figure 23:
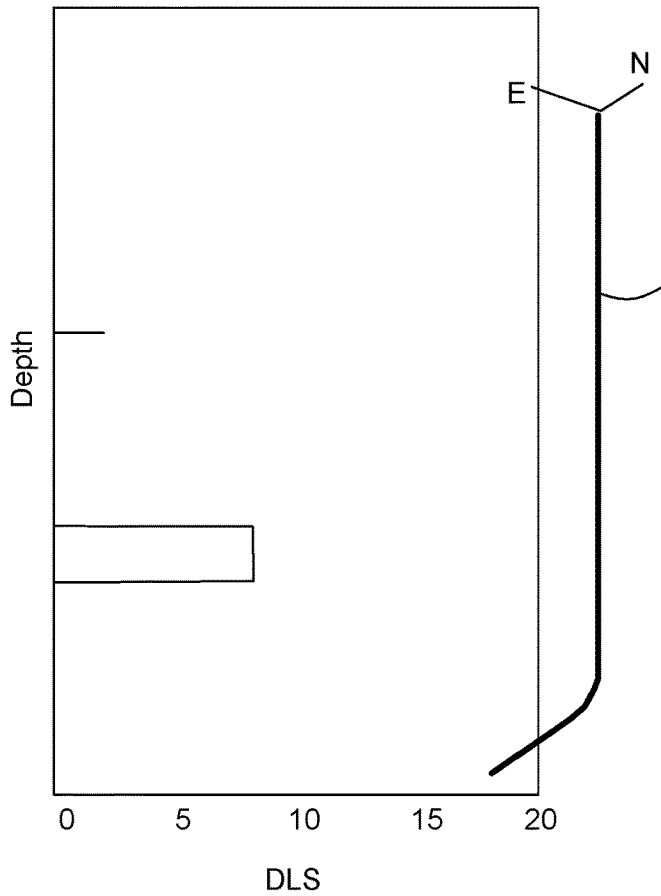
FIG. 23 illustrates an example of a method.
Figure 26:
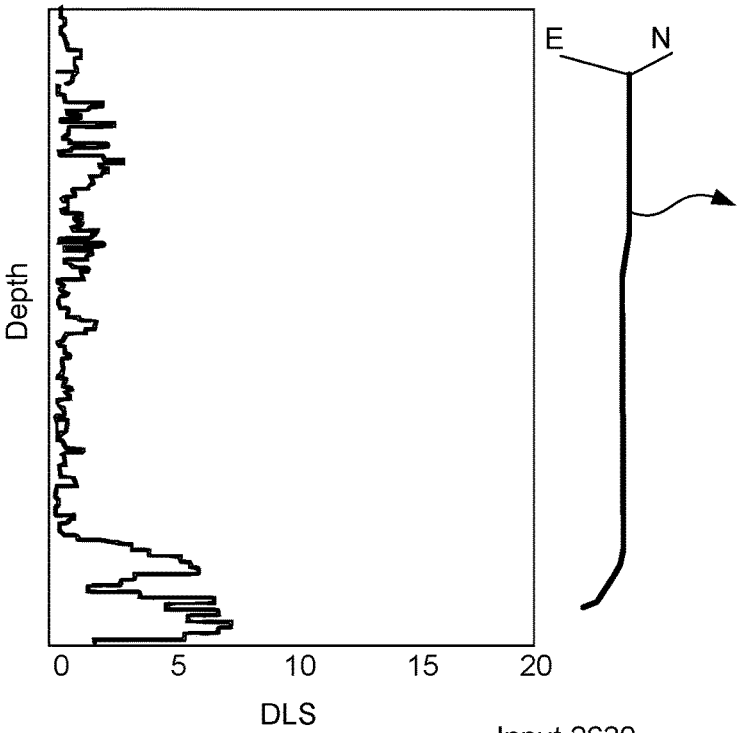
FIG. 26 illustrates an example of a method.

FIGS. 20, 21 and 22 correspond to a first example; FIGS. 23, 24 and 25 correspond to a second example; FIGS. 26, 27 and 28 correspond to a third example; and FIGS. 29, 30, 31, 32, 33 and 34 correspond to a fourth example.

FIG. 20 shows an example of a method 2000 that includes input blocks 2010, 2020 and 2030 for inputting depth versus DLS data, measured depth, inclination, azimuth and diameter data, and component data, respectively. As shown, the depth versus DLS data corresponds to a planned trajectory with a curved portion that can be drilled via directional drilling.

FIG. 21 shows an additional input block 2100 for the method 2000 that includes drilling parameters, which may be utilized for purposes of simulating scenarios, for example, in combination with various inputs of one or more of the input blocks 2010, 2020 and 2030.

FIG. 22 shows an example of a graphical user interface 2200 for drilling instructions for a number of stands to be drilled where the instructions include instructions for one or more toolface variations (e.g., 0 degrees, 30 degrees or 60 degrees). As shown, the ratio of modes can differ, which can be utilized as a schedule or schedules during drilling to improve drilling, for example, to improve an ability to follow a planned trajectory or other desired or desirable trajectory to drill a borehole to or towards a particular target (e.g., landing point, etc.).

FIG. 23 shows an example of a method 2300 that includes input blocks 2310, 2320 and 2330 for inputting depth versus DLS data, measured depth, inclination, azimuth and diameter data, and component data, respectively. As shown, the depth versus DLS data corresponds to a planned trajectory with a curved portion that can be drilled via directional drilling.

FIG. 24 shows an additional input block 2400 for the method 2300 that includes drilling parameters, which may be utilized for purposes of simulating scenarios, for example, in combination with various inputs of one or more of the input blocks 2310, 2320 and 2330.

FIG. 25 shows an example of a graphical user interface 2500 for drilling instructions for a number of stands to be drilled where the instructions include instructions for one or more toolface variations (e.g., 0 degrees, 30 degrees or 60 degrees). As shown, the ratio of modes can differ, which can be utilized as a schedule or schedules during drilling to improve drilling, for example, to improve an ability to follow a planned trajectory or other desired or desirable trajectory to drill a borehole to or towards a particular target (e.g., landing point, etc.).

FIG. 26 shows an example of a method 2600 that includes input blocks 2610, 2620 and 2630 for inputting depth versus DLS data, measured depth, inclination, azimuth and diameter data, and component data, respectively. As shown, the depth versus DLS data corresponds to a planned trajectory with a curved portion that can be drilled via directional drilling.

FIG. 27 shows an additional input block 2700 for the method 2600 that includes drilling parameters, which may be utilized for purposes of simulating scenarios, for example, in combination with various inputs of one or more of the input blocks 2610, 2620 and 2630.

FIG. 28 shows an example of a graphical user interface 2800 for drilling instructions for a number of stands to be drilled where the instructions include instructions for one or more toolface variations (e.g., 0 degrees, 30 degrees or 60 degrees). As shown, the ratio of modes can differ, which can be utilized as a schedule or schedules during drilling to improve drilling, for example, to improve an ability to follow a planned trajectory or other desired or desirable trajectory to drill a borehole to or towards a particular target (e.g., landing point, etc.).

Figure 29:
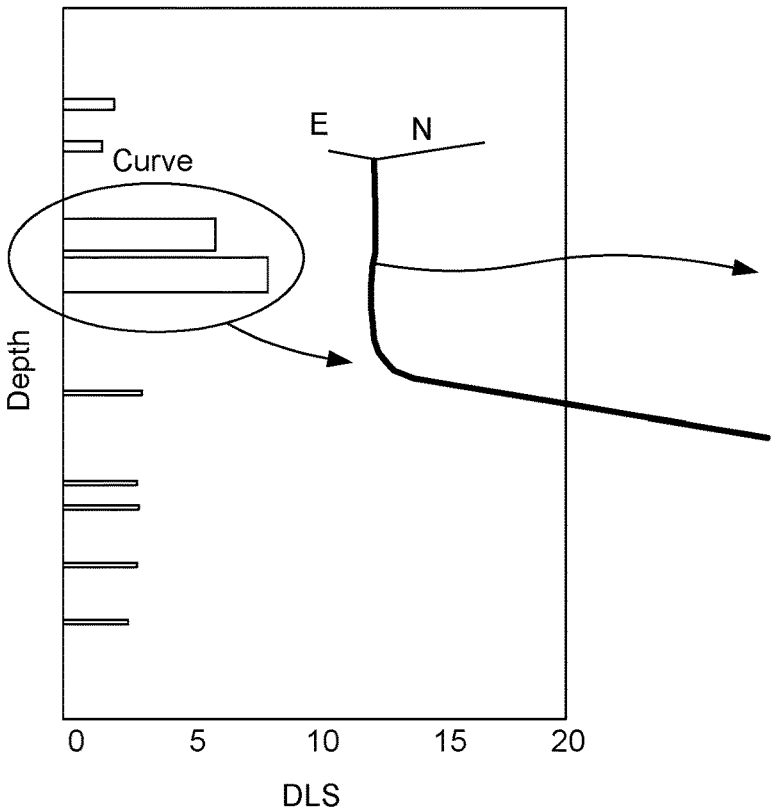
FIG. 29 illustrates an example of a method.

FIG. 29 shows an example of a method 2900 that includes input blocks 2910, 2920 and 2930 for inputting depth versus DLS data, measured depth, inclination, azimuth and diameter data, and component data, respectively. As shown, the depth versus DLS data corresponds to a planned trajectory with a curved portion that can be drilled via directional drilling.

Figure 30:
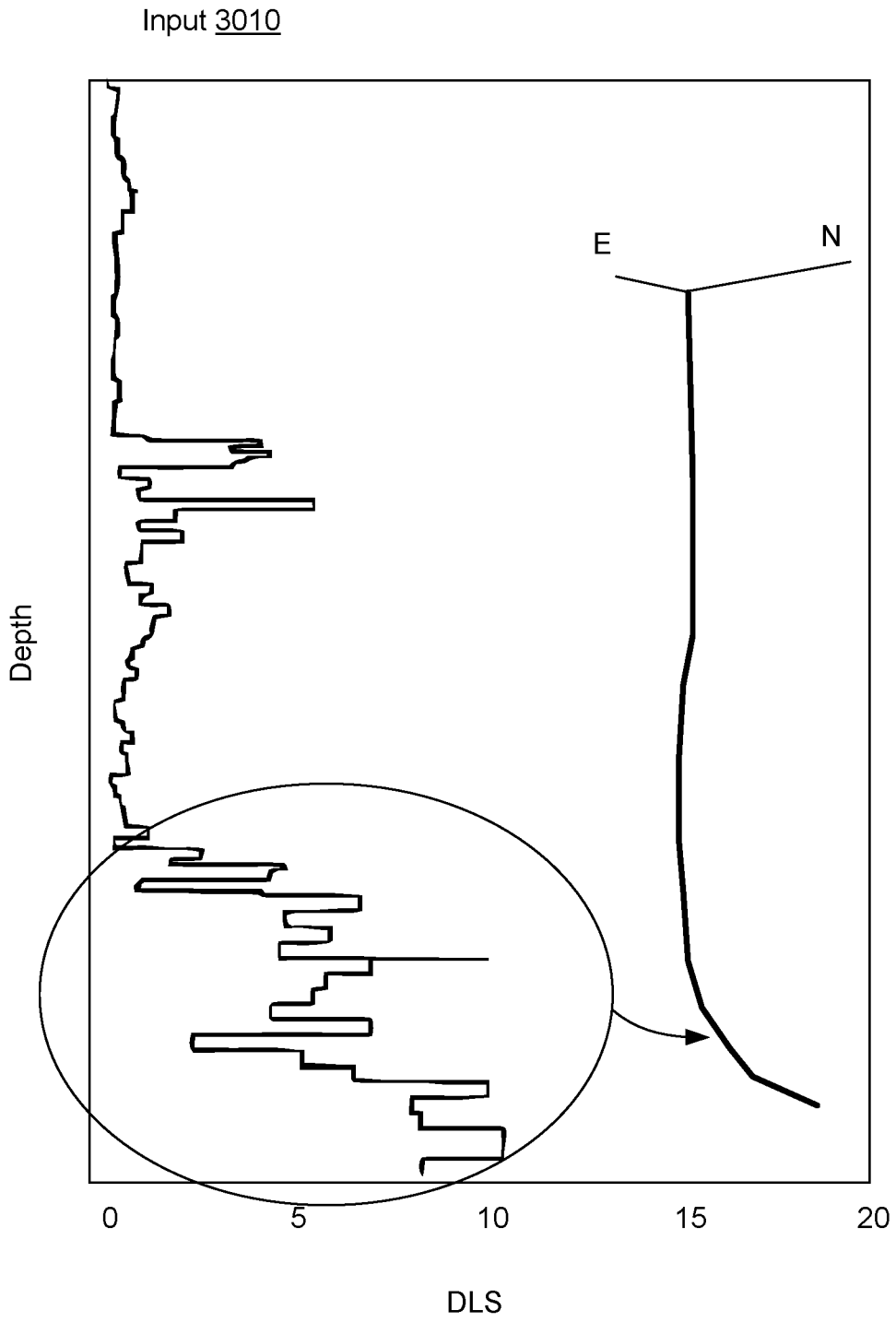
FIG. 30 illustrates examples of inputs.

FIG. 30 shows actual depth versus DLS data as interpolated from actual survey data for a portion of the trajectory illustrated in FIG. 29.

FIG. 31 shows an additional input block 3100 for the method 2900 that includes drilling parameters, which may be utilized for purposes of simulating scenarios, for example, in combination with various inputs of one or more of the input blocks 2910, 2920 and 2930.

FIG. 32 shows an example of a graphical user interface 3200 for drilling instructions for a number of stands to be drilled where the instructions include instructions for one or more toolface variations (e.g., 0 degrees, 30 degrees or 60 degrees). As shown, the ratio of modes can differ, which can be utilized as a schedule or schedules during drilling to improve drilling, for example, to improve an ability to follow a planned trajectory or other desired or desirable trajectory to drill a borehole to or towards a particular target (e.g., landing point, etc.).

FIG. 33 shows an example of a graphical user interface 3300 for drilling instructions as a sliding planning report using data interpolated from the actual surveys as illustrated in FIG. 30.

FIG. 34 shows an example of a graphical user interface 3400 that corresponds to the example of FIGS. 29, 30, 31, 32 and 33. In particular, the GUIs 3400 and 3500 show comparisons of toolface variation patterns where the patterns included: sinusoidal (period=1 ft); sinusoidal (period=2 ft); and random variation. Such approaches are described with respect to FIG. 17 where the method 1710 is for sinusoidal and the method 1730 is for random.

FIG. 35 shows an example of a method 3500 for DLS and toolface angle computations associated with a circular arc, as part of a trajectory. The method 3500 can include defining survey stations (see, e.g., survey stations 1 and 2) and an arc therebetween, which can correspond to a distance such as DMD. As shown, the toolface angle can change over the course of the trajectory as can be computed using an equation for the angle a, shows as being between two vectors. As indicated, DLS depends on a and DMD.

FIG. 36 shows an example of a method 3600 that provides for survey interpolation based on radius of curvature. As shown, inclination and azimuth angles can be utilized at two adjacent survey stations along with measured depths of the survey stations to determine one or more intermediate depths, interpolated angles, etc.

As explained, conditions can determine the ability of a BHA to deliver a tendency to drill a trajectory as per a specified dogleg severity (DLS). As an example, a BHA may be characterized, as a steering system, with respect to tendency (e.g., directional tendency, build tendency, walk tendency, dropping tendency, a tendency to drill straight ahead, a tendency to drift laterally, a tendency to stay on a current path, etc.). A BHA may have a natural tendency to maintain or return to a straight form (e.g., linear along a longitudinal axis of the BHA).

As an example, a graphical user interface (GUI) may provide information concerning steering tendency of a BHA or BHAs. Such information can indicate whether a BHA has a specified DLS capability. If not, the GUI may render one or more suggestions that can be taken such as, for example, increase bend (e.g., bendability) of a BHA, adjust stabilizer position (e.g., if adjustable), etc. As an example, various details can be rendered such as 100 percent steering DLS, a toolface analysis, a trajectory DLS, an analysis depth, etc. As an example, one or more graphics may provide for steering tendency (e.g., 10.27 degrees per 100 ft) and/or neutral tendency (e.g., 2.12 degrees per 100 ft). Such information can alert a planner and/or a driller as to one or more issues and optionally one or more possible remedies to a tendency issue.

To predict the directional tendency of a BHA, a finite element method (FEM) based simulation system can be established to accurately calculate the actual BHA drilling behaviors. Such a FEM approach can be capable of modeling each drillstring component from the top drive (or rotary table) to the drill bit, taking into account the drillstring contact and cutting structures (e.g., bit, reamer, etc.) interactions with a formation.

Figure 37:
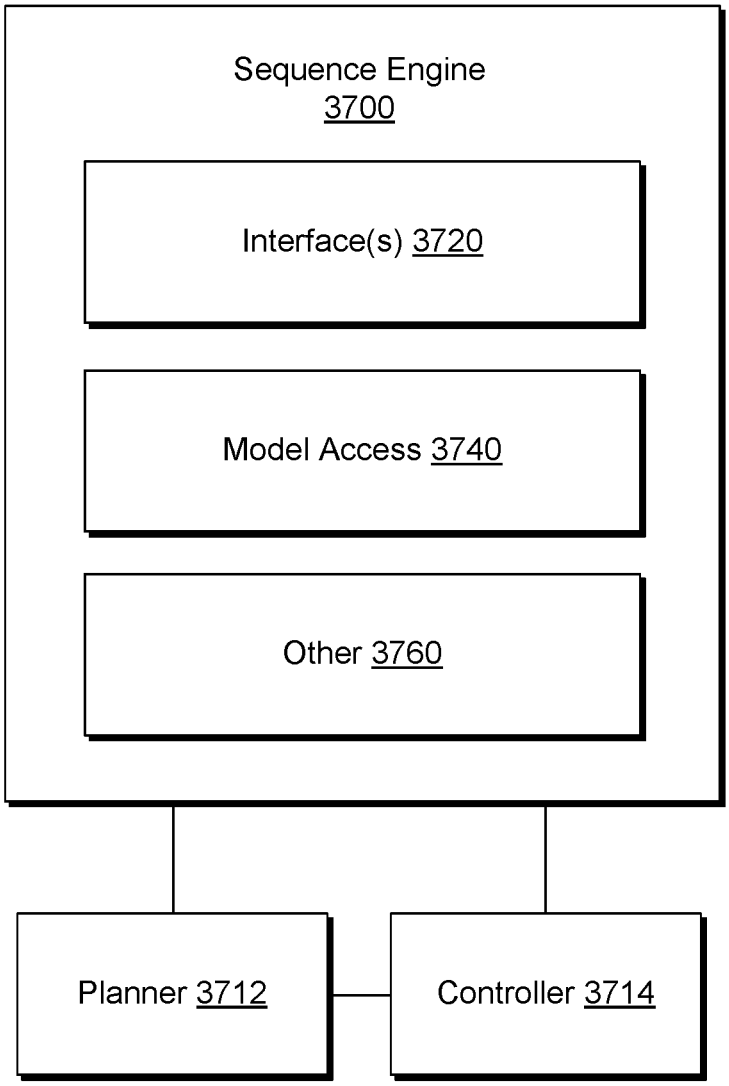
FIG. 37 illustrates an example of a sequence engine.

FIG. 37 shows an example of a sequence engine 3700 that can include one or more interfaces 3720, a model access component 3740 and one or more other components 3760. As shown, the sequence engine 3700 can be operatively coupled to a planning component or system 3712 and/or a control component or system 3714. As an example, the one or more interfaces 3720 can be or include one or more application programming interfaces (APIs) where one or more calls may be made such that the sequence engine 3700 performs some action, which may be for purposes of planning and/or control. As an example, a call may come from one or more of the planning component or system 3712 and the control component or system 3714. As an example, a driller may utilize a computing device to make a call, which may return sequence information as to a mode or modes (e.g., sliding mode, rotating mode, etc.). As mentioned, for a bent motor, "rotating mode" (or rotary mode) can be defined as surface_RPM>0 and motor RPM>0 and "sliding mode" can be defined as surface_RPM=0 and motor RPM>0.

As an example, a framework can utilize a Representational State Transfer (REST) API, which is of a style that defines a set of constraints to be used for creating web services. Web services that conform to the REST architectural style, termed RESTful web services, provide interoperability between computer systems on the Internet. One or more other kinds of web services may be utilized (e.g., such as SOAP web services) that may expose their own sets of operations.

FIG. 38 shows an example of a method 3800 and an example of a system 3890. As shown, the method 3800 can include a reception block 3810 for receiving data for a borehole trajectory in a formation, a length of pipe, and a bottom hole assembly that includes a mud motor and a bit; a generation block 3820 for generating a sequence for operation of the mud motor using a model of at least the bit, where the sequence includes a sliding mode and a rotary mode for drilling the borehole in the formation a distance less than or equal to the length of pipe; and a drilling block 3830 for drilling the borehole according to the sequence.

The method 3800 is shown as including various computer-readable storage medium (CRM) blocks 3811, 3821 and 3831 that can include processor-executable instructions that can instruct a computing system, which can be a control system, to perform one or more of the actions described with respect to the method 3800.

In the example of FIG. 38, a system 3890 includes one or more information storage devices 3891, one or more computers 3892, one or more networks 3895 and instructions 3896. As to the one or more computers 3892, each computer may include one or more processors (e.g., or processing cores) 3893 and memory 3894 for storing the instructions 3896, for example, executable by at least one of the one or more processors 3893 (see, e.g., the blocks 3811, 3821 and 3831). As an example, a computer may include one or more network interfaces (e.g., wired or wireless), one or more graphics cards, a display interface (e.g., wired or wireless), etc.

As an example, the method 3800 may be a workflow that can be implemented using one or more frameworks that may be within a framework environment. As an example, the system 3890 can include local and/or remote resources. For example, consider a browser application executing on a client device as being a local resource with respect to a user of the browser application and a cloud-based computing device as being a remote resources with respect to the user. In such an example, the user may interact with the client device via the browser application where information is transmitted to the cloud-based computing device (or devices) and where information may be received in response and rendered to a display operatively coupled to the client device (e.g., via services, APIs, etc.).

Figure 39:
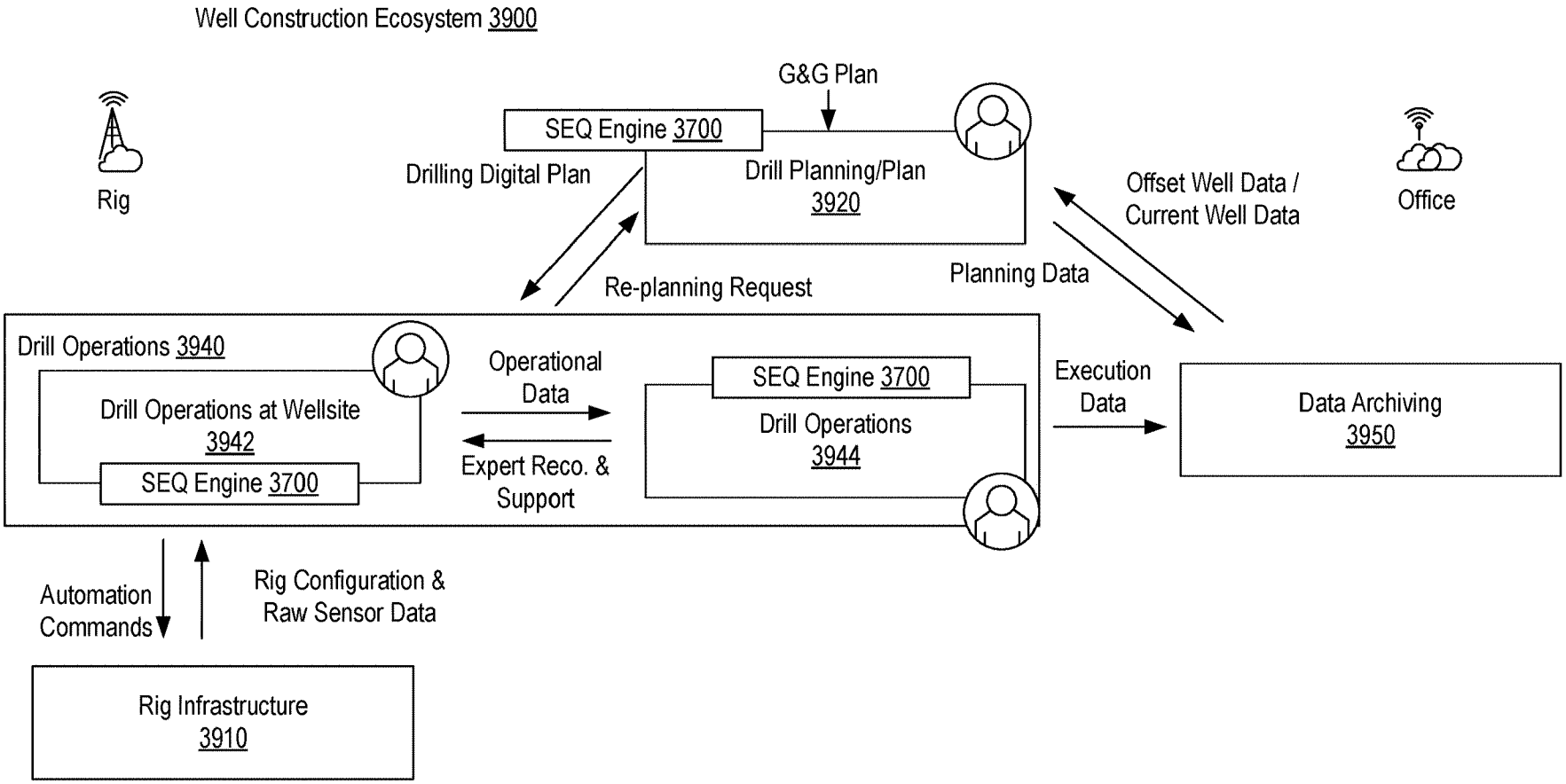
FIG. 39 illustrates an example of a well construction ecosystem that includes one or more sequence engines.

FIG. 39 shows an example of a system 3900 that can be a well construction ecosystem. As shown, the system 3900 can include one or more instances of the sequence engine 3700 (SEQ Engine) and can include a rig infrastructure 3910 and a drill plan component 3920 that can generation or otherwise transmit information associated with a plan to be executed utilizing the rig infrastructure 3910, for example, via a drilling operations layer 3940, which includes a wellsite component 3942 and an offsite component 3944. As shown, data acquired and/or generated by the drilling operations layer 3940 can be transmitted to a data archiving component 3950, which may be utilized, for example, for purposes of planning one or more operations (e.g., per the drilling plan component 3920).

In the example of FIG. 39, the sequence engine 3700 is shown as being implemented with respect to the drill plan component 3920, the wellsite component 3942 and/or the offsite component 3944.

As an example, the sequence engine 3700 can interact with one or more of the components in the system 3900. As shown, the sequence engine 3700 can be utilized in conjunction with the drill plan component 3920. In such an example, data accessed from the data archiving component 3950 may be utilized to assess output of the sequence engine 3700 or, for example, may be utilized as input to the sequence engine 3700. As an example, the data archiving component 3950 can include drilling data for one or more offset wells and/or one or more current wells pertaining to specifications for and/or operations of one or more types of bits, one or more types of mud motors, etc. As an example, data may be utilized in combination with a framework such as, for example, the IDEAS framework.

As shown in FIG. 39, various components of the drilling operations layer 3940 may utilize the sequence engine 3700 and/or a drilling digital plan as output by the drill plan component 3920. During drilling, execution data can be acquired, which may be utilized by the sequence engine 3700, for example, to update one or more sequences. Such execution data can be archived in the data archiving component 3950, which may be archived during one or more drill operations and may be available by the drill plan component 3920, for example, for re-planning, etc.

As explained, drilling can increase the depth of a bore. As an example, during non-drilling (e.g., a non-drilling state), flow rate of fluid being pumped into a drillstring may increase and/or decrease, rate of rotation of a drillstring may increase and/or decrease, a drill bit may move upwards and/or downwards, or a combination thereof. A non-drilling activity may be or include a time when a drill bit is idle (e.g., not drilling) and a slips assembly is not engaged with a drillstring.

As an example, pre-connection can refer to a state where a drill bit has completed drilling operations for a current section of pipe, etc., but the slips assembly has not begun to move (e.g., radially-inward) into engagement with the drillstring. During pre-connection, the flow rate of fluid being pumped into the drillstring may increase and/or decrease, the rate of rotation of the drillstring may increase and/or decrease, the drill bit may move upwards and/or downwards, or a combination thereof.

As an example, connection can refer to a state where a slips assembly is engaged with, and supports, a drillstring (e.g., the drillstring is "in-slips"). When a connection is occurring, a segment (e.g., a pipe, a stand, etc.) may be added to the drillstring to increase the length of the drillstring, or a segment may be removed from the drillstring to reduce the length of the drillstring.

As an example, post-connection can refer to a state where the drillstring is released by a slips assembly and the drillstring with a drill bit is lowered to be on-bottom (e.g., bottom of hole or BOH). During post-connection, the flow rate of fluid being pumped into a drillstring may increase and/or decrease, the rate of rotation of a drillstring may increase and/or decrease, the drill bit may move upwards and/or downwards, or a combination thereof.

As an example, a method can include receiving data for a borehole trajectory in a formation, a length of pipe, and a bottom hole assembly that includes a mud motor and a bit; generating a sequence for operation of the mud motor using a model of at least the bit, where the sequence includes a sliding mode and a rotary mode for drilling the borehole in the formation a distance less than or equal to the length of pipe; and drilling the borehole according to the sequence. In such an example, the drilling can include switching from one of the sliding mode and the rotary mode to one of the rotary mode and the sliding mode, respectively.

As an example, a method can include determining a ratio of drilling distance of sliding and rotating operation modes for each drilling stand. As an example, for a sliding mode, operation control can include a command for a motor toolface demand that can set a toolface orientation, for example, using an adjustable bent housing mechanism (see, e.g., the surface-adjustable bent housing (SAB) 816 of FIG. 8).

As an example, a model can be a physics-based model that represents interaction between a bit and a formation using a numerical computation technique.

As an example, a sequence can correspond to a toolface variation (e.g., a toolface angle or "toolface").

As an example, a method can include generating a plurality of sequences where each of the sequences corresponds to a different toolface variation of a plurality of toolface variations. In such an example, the toolface variations can be specified as toolface angles.

As an example, a method can include generating a sequence for operation of a mud motor using a model of at least a bit by predicting positions for different sliding mode to rotary mode ratios and selecting the sequence by comparing at least one of the predicted positions to a position of a borehole trajectory (e.g., a planned borehole trajectory).

As an example, generating a sequence for operation of a mud motor using a model of at least a bit can include predicting positions for different sliding mode to rotary mode ratios, comparing the predicted positions to a position of a borehole trajectory and, based on the comparing, refining a range of the different sliding mode to rotary mode ratios.

As an example, a sequence can specify a distance as a sum of a distance for sliding mode operation and a distance for rotary mode operation.

As an example, a method can include generating a sequence by using one or more constraints such as, for example, a constraint as to a number of transitions. For example, consider an approach that limits a sequence to a single mode transition (e.g., from a sliding mode to a rotary mode or from a rotary mode to a sliding mode). As an example, a generated sequence can include a single mode transition for a length of pipe, which may be a single pipe or a stand (e.g., multiple pipes connected to form a stand).

As an example, a method can include receiving a mode transition limit, where the mode transition limit is less than five mode transitions (e.g., for a pipe, a stand, etc.).

As an example, a method can include, responsive to drilling according to a sequence, receiving survey data and generating another sequence using at least a portion of the survey data.

As an example, a method can include generating to generate a plurality of sequences prior to the drilling where, for example, the plurality of sequences can be part of a well construction plan. As an example, a method can include receiving sensor data in real-time during drilling according to a sequence and generating another sequence at least in part during a period of time bound by an in-slips operation and an out-of-slips operation, where the out-of-slips operation corresponds to a drilling operation for drilling another distance less than or equal to the length of pipe (e.g., a single pipe, a stand, etc.). Such a method can include drilling according to the generated other sequence.

As mentioned, a length of pipe can be a stand, which may be, for example, approximately 90 ft or 30 m, and formed from individual pipes connected together to form the stand. As an example, a length of pipe can be greater than approximately 5 meters and less than approximately 100 meters.

As an example, a system can include a processor; memory accessible by the processor; processor-executable instructions stored in the memory and executable to instruct the system to: receive data for a borehole trajectory in a formation, a length of pipe, and a bottom hole assembly that includes a mud motor and a bit; generate a sequence for operation of the mud motor using a model of at least the bit, where the sequence includes a sliding mode and a rotary mode for drilling the borehole in the formation a distance less than or equal to the length of pipe; and drill the borehole according to the sequence.

As an example, one or more computer-readable storage media can include processor-executable instructions to instruct a computing system to: receive data for a borehole trajectory in a formation, a length of pipe, and a bottom hole assembly that includes a mud motor and a bit; generate a sequence for operation of the mud motor using a model of at least the bit, where the sequence includes a sliding mode and a rotary mode for drilling the borehole in the formation a distance less than or equal to the length of pipe; and drill the borehole according to the sequence.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 40:
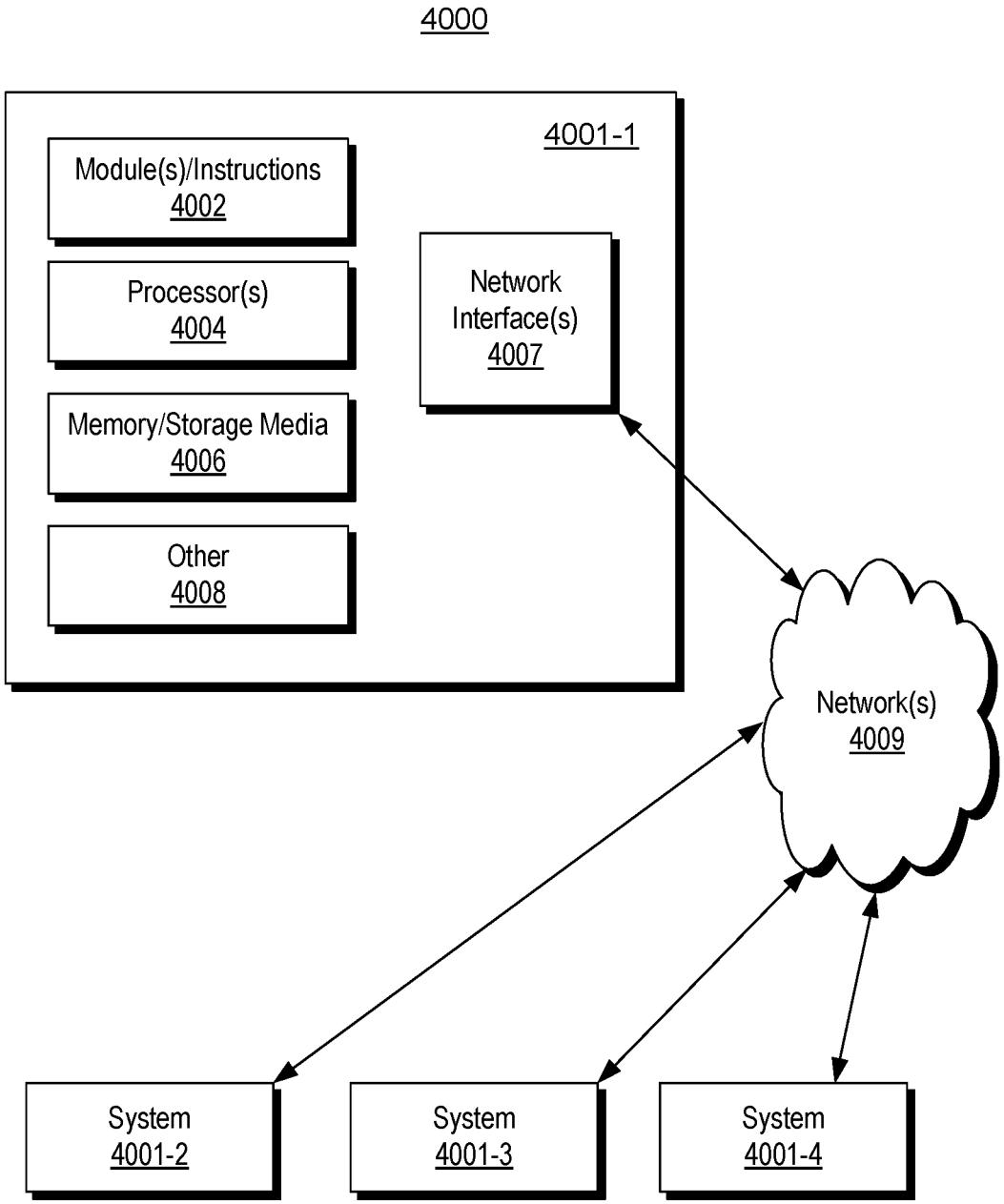
FIG. 40 illustrates an example of computing system.

In some embodiments, a method or methods may be executed by a computing system. FIG. 40 shows an example of a system 4000 that can include one or more computing systems 4001-1, 4001-2, 4001-3 and 4001-4, which may be operatively coupled via one or more networks 4009, which may include wired and/or wireless networks.

As an example, a system can include an individual computer system or an arrangement of distributed computer systems. In the example of FIG. 40, the computer system 4001-1 can include one or more modules 4002, which may be or include processor-executable instructions, for example, executable to perform various tasks (e.g., receiving information, requesting information, processing information, simulation, outputting information, etc.).

As an example, a module may be executed independently, or in coordination with, one or more processors 4004, which is (or are) operatively coupled to one or more storage media 4006 (e.g., via wire, wirelessly, etc.). As an example, one or more of the one or more processors 4004 can be operatively coupled to at least one of one or more network interface 4007. In such an example, the computer system 4001-1 can transmit and/or receive information, for example, via the one or more networks 4009 (e.g., consider one or more of the Internet, a private network, a cellular network, a satellite network, etc.).

As an example, the computer system 4001-1 may receive from and/or transmit information to one or more other devices, which may be or include, for example, one or more of the computer systems 4001-2, etc. A device may be located in a physical location that differs from that of the computer system 4001-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 4006 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

Figure 41:
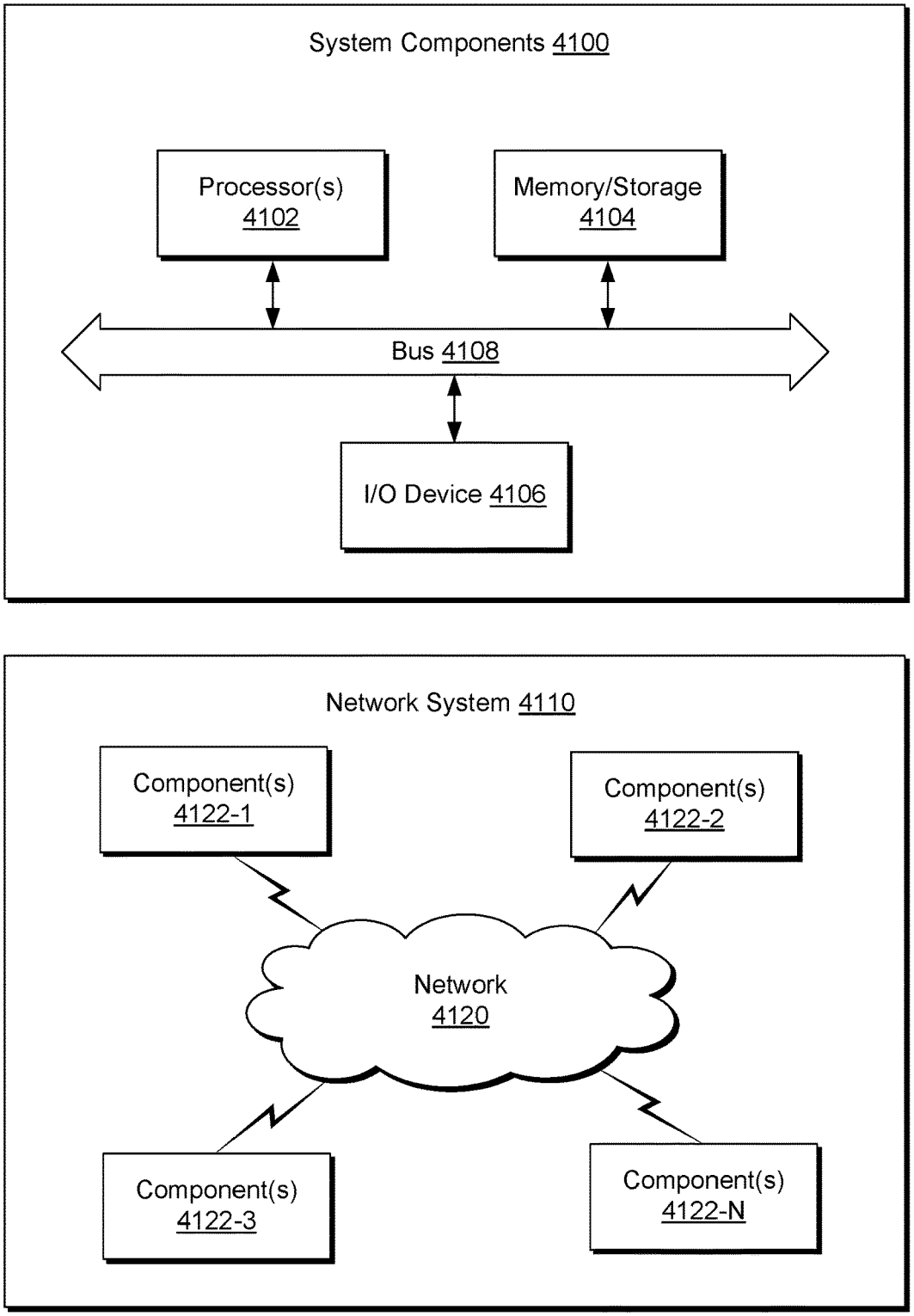
FIG. 41 illustrates example components of a system and a networked system.

FIG. 41 shows components of a computing system 4100 and a networked system 4110. The system 4100 includes one or more processors 4102, memory and/or storage components 4104, one or more input and/or output devices 4106 and a bus 4108. According to an embodiment, instructions may be stored in one or more computer-readable media (e.g., memory/storage components 4104). Such instructions may be read by one or more processors (e.g., the processor(s) 4102) via a communication bus (e.g., the bus 4108), which may be wired or wireless. The one or more processors may execute such instructions to implement (wholly or in part) one or more attributes (e.g., as part of a method). A user may view output from and interact with a process via an I/O device (e.g., the device 4106). According to an embodiment, a computer-readable medium may be a storage component such as a physical memory storage device, for example, a chip, a chip on a package, a memory card, etc.

According to an embodiment, components may be distributed, such as in the network system 4110. The network system 4110 includes components 4122-1, 4122-2, 4122-3, . . . 4122-N. For example, the components 4122-1 may include the processor(s) 4102 while the component(s) 4122-3 may include memory accessible by the processor(s) 4102. Further, the component(s) 4122-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method comprising:

receiving data for a borehole trajectory in a formation, a length of pipe, and a bottom hole assembly that comprises a mud motor and a bit;

receiving a mode transition limit;

generating a sequence for operation of the mud motor using a model of at least the bit, wherein the sequence comprises a sliding mode and a rotary mode for drilling the borehole in the formation a distance less than or equal to the length of pipe, and wherein the mode transition limit is less than five mode transitions; and drilling the borehole according to the sequence.

2. The method of claim 1 wherein the drilling comprises switching from one of the sliding mode and the rotary mode to one of the rotary mode and the sliding mode, respectively.

3. The method of claim 1 wherein the model comprises a physics-based model that represents interaction between the bit and the formation using a numerical computation technique.

4. The method of claim 1 wherein the sequence corresponds to a toolface variation.

5. The method of claim 1 comprising generating a plurality of sequences wherein each of the sequences corresponds to a different toolface variation of a plurality of toolface variations.

6. The method of claim 5 wherein the toolface variations are specified as toolface angles.

7. The method of claim 1 wherein the generating comprises predicting positions for different sliding mode to rotary mode ratios and selecting the sequence by comparing at least one of the predicted positions to a position of the borehole trajectory.

8. The method of claim 1 wherein the generating comprises predicting positions for different sliding mode to rotary mode ratios, comparing the predicted positions to a position of the borehole trajectory and, based on the comparing, refining a range of the different sliding mode to rotary mode ratios.

9. The method of claim 1 wherein the sequence specifies the distance as a sum of a distance for sliding mode operation and a distance for rotary mode operation.

10. The method of claim 1 wherein the mode transition limit is equal to one to limit the generating of the sequence to a single mode transition.

11. The method of claim 1 wherein the sequence comprises a single mode transition.

12. The method of claim 1 comprising, responsive to the drilling, receiving survey data and generating another sequence using at least a portion of the survey data.

13. The method of claim 1 wherein the generating generates a plurality of sequences prior to the drilling.

14. The method of claim 13 wherein the plurality of sequences are part of a well construction plan.

15. The method of claim 13 comprising receiving sensor data in real-time and generating another sequence at least in part during a period of time bound by an in-slips operation and an out-of-slips operation, wherein the out-of-slips operation corresponds to a drilling operation for drilling another distance less than or equal to the length of pipe.

16. The method of claim 1 wherein the length of pipe comprises a stand.

17. The method of claim 1 wherein the length of pipe is greater than approximately 5 meters and less than approximately 100 meters.

18. The method of claim 1, wherein the model comprises a bottom hole assembly tendency model that predicts positions for different sliding mode to rotary mode ratios for the length of pipe.

19. A system comprising:

a processor;

memory accessible by the processor;

processor-executable instructions stored in the memory and executable to instruct the system to:

receive data for a borehole trajectory in a formation, a length of pipe, and a bottom hole assembly that comprises a mud motor and a bit;

receive a mode transition limit;

generate a sequence for operation of the mud motor using a model of at least the bit, wherein the sequence comprises a sliding mode and a rotary mode for drilling the borehole in the formation a distance less than or equal to the length of pipe, and wherein the mode transition limit is less than five mode transitions; and drill the borehole according to the sequence.

20. One or more computer-readable storage media comprising processor-executable instructions to instruct a computing system to:

receive data for a borehole trajectory in a formation, a length of pipe, and a bottom hole assembly that comprises a mud motor and a bit;

receive a mode transition limit;

generate a sequence for operation of the mud motor using a model of at least the bit, wherein the sequence comprises a sliding mode and a rotary mode for drilling the borehole in the formation a distance less than or equal to the length of pipe, and wherein the mode transition limit is less than five mode transitions; and drill the borehole according to the sequence.

* * * * *